US007264338B2

(12) United States Patent
Ogata et al.

(10) Patent No.: US 7,264,338 B2
(45) Date of Patent: Sep. 4, 2007

(54) RECORDING HEAD, CARRIAGE AND IMAGE FORMING APPARATUS

(75) Inventors: Kenichi Ogata, Kanagawa (JP); Takahiro Yoshida, Kanagawa (JP); Hirotoshi Eguchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 215 days.

(21) Appl. No.: 10/530,607

(22) PCT Filed: Mar. 23, 2004

(86) PCT No.: PCT/JP2004/003919

§ 371 (c)(1),
(2), (4) Date: Apr. 7, 2005

(87) PCT Pub. No.: WO2004/085161

PCT Pub. Date: Oct. 7, 2004

(65) Prior Publication Data

US 2006/0007272 A1 Jan. 12, 2006

(30) Foreign Application Priority Data

Mar. 24, 2003 (JP) ..... 2003-079443
Apr. 1, 2003 (JP) ..... 2003-097592
Oct. 24, 2003 (JP) ..... 2003-364294

(51) Int. Cl.
*B41J 2/045* (2006.01)

(52) U.S. Cl. ..... 347/70; 347/68
(58) Field of Classification Search ..... 347/68, 347/70
See application file for complete search history.

(56) References Cited

FOREIGN PATENT DOCUMENTS

| | | | |
|---|---|---|---|
| EP | 670218 | A2 * | 9/1995 |
| EP | 0670218 | A2 | 9/1995 |
| JP | 6-191030 | | 7/1994 |
| JP | 7-125235 | | 5/1995 |
| JP | 7-171969 | | 7/1995 |
| JP | 8-108534 | | 4/1996 |
| JP | 9-141856 | | 6/1997 |
| JP | 10-264378 | | 10/1998 |
| JP | 10264378 | A * | 10/1998 |
| JP | 2000-158668 | | 6/2000 |
| JP | 2000-301714 | | 10/2000 |
| JP | 2002-254630 | | 9/2002 |
| JP | 2002254630 | A * | 9/2002 |

OTHER PUBLICATIONS

Partial International Search Report for PCT/JP2004/003919, Jan. 6, 2004.*

* cited by examiner

*Primary Examiner*—Matthew Luu
*Assistant Examiner*—Lisa M Solomon
(74) *Attorney, Agent, or Firm*—Cooper & Dunham

(57) ABSTRACT

A recording head is provided with a plurality of nozzles for ejecting a fluid, a plurality of pressure-applied chambers arranged in a predetermined direction and each communicating with a corresponding one of the nozzles, and a common chamber having a plurality of wall surfaces and configured to supply the fluid to the pressure-applied chambers. At least one of the wall surfaces of the common chamber, along the predetermined direction, has a pressure absorbing surface with a rigidity lower than those of other wall surfaces and configured to absorb a pressure change, and the pressure absorbing surface is formed by a pressure absorbing member having a non-uniform thickness.

32 Claims, 28 Drawing Sheets

RECORDING HEAD, CARRIAGE AND IMAGE FORMING APPARATUS

TECHNICAL FIELD

The present invention generally relates to recording heads, carriages and image forming apparatuses, and more particularly to a recording head for ejecting fluid such as ink, a carriage having at least one recording head, and an image forming apparatus having at least one carriage.

An ink-jet recording apparatus is used as an image forming apparatus for printers, facsimile apparatuses, copying apparatuses, plotters and the like. The ink-jet recording apparatus is provided with an ink-jet recording head which includes an ink flow passage and a pressure converting means for applying pressure on the ink by varying the pressure within the ink flow passage. The ink flow passage is also often referred to as an ink ejecting chamber, a pressure chamber, a pressure-applied ink chamber, an ink chamber or the like.

BACKGROUND ART

There is a known ink-jet recording head which uses an electro-mechanical conversion element, such as a piezoelectric element, as the pressure converting means for variably applying pressure on the ink within the ink chamber. A resiliently deformable vibration plate, which forms a wall of the ink chamber, is deformed by a driving means, by use of the pressure converting means, so as to eject an ink drop by varying the volume and/or pressure within the ink chamber. The so-called piezoelectric type ink-jet recording head corresponds to such an ink-jet recording head. For example, Japanese Laid-Open Patent Application No. 8-108534 proposes such a piezoelectric type ink-jet recording head.

A description will be given of the piezoelectric type ink-jet recording head, by referring to FIGS. 1 and 2. FIG. 1 is a cross sectional view showing the piezoelectric type ink-jet recording head cut along a longitudinal direction of a pressure-applied ink chamber, that is, along a direction perpendicular to a direction in which nozzles are arranged. FIG. 2 is a cross sectional view showing the piezoelectric type ink-jet recording head cut along a direction perpendicular to the longitudinal direction of the pressure-applied ink chamber, that is along the direction in which the nozzles are arranged.

The ink-jet recording head shown in FIGS. 1 and 2 includes an ink chamber substrate 211 and a nozzle plate 218 which are connected. A pressure-applied ink chamber 214 communicates to a nozzle 213 which ejects the ink drop. A common ink chamber 219 supplies the ink to the pressure-applied ink chamber 214 via a connecting part 220. A piezoelectric element 217 is provided on a base substrate 212, on the outer side of a vibration plate 216 which forms a portion of a wall of the pressure-applied ink chamber 214.

The vibration plate 216 undergoes resilient deformation as the piezoelectric element 217 is deformed. In order to efficiently convert a displacement of the piezoelectric element into a volume change of the pressure-applied ink chamber 214, the rigidity of the vibration plate 216 is normally smaller than that of other surfaces forming the pressure-applied ink chamber 214. In other words, the compliance of the vibration plate 216 is normally larger than that of the other surfaces forming pressure-applied ink chamber 214. In addition, the common ink chamber 219 is connected to an ink tank (not shown), and a support member 221 is provided between the ink chamber substrate 211 and the base substrate 212.

The piezoelectric element 217 is deformed by applying a voltage to the piezoelectric element 217 from a driving circuit (not shown), to displace the vibration plate 216 so as to increase or decrease the volume of the pressure-applied ink chamber 214. When the volume of the pressure-applied ink chamber 214 increases, the internal pressure of the pressure-applied ink chamber 214 decreases, and the ink from the common ink chamber 219 is supplied to the pressure-applied ink chamber 214 via the connecting part 220.

Thereafter, the piezoelectric element 217 is driven so as to increase the internal pressure of the pressure-applied ink chamber 214. In other words, when the piezoelectric element 217 is driven so as to decrease the volume of the pressure-applied ink chamber 214, the internal pressure of the pressure-applied ink chamber 214 increases, and the ink is ejected from the nozzle 213 in the form of an ink drop 222. The ink drop 222 adheres on a recording medium (not shown) such as paper, to record an image or the like on the recording medium.

The ink-jet recording head may use elements other than the piezoelectric element for the pressure converting means for causing the ink to be ejected, such as a thermal actuator, a shape memory alloy actuator and an electrostatic actuator. The thermal actuator utilizes a phase change caused by film boiling of the ink by using an element which converts electricity into heat, such as a heating resistor. The shape memory alloy actuator uses a metal phase change caused by temperature change. The electrostatic actuator uses electrostatic force.

When ejecting the ink drop from the ink-jet recording head as described above, it is necessary to increase the pressure of the pressure-applied ink chamber. In addition, the generated pressure not only causes the ink to be ejected, but is also applied to the common ink chamber. However, when the pressure applied to the common ink chamber is again applied to the pressure-applied ink chamber, the pressure of the pressure-applied ink chamber varies.

Particular in the case of the ink-jet recording head having a large number of nozzles, the pressure change at the time of a multi-channel drive is large, and causes resonance (mutual interference) of the ink chamber. If the resonance frequency of the vibration matches the driving frequency of the recording, the ink ejection is affected thereby to deteriorate the picture quality of the recorded image.

In order to prevent the problem associated with the resonance frequency, it is necessary to increase the pressure damping efficiency of the common ink chamber. Generally, this is achieved by setting the volume of the common ink chamber to a relatively large value. On the other hand, a Japanese Laid-Open Patent Application No. 6-191030 proposes another method which provides a plurality of damper chambers between the ink chamber and the common ink chamber, so as to absorb a pressure change within the ink chamber.

In addition, although for a different purpose, a Japanese Laid-Open Patent Application No. 2000-158668 proposes a method of providing a plurality of damper chambers within an ink supply passage from the ink tank to the ink-jet recording head, in order to absorb a change in the ink supply pressure. In other words, the damper chambers are provided to reduce the pressure change when supplying the ink from the outside to the common ink chamber of the ink-jet recording head.

However, since the damper chamber is provided for each individual ink chamber of the ink-jet recording head according to the Japanese Laid-Open Patent Application No. 6-191030, it is difficult to sufficiently reduce the rigidity of the damper chamber, and it is difficult to effectively absorb the pressure. Furthermore, the structure of the ink-jet recording head becomes complex, thereby requiring a complex production process to produce the ink-jet recording head. Recently, the trend is for the number of nozzles of the ink-jet recording head to increase in order to cope with the demands for high-speed recording, but the structure proposed in the Japanese Laid-Open Patent Application No. 6-191030 is unsuited for application to this trend.

On the other hand, the ink-jet recording head proposed in the Japanese Laid-Open Patent Application No. 2000-158668 reduces the pulsation in the ink supply, and does not absorb the pressure change of the common ink chamber when the ink-jet recording head is driven. In addition, the structure of the ink-jet recording head becomes complex, thereby requiring a complex production process to produce the ink-jet recording head.

DISCLOSURE OF THE INVENTION

It is a general object of the present invention to provide a recording head, carriage and image forming apparatus, in which the problems described above are suppressed.

A more specific object of the present invention is to provide a recording head, a carriage and an image forming apparatus, which can realize a high-speed and high-quality recording, by efficiently damping a pressure change of a common chamber while reducing a resonance of the common chamber.

Still another object of the present invention is to provide a recording head comprising a plurality of nozzles for ejecting a fluid; a plurality of pressure-applied chambers arranged in a predetermined direction and each communicating with a corresponding one of the nozzles; and a common chamber having a plurality of wall surfaces and configured to supply the fluid to the pressure-applied chambers, at least one of the wall surfaces of the common chamber, along the predetermined direction, having a pressure absorbing surface with a rigidity lower than those of other wall surfaces and configured to absorb a pressure change, the pressure absorbing surface being formed by a pressure absorbing member having a non-uniform thickness. According to the recording head of the present invention, it is possible to suppress a resonance frequency of the pressure absorbing surface from decreasing while maintaining the rigidity of the pressure absorbing surface, so that a driving frequency of the recording head and the resonance frequency becomes different and a stable fluid-jet characteristic can be obtained even when the recording head is driven at a high speed. For this reason, it is possible to record an image having a high picture quality at a high speed.

A further object of the present invention is to provide a recording head comprising a plurality of nozzles for ejecting a fluid; a plurality of pressure-applied chambers arranged in a predetermined direction and each communicating with a corresponding one of the nozzles; a common chamber having a plurality of wall surfaces and configured to supply the fluid to the pressure-applied chambers; and a plurality of pressure converting means for varying pressures within the pressure-applied chambers, at least one of the wall surfaces of the common chamber, along the predetermined direction, having a pressure absorbing surface with a rigidity lower than those of other wall surfaces and configured to absorb a pressure change, the pressure absorbing surface being formed by a pressure absorbing member having a plurality of portions with different rigidities. According to the recording head of the present invention, it is possible to suppress a resonance frequency of the pressure absorbing surface from decreasing while maintaining the rigidity of the pressure absorbing surface, so that a driving frequency of the recording head and the resonance frequency becomes different and a stable fluid-jet characteristic can be obtained even when the recording head is driven at a high speed. For this reason, it is possible to record an image having a high picture quality at a high speed.

Another object of the present invention is to provide a carriage comprising one of the recording heads described above; and a fluid cartridge configured to supply the fluid to the recording head. According to the carriage of the present invention, it is possible to record an image having a high picture quality at a high speed.

Still another object of the present invention is to provide an image forming apparatus comprising one of the recording heads described above; a fluid cartridge configured to supply the fluid to the recording head; and a cartridge, accommodating the recording head and the fluid cartridge, configured to move in a main scan direction which is perpendicular to the predetermined direction. According to the image forming apparatus of the present invention, it is possible to record an image having a high picture quality at a high speed.

A further object of the present invention is to provide a recording head comprising a plurality of nozzles for ejecting a fluid; a plurality of pressure-applied chambers arranged in a predetermined direction and each communicating with a corresponding one of the nozzles; a common chamber having a plurality of wall surfaces and configured to supply the fluid to the pressure-applied chambers; and a plurality of pressure converting means for varying pressures within the pressure-applied chambers, at least one of the wall surfaces of the common chamber, along the predetermined direction, having a damping surface with a rigidity lower than those of other wall surfaces and configured to absorb a pressure by vibration, the damping surface being formed by a pressure absorbing member which partially has a region where no damping surface is formed, such that the damping surface extends for a length along the predetermined direction less than a total length of the common chamber along the predetermined direction. According to the recording head of the present invention, it is possible to adjust the rigidity of the pressure absorbing member independently of the shape of the common chamber, and control a resonance frequency of the pressure absorbing member. Consequently, the resonance frequency of the pressure absorbing member can be separated from a driving frequency of the recording head, thereby making it possible to stabilize the fluid-jet characteristic and realize a high picture quality even when the recording head is driven at a high driving frequency.

Another object of the present invention is to provide a carriage comprising the recording head described immediately above; and a fluid cartridge configured to supply the fluid to the recording head. According to the carriage of the present invention, it is possible to record an image having a high picture quality at a high speed.

Still another object of the present invention is to provide an image forming apparatus comprising the recording head described immediately above; a fluid cartridge configured to supply the fluid to the recording head; and a cartridge, accommodating the recording head and the fluid cartridge, configured to move in a main scan direction which is perpendicular to the predetermined direction. According to the image forming apparatus of the present invention, it is possible to record an image having a high picture quality at a high speed.

A further object of the present invention is to provide a recording head comprising a plurality of nozzles for ejecting a fluid; a plurality of pressure-applied chambers arranged in a predetermined direction and each communicating with a corresponding one of the nozzles; and a common chamber having a plurality of wall surfaces and configured to supply the fluid to the pressure-applied chambers, at least one of the wall surfaces of the common chamber having a free vibration surface having thick portions and thin portions. According to the recording head of the present invention, it is possible to effectively suppress and damp the pressure change of the common chamber, improve the ink-jet characteristic, and reduce both the size and cost of the recording head.

Another object of the present invention is to provide a carriage comprising the recording head described immediately above; and a fluid cartridge configured to supply the fluid to the recording head. According to the carriage of the present invention, it is possible to record an image having a high picture quality at a high speed.

Still another object of the present invention is to provide an image forming apparatus comprising the recording head described immediately above; a fluid cartridge configured to supply the fluid to the recording head; and a cartridge, accommodating the recording head and the fluid cartridge, configured to move in a main scan direction which is perpendicular to the predetermined direction. According to the image forming apparatus of the present invention, it is possible to record an image having a high picture quality at a high speed.

Other objects and further features of the present invention will be apparent from the following detailed description when read in conjunction with the accompanying drawings.

BEST MODE FOR CARRYING OUT THE INVENTION

Figure 1:
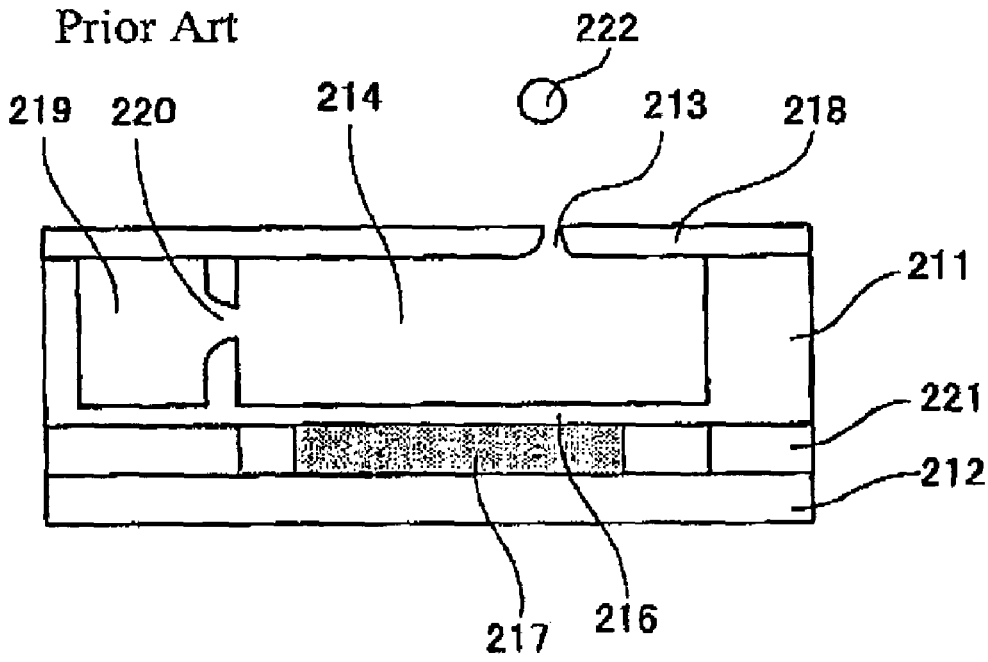
FIG. 1 is a cross sectional view showing a piezoelectric type ink-jet recording head cut along a direction perpendicular to a direction in which nozzles are arranged.
Figure 2:
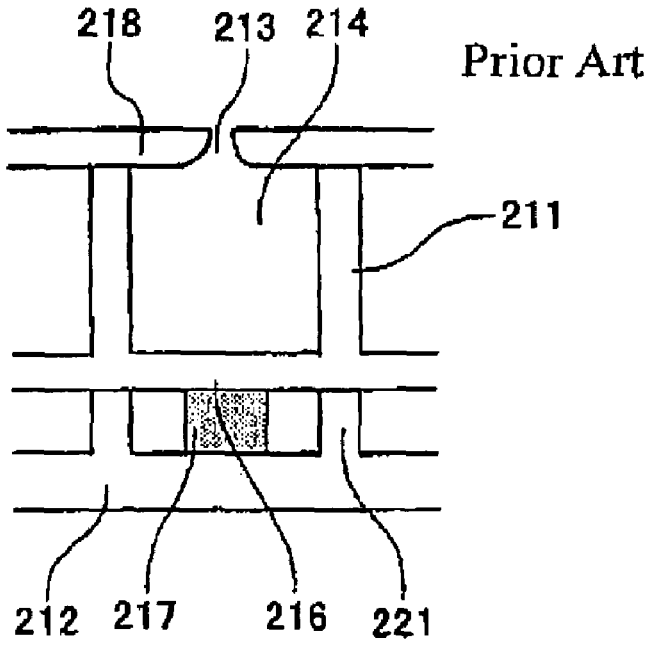
FIG. 2 is a cross sectional view showing the piezoelectric type ink-jet recording head cut along the direction in which the nozzles are arranged.
Figure 3:
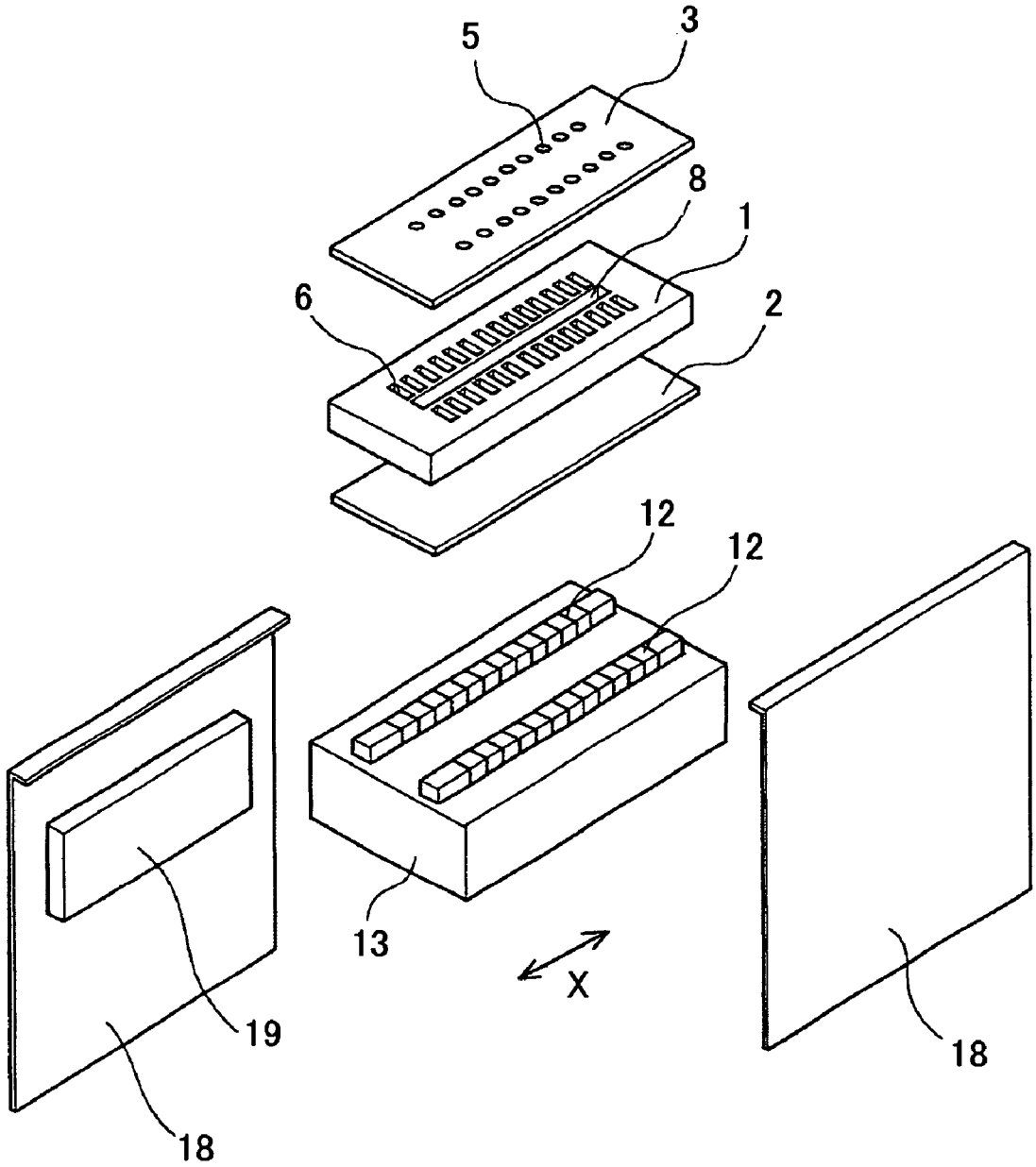
FIG. 3 is a disassembled perspective view showing a first embodiment of a recording head according to the present invention.
Figure 4:
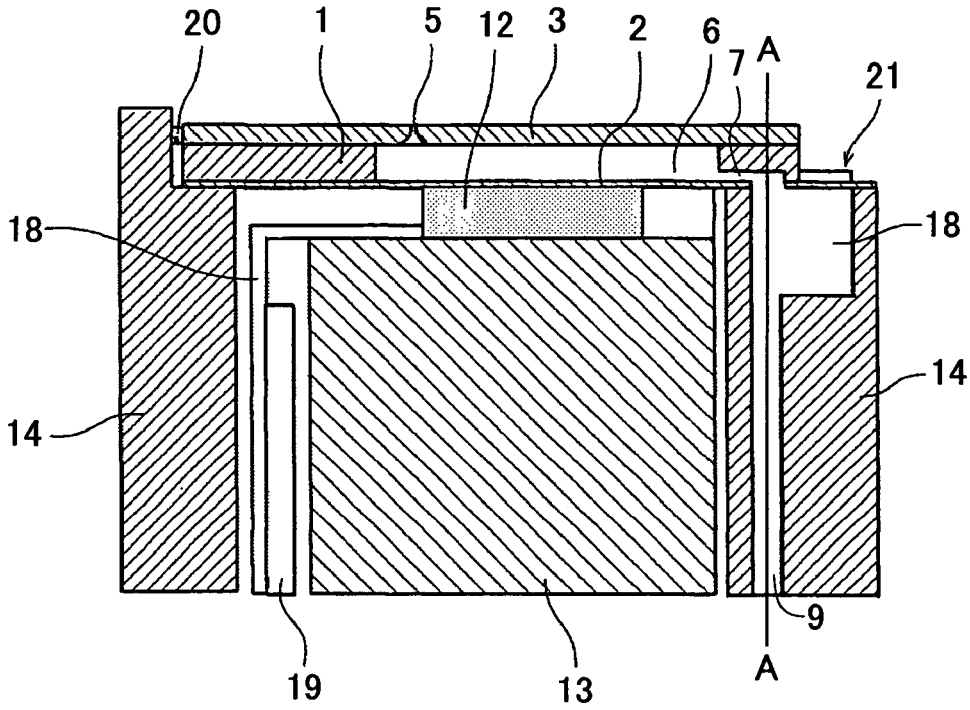
FIG. 4 is a cross sectional view showing the first embodiment of the recording head cut along a direction perpendicular to a direction in which nozzles are arranged.
Figure 5:
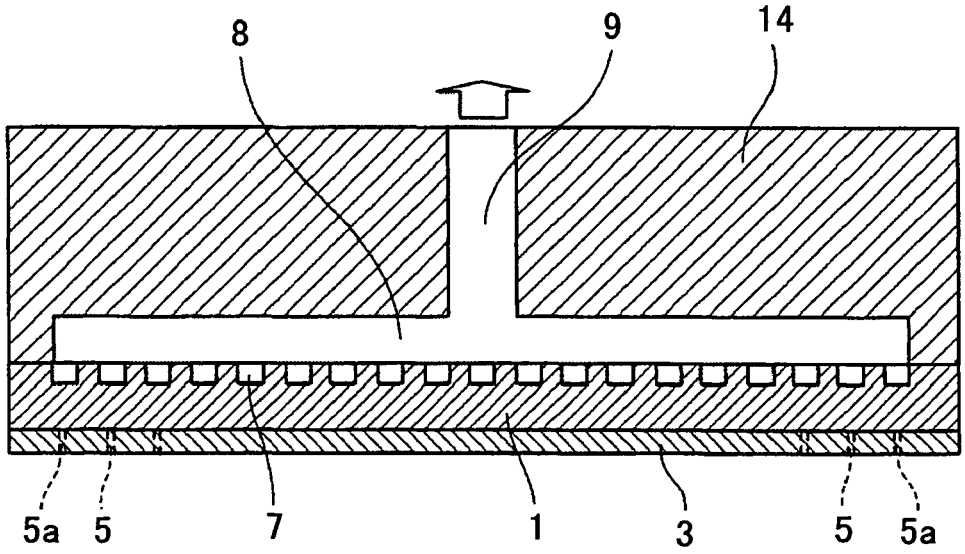
FIG. 5 is an inverted cross sectional view showing the first embodiment of the recording head cut along the direction in which the nozzles are arranged.

First, a description will be given of a first embodiment of a recording head according to the present invention, by referring to FIGS. 3 through 5. FIG. 3 is a disassembled perspective view showing this first embodiment of the recording head, and FIG. 4 is a cross sectional view showing this first embodiment of the recording head cut along a longitudinal direction of a pressure-applied ink chamber, that is along a direction perpendicular to a direction in which nozzles are arranged. FIG. 5 is an inverted cross sectional view showing this first embodiment of the recording head cut along the direction (A-A in FIG. 4) in which nozzles are arranged. In this first embodiment of the recording head, the present invention is applied to an ink-jet recording head.

The ink-jet recording head shown in FIGS. 3 through 5 includes a flow passage forming substrate (ink chamber substrate) 1 which is made of single crystal silicon (Si), a vibration plate 2 provided on a lower surface of the flow passage forming substrate 1, a nozzle plate 3 provided on an upper surface of the flow passage forming substrate 1, and a frame member 14 which will be described later. The flow passage forming substrate 1, the vibration plate 2, the nozzle plate 3 and the frame member 14 form pressure-applied ink chambers 6 and a common ink chamber 8. Each nozzle 5 which ejects an ink drop communicates to one of the pressure-applied ink chambers 6 which forms a flow passage. The common ink chamber 8 supplies the ink to the pressure-applied ink chambers 6 via an ink supply passage (communicating part) 7 which forms a flow resistance portion.

A stacked piezoelectric element 12 is provided with respect to each pressure-applied ink chamber 6 on the outer surface side of the vibration plate 2, that is, on the side opposite to the pressure-applied ink chamber 6, as a driving means. The piezoelectric element 12 is fixed on a base substrate 13.

A groove portion, which forms the common ink chamber 8 together with the flow passage forming substrate 1, is formed in the frame member 14. In addition, an ink supply opening (communication tube) 9, which supplies the ink to the common ink chamber 8 from the outside, is formed in the frame member 14. This ink supply opening 9 is connected to an ink supply source (not shown) such as an ink cartridge.

A flexible printed circuit (FPC) cable 18 is connected to the piezoelectric elements 12 by soldering, AFC bonding or wire-bonding, for supplying driving signals. The FPC cable 18 is provided with a driving circuit (driver IC) for selectively applying a driving waveform to each of the piezoelectric elements 12.

Penetrating holes for forming the pressure-applied ink chambers 6 and the groove for forming the ink supply passage 7 are formed in the flow passage forming substrate 1 by carrying out an anisotropic etching of a single crystal silicon substrate having a (110) crystal orientation, using an alkaline etchant such as potassium hydroxide (KOH) solution.

The vibration plate 2 is made of a metal plate which is formed by electroforming. Each nozzle 5 corresponding to one of the pressure-applied ink chambers 6 is formed in the nozzle plate 3 to have a diameter of approximately 10 μm to approximately 30 μm. The vibration plate 2 is fixed on the flow passage forming substrate by an adhesive. The pressure-applied ink chamber 6 corresponding to a nozzle 5*a* shown in FIG. 5 which is located on one end of the common ink chamber 8 along a longitudinal direction thereof, may not be used to form the image, so as to use the nozzle 5*a* as a dummy nozzle for suction to eject air bubbles. Further, both nozzles 5*a* located on the respective ends of the common ink chamber 8 along the longitudinal direction thereof, may be used as such dummy nozzles.

The nozzle plate 3 may be made of a metal such as stainless steel and nickel (Ni), a combination of a metal and a resin such as polyimide resin film, silicon, or a combination of such materials. A water repellent layer is formed on a nozzle surface of the nozzle plate 3, that is, the surface from which the ink is ejected, to ensure that the nozzle surface repels the ink. The water repellent layer may be formed on the nozzle surface by a known method such as plating and coating the water repellent layer. A sealant 20 fills a gap between a periphery of the nozzle plate 3 and the frame member 14. This sealant 20 also functions as an adhesive.

When a driving pulse voltage of approximately 20 V to approximately 50 V is selectively applied to the piezoelectric elements 12 of the ink-jet recording head having the above described structure, the piezoelectric element 12 which is applied with the driving pulse voltage is displaced in a direction in which the layers of the piezoelectric element 12 are stacked, and the vibration plate 2 is deformed in a direction of the corresponding nozzle 5. As a result, the volume or capacity of the corresponding pressure-applied ink chamber 6 changes to apply pressure on the ink within the pressure-applied ink chamber 6, and the ink drop is ejected from the corresponding nozzle 5 to enable the ink-jet recording.

As the ink is ejected, the ink pressure within the pressure-applied ink chamber 6 decreases, and a slight negative pressure is generated within the pressure-applied ink chamber 6 due to inertia of the ink flow. In this state, the vibration plate 2 returns to its original position and the pressure-applied ink chamber 6 returns to its original shape when the application of the driving pulse voltage to the piezoelectric element 12 is stopped, that is, when the driving pulse voltage is turned OFF, and as a result, the negative pressure is further generated within the pressure-applied ink chamber 6. In this state, the ink is supplied to the pressure-applied ink chamber 6 from the ink supply opening 9 via the common ink chamber 8 and the ink supply passage 7 which forms the flow resistance portion. Hence, after the vibration of an ink meniscus surface at the nozzle 5 is damped and stabilizes, the driving pulse voltage is applied to the piezoelectric element 12 to eject the ink drop to enable the next ink-jet recording.

In FIGS. 3 and 4, the nozzles 5 shown face upwards. But when actually ejecting the ink drop on the recording medium such as paper to carry out the ink-jet recording, the ink drop is ejected vertically downwards in most cases. Accordingly, in this embodiment, the ink drop may similarly be ejected vertically downwards in FIG. 5 with respect to the recording medium, such as paper, which is transported horizontally, when carrying out the ink-jet recording of the image.

Figure 6:
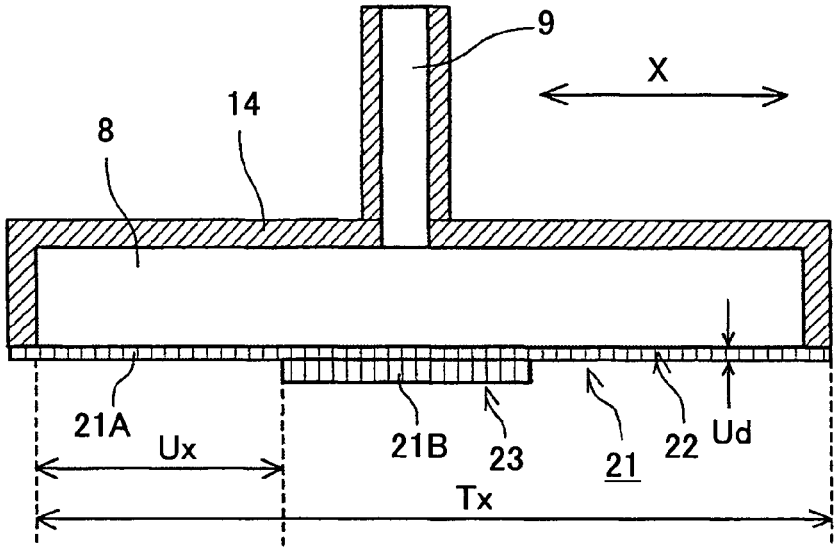
FIG. 6 is a cross sectional view on an enlarged scale showing a portion of a common ink chamber cut along the direction in which the nozzles are arranged.
Figure 7:
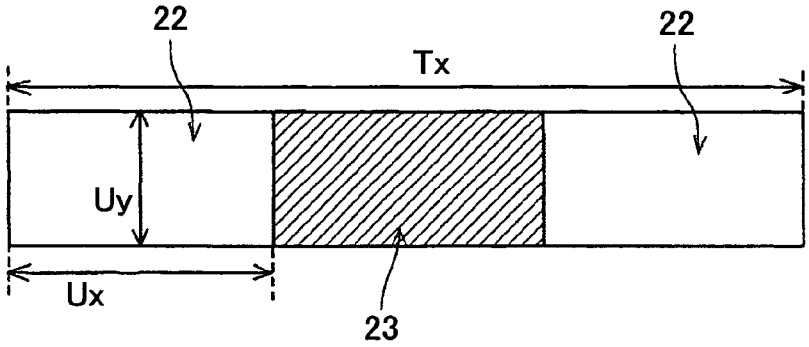
FIG. 7 is a plan view for explaining a pressure absorbing member.
Figure 8:
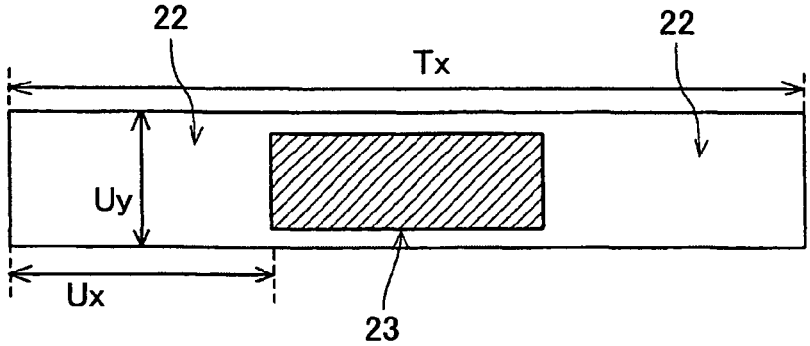
FIG. 8 is a plan view for explaining another pressure absorbing member.

Next, a description will be given of a structure of the common ink chamber 8 of the ink-jet recording head, by referring to FIGS. 6 through 8. FIG. 6 is a cross sectional view on an enlarged scale showing a portion of the common ink chamber 8 cut along the direction in which the nozzles 5 are arranged. In addition, FIG. 7 is a plan view for explaining a pressure absorbing member, and FIG. 8 is a plan view for explaining another pressure absorbing member.

In this embodiment of the recording head, the common ink chamber 8 is formed by the frame member 14 and a pressure absorbing member 21 which has a rigidity smaller than that of the frame member 14, as shown in FIG. 6. The pressure absorbing member 21 forms a pressure absorbing surface 21*a*. If a direction in which the pressure-applied ink chambers 6 are arranged is denoted by X, at least one of wall surfaces of the common ink chamber 8 along the direction X is formed by the pressure absorbing surface 21*a* which has a rigidity smaller than that of the other wall surfaces and absorbs the pressure.

As shown in FIG. 6, the pressure absorbing member 21, which forms the pressure absorbing surface 21*a*, has a thickness which is non-uniform along the direction X. In other words, a central portion of the pressure absorbing member 21 is thick on the average, and both end portions of the pressure absorbing member 21 are thin. More particularly, if the pressure absorbing surface 21 is divided into 3 regions of approximately the same size along the direction X, an average thickness of the central portion is larger than an average thickness of the end portions on both sides of the central portion along the direction X. Hence, a thick portion 23 is formed at the central portion of the pressure absorbing member 21, and thin portions 22 are formed on the end portions of the pressure absorbing member 21 on both sides of the central portion along the direction X. Of course, it is possible to divide the pressure absorbing surface 21*a* into more than 3 regions of approximately the same size along the direction X, and to form the thick portion 23 at the central portion of the pressure absorbing member 21. The thick portion 23 has a rigidity larger than that of the thin portions 22, and consequently, the pressure absorbing member 21 is formed by a plurality of portions having different rigidities.

In this case, the pressure absorbing member 21 has a stacked structure made up of a first layer 21A and a second layer 21B. The first layer 21A forms the thin portion 22 forming the vibration plate 2. The second layer 21B is formed on the first layer 21A, and forms the thick portion 23 together with the first layer 21A. It is possible to easily make the thickness of the pressure absorbing member 21 non-uniform by employing the stacked structure. Moreover, by forming a portion of the stacked structure by the same layer or layers as the vibration plate 2, it is possible to simultaneously form the pressure absorbing member 21 when carrying out a process to form the vibration plate 2, and the production process can be simplified.

In this embodiment, a stepped portion is formed at a boundary of the thin portion 22 and the thick portion 23, as may be seen from FIG. 6. However, it is not essential to provide the stepped portion, and the thickness of the pressure absorbing member 21 may change continuously between the thin portion 22 and the thick portion 23, that is, the thin portion 22 and the thick portion 23 may be connected via a continuously sloping portion. The pressure absorbing member 21 may also be made to have a non-uniform thickness and portions with different rigidities, by providing such a continuously changing portion between the thin portion 22 and the thick portion 23. The size of the regions of the pressure absorbing member 21 where the thin portions 22 and the thick portion 23 are provided does not need to be the same, and the number of regions is of course not limited to 3. The number and the location of each of the thin portion 22 and the thick portion 23 in the pressure absorbing member 21 may be determined depending on the material, size and the like of the pressure absorbing member 21, and optimized if necessary.

As shown in FIG. 7, a width Uy of the thin portion 22 taken along a direction perpendicular to the direction X, that is, taken along a shorter side of the pressure absorbing member 21, may be set the same as that of the thick portion 23. On the other hand, as shown in FIG. 8, the width Uy of the thin portion 22 taken along the direction perpendicular to the direction X may be set larger than that of the thick portion 23. In FIGS. 7 and 8, Ux denotes a length of the thin portion 22 taken along the direction X, and Tx denotes a total length of the pressure absorbing member taken along the direction X. The thin portions 22 and the thick portion 23 have the same length Ux in this embodiment, but as described above, the lengths of the thin portions 22 and the thick portion 23 may be different.

By making the thickness of the pressure absorbing member 21 non-uniform, a structural vibration of the common ink chamber 8 becomes complex, thereby making it possible to suppress the generation of a large vibration mode at low frequencies. In addition, it is possible to prevent the driving frequency and the resonance frequency of the common ink chamber 8 from matching.

Furthermore, by making the pressure absorbing member 21 have a plurality of portions with different rigidities, the structural vibration of the common ink chamber 8 becomes complex, thereby making it possible to suppress the generation of a large vibration mode at low frequencies. In addition, it is possible to prevent the driving frequency and the resonance frequency of the common ink chamber 8 from matching. Of course, the portions of the pressure absorbing member 21 may be made to have the different rigidities by making the thicknesses of the portions different and/or by making the materials used for the portions different.

In other words, in order to prevent the pressure vibration which propagates from the pressure-applied ink chamber 6 to the common ink chamber 8 when the ink drop is ejected from propagating to the other pressure-applied ink chambers 6, it is necessary to increase the pressure damping efficiency at the common ink chamber 8. In order to increase the pressure damping efficiency at the common ink chamber 9, it is possible to employ a method which damps the pressure change by the vibration of the wall surface itself of the common ink chamber 8 or, a method which coats a material having a low elasticity, such as rubber, on the wall surface of the common ink chamber 8, to damp the pressure change by the deformation of the wall surface of the common ink chamber 8. The method which damps the pressure change by the vibration of the wall surface itself of the common ink chamber 8 is particularly satisfactory because of the ease of production and the relatively high pressure damping efficiency. In this case, the ease of production is due to the relatively low cost and the relatively simple production process.

Figure 9:
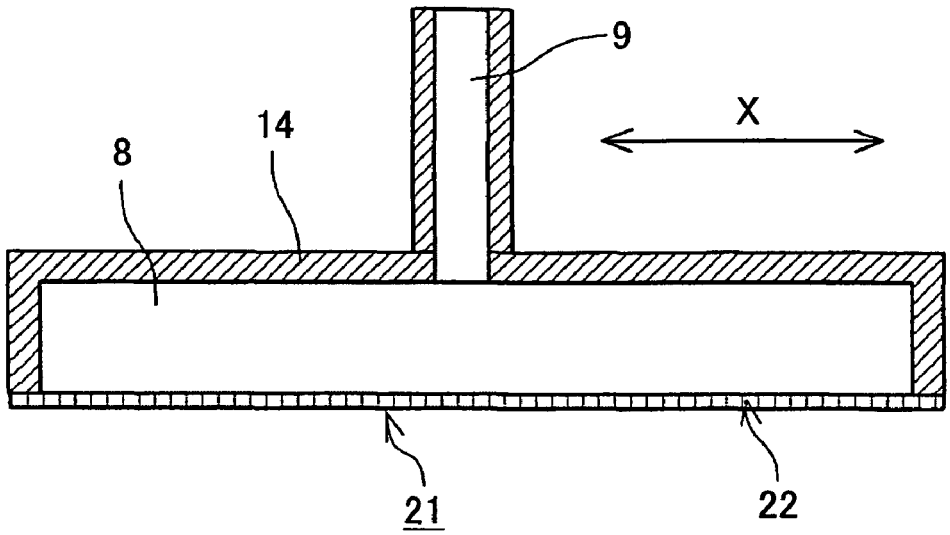
FIG. 9 is a cross sectional view on an enlarged scale showing of a common ink chamber of a first comparison example cut along the direction in which nozzles are arranged.
Figure 10:
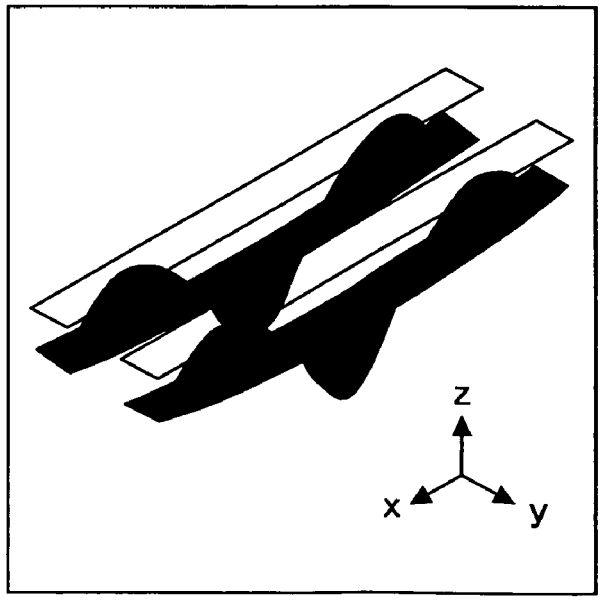
FIG. 10 is a diagram for explaining a vibration mode of a wall surface of the common ink chamber when the first comparison example is driven at a driving frequency of 4 kHz.
Figure 11:
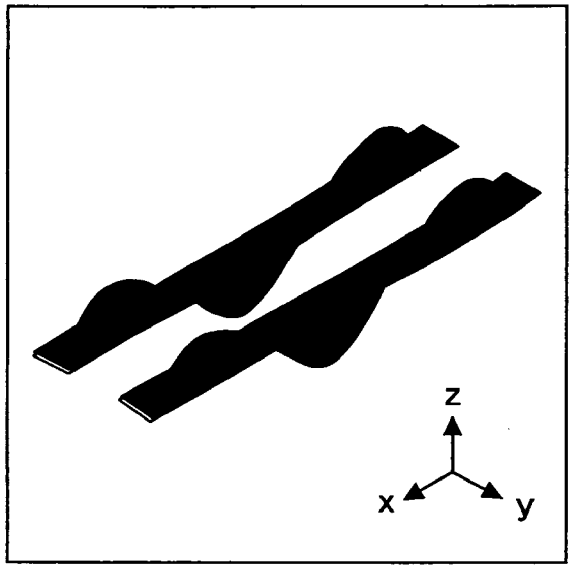
FIG. 11 is a diagram for explaining the vibration mode of the wall surface of the common-ink chamber when a second comparison example is driven at a driving frequency of 16.8 kHz.
Figure 12:
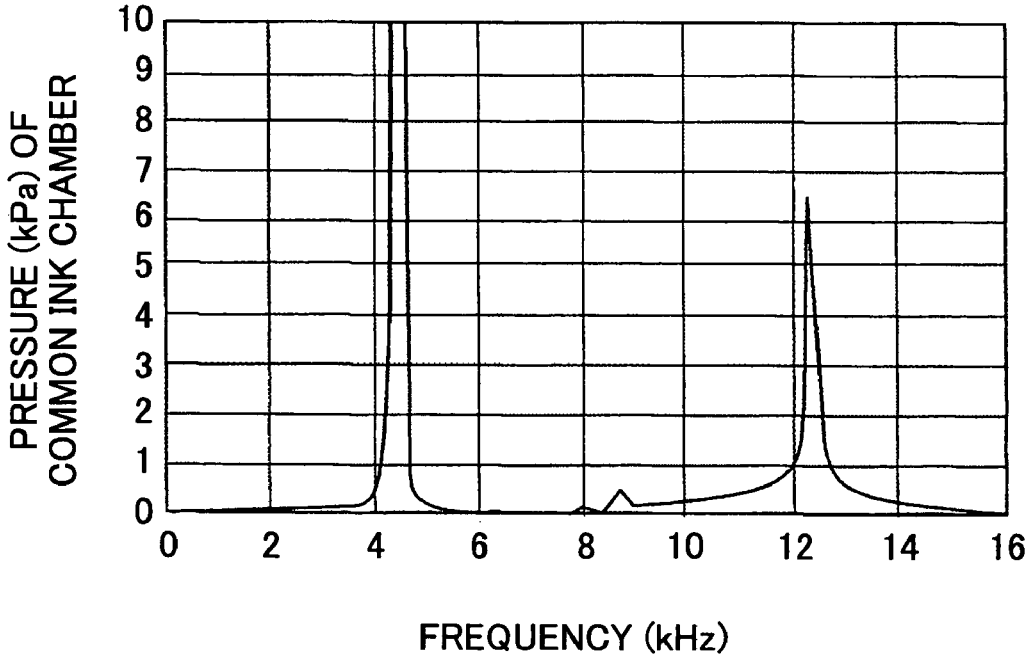
FIG. 12 is a diagram for explaining a frequency characteristic of a pressure change of the common ink chamber of the first comparison example.

But when the rigidity of the wall surface of the common ink chamber 8 is reduced to more easily generate the vibration, the pressure change of the common ink chamber 8 is generated by the resonance of the wall surface itself. This phenomenon will now be described with reference to FIGS. 9 through 12. FIG. 9 is a cross sectional view on an enlarged scale showing of a common ink chamber of a first comparison example cut along the direction in which the nozzles are arranged. FIG. 10 is a diagram for explaining a vibration mode of a wall surface of the common ink chamber when the first comparison example is driven at a driving frequency of 4 kHz, and FIG. 11 is a diagram for explaining the vibration mode of the wall surface of the common ink chamber when a second comparison example is driven at a driving frequency of 16.8 kHz. In addition, FIG. 12 is a diagram for explaining a frequency characteristic of a pressure change of the common ink chamber of the first comparison example.

The first comparison example shown in FIG. 9 has a portion of the wall surface of the common ink chamber 8 formed entirely by the thin portion 22, so that the rigidity of the pressure absorbing member 21 is reduced. In this case, the vibration mode of the wall surface of the common ink chamber 8 becomes as shown in FIG. 10 when this first comparison example is driven at the driving frequency of 4 kHz. In addition, when the rigidity of the pressure absorbing member 21 is not reduced for a second comparison example and this second comparison example is driven at the driving frequency of 16.8 kHz, the vibration mode of the wall surface of the common ink chamber 8 becomes as shown in FIG. 11. In FIG. 10, two rectangular shapes which are white correspond to perspective views of two pressure absorbing members which are arranged side by side, and in FIGS. 10 and 11, black shapes show the deformation of the pressure absorbing members in x, y and z directions. FIGS. 10 and 11 show the vibration modes for a case where the area of the wall surface of the common ink chamber 8 is the same for the first and second comparison examples, and only the thickness of the portion forming the wall surface is different between the first and second comparison examples so that the respective wall surfaces have different rigidities.

As may be seen from FIGS. 10 and 11, the resonance frequency of the first comparison example which has the common ink chamber 8 with the wall surface having the reduced rigidity is shifted in the low-frequency band compared to the resonance frequency of the second comparison example which has the common ink chamber 8 with the wall surface having the rigidity which is not reduced. Accordingly, as the period at which the ink drop is ejected becomes shorter, that is, as the driving frequency of the ink-jet recording head becomes higher, the resonance frequency of the wall surface of the common ink chamber 8 of the first comparison example may match the driving frequency. Normally, the driving frequency of the ink-jet recording head is on the order of approximately several kHz to approximately ten-odd kHz. Hence, the frequency band of the driving frequency is lower than the resonance frequency of the wall surface of the common ink chamber 8, but in the case where the rigidity of the wall surface of the common ink chamber 8 is reduced, the resonance frequency decreases, and the decreased resonance frequency may match the driving frequency of the ink-jet recording head.

At a resonance point of the wall surface of the common ink chamber 8, the pressure itself of the common ink chamber 8 greatly changes due to the vibration of the wall surface. Hence, when the rigidity of the wall surface of the common ink chamber 8 is reduced to form the pressure absorbing member 21 as in the first comparison example, the frequency characteristic of the pressure change of the common ink chamber 8 becomes as shown in FIG. 12, and the pressure change shows a large value at the resonance frequency. In FIG. 12, the ordinate indicates the pressure (kPa) of the common ink chamber 8 of the first comparison example, and the abscissa indicates the frequency (kHz).

Therefore, the pressure absorbing member 21 which is originally provided to damp the pressure of the common ink chamber 8 may actually increase the pressure change of the common ink chamber 8 due to the provision of the pressure absorbing member 21. In order to prevent the pressure absorbing member 21 from increasing the pressure change of the common ink chamber 8, the driving frequency of the ink-jet recording head must be set so as not to match the resonance frequency of the wall surface of the common ink chamber 8, and consequently, the driving conditions for the ink-jet recording head becomes restricted in this case.

As described above, the trend is for the number of nozzles 5 of the ink-jet recording head to increase in order to cope with the demands for high-speed recording. However, as the number of nozzles 5 increases and the number of individual pressure-applied ink chambers 6 accordingly increases, the length of the common ink chamber 8 along the direction X in which the pressure-applied ink chambers 6 are arranged increases. As a result, the length of the pressure absorbing member 21 along the direction X also increases. But as the length of the pressure absorbing member 21 increases, the rigidity thereof is reduced therewith and the resonance point of the wall surface of the common ink chamber 8 shifts further towards the low-frequency band. Consequently, in order to prevent the driving frequency of the ink-jet recording head from not matching the resonance frequency, the driving conditions of the ink-jet recording head must be set and restricted more severely.

Particularly in the case of a line type ink-jet recording head having a large number of nozzles and a long common ink chamber, a large pressure change is generated and causes inconveniences described above.

On the other hand, in this embodiment of the recording head, the pressure absorbing member 21 is formed not entirely by the thin portion 22, but is formed by a combination of the thin portions 22 and the thick portion 23. For this reason, it is possible to suppress the decrease of the resonance frequency of the wall surface of the common ink chamber 8 while obtaining the pressure damping effect. Therefore, a stable ink drop ejection characteristic can be obtained even when the ink-jet recording head is driven at a high speed.

Figure 13:
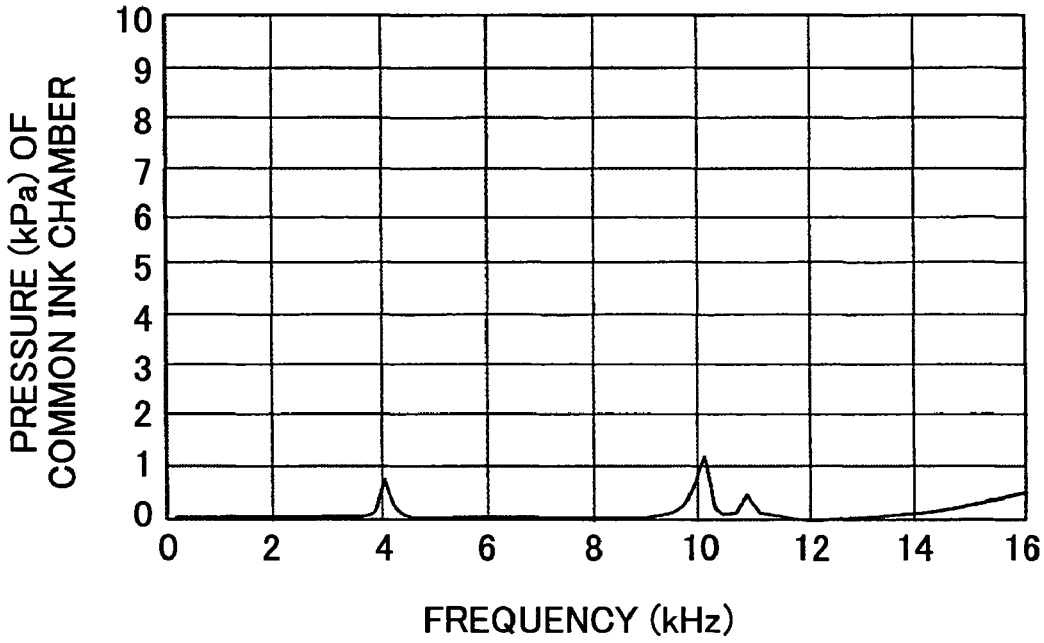
FIG. 13 is a diagram for explaining a frequency characteristic of a pressure change of the common ink chamber of the first embodiment of the recording head.

FIG. 13 is a diagram for explaining a frequency characteristic of a pressure change of the common ink chamber 8 of the first embodiment of the recording head. In FIG. 13, the ordinate indicates the pressure (kPa) of the common ink chamber 8 of the first embodiment of the recording head, and the abscissa indicates the frequency (kHz). FIG. 13 shows the frequency characteristic for a case where the thin portions 22 on both ends of the pressure absorbing surface 21*a* of the pressure absorbing member 21 along the direction X in FIG. 6 respectively occupy 35% of the total area of the pressure absorbing surface 21*a*, and the thick portion 23 occupies the remaining 30% of the total area of the pressure absorbing surface 21*a*. As may be readily seen by comparing FIG. 13 for this first embodiment and FIG. 12 for the first comparison example described above, the pressure absorbing member 21 of this first embodiment can obtain a higher pressure damping effect even though the rigidity of the pressure absorbing member 21 of the first comparison example is smaller.

As shown in FIG. 6, this first embodiment of the recording head supports both ends of the pressure absorbing member 21 along the direction X. However, since the thickness of the pressure absorbing member 21 in the vicinities of the supported ends is reduced compared to other portions of the pressure absorbing member 21, that is, the rigidity of the pressure absorbing member 21 in the vicinities of the supported ends is reduced compared to other portions of the pressure absorbing member 21, it is possible to make the amount of deformation of the pressure absorbing member 21 as a whole large. Consequently, although the thickness of the pressure absorbing member 21 is partially increased and the original function of the pressure absorbing member 21 slightly deteriorates at the increased thickness portion, the deterioration of the original function of the pressure absorbing member 21 as a whole is suppressed. The deterioration of the original function of the pressure absorbing member 21 may be suppressed to a minimum so that the deterioration is negligible.

In addition, both end portions of the common ink chamber 8 are most affected by the pressure change when the resonance of the pressure is generated in the common ink chamber 8. For this reason, by providing the thin portions 22 having the large pressure absorbing effect at the end portions where the amount of pressure change is large, it is possible to efficiently obtain the pressure damping effect.

Moreover, the simple structure of the pressure absorbing member 21 having the thick portion 23 at the central portion thereof and the thin portions 22 on both sides of the thick portions along the direction X, that is, only two kinds of thicknesses, enables easy production of the pressure absorbing member 21. Although the pressure absorbing member 21 has a simple structure, it is possible to improve the pressure damping effect.

Furthermore, the pressure absorbing member 21 having the non-uniform thickness may be realized by a stacked structure. That is, the stacked structure may be made up of the first layer 21A and the second layer 21B, where the first layer 21A forms the thin portion 22, and the second layer 21B is formed on the first layer 21A and forms the thick portion 23 together with the first layer 21A. Such a stacked structure may be formed by a simple process. In this first embodiment, the thin portion 22 is formed by one layer (first layer 21A) and the thick portion 23 is formed by two layers (first and second layers 21A and 21B), but the number of layers forming each of the thin portion 22 and the thick portion 23 is not limited to such. For example, the thin portion 22 may be formed by a single layer, and the thick portion 23 may be formed by three layers.

If the length of the thin portion 22 of the pressure absorbing member 21 is made long in the direction X, it is possible to obtain a high pressure damping effect, but the pressure change is generated in the lower frequencies due to the vibration of the pressure absorbing surface 21*a*, that is, the vibration of the pressure absorbing member 21. On the other hand, if the length of the thin portion 22 of the pressure absorbing member 21 is made short in the direction X, the vibration of the pressure absorbing surface 21*a* is improved, but the pressure damping effect deteriorates. Accordingly, the size and thickness, the modulus of elasticity of the material and the like of the pressure absorbing member 21 may be selected appropriately in this embodiment to obtain the desired pressure damping effect and vibration of the pressure absorbing surface 21*a*. In addition, the modulus of elasticity of the material and the like of the pressure absorbing member 21 may be selected to optimize the pressure damping effect and vibration of the pressure absorbing surface 21*a*.

The present inventors produced samples of this first embodiment of the recording head, with various pressure absorbing members 21 and head structures. Table 1 shows 32 kinds of samples of the ink-jet recording head produced, which were subjected to ink-jet tests, with the following evaluations A and B made for each sample. The evaluation A was made to evaluate the mutual interference, that is, whether or not the pressure absorbing member 21 sufficiently functions. The evaluation B was made to evaluate the frequency dependence, that is, whether or not the resonance of the pressure absorbing member 21 affects the ink-jet characteristic.

TABLE 1

| Sample No. | K Value (×10) | Evaluation A | Evaluation B |
|---|---|---|---|
| 1 | 0.02 | ○ | x |
| 2 | 0.18 | ○ | x |
| 3 | 1.04 | ○ | x |
| 4 | 1.58 | ○ | x |
| 5 | 1.65 | ○ | x |
| 6 | 1.76 | ○ | x |
| 7 | 2.14 | ○ | ○ |
| 8 | 2.2 | ○ | ○ |
| 9 | 2.81 | ○ | ○ |
| 10 | 4.17 | ○ | ○ |
| 11 | 4.76 | ○ | ○ |
| 12 | 4.83 | ○ | ○ |
| 13 | 4.83 | ○ | ○ |
| 14 | 5.56 | ○ | ○ |
| 15 | 7.66 | ○ | ○ |
| 16 | 8.87 | ○ | ○ |
| 17 | 9.11 | x | ○ |
| 18 | 9.13 | ○ | x |
| 19 | 13.4 | x | x |
| 20 | 15.22 | ○ | x |
| 21 | 22.4 | x | ○ |
| 22 | 28.81 | ○ | x |
| 23 | 42.26 | x | x |
| 24 | 54.59 | ○ | x |
| 25 | 62.92 | ○ | x |
| 26 | 103.02 | x | ○ |
| 27 | 137.89 | x | ○ |
| 28 | 172.21 | x | ○ |
| 29 | 222.62 | ○ | x |
| 30 | 711.84 | x | ○ |

TABLE 1-continued

| Sample No. | K Value (×10) | Evaluation A | Evaluation B |
|---|---|---|---|
| 31 | 1165.48 | x | x |
| 32 | 2553.03 | x | ○ |

The evaluation A was made by actually mounting each sample of the ink-jet recording head and printing an evaluation chart, to judge whether or not an image abnormality is generated in the printed sample. In Table 1, "O" indicates that no image abnormality was detected by the evaluation A, and "X" indicates that the image abnormality was detected by the evaluation A. On the other hand, the evaluation B was made by ejecting the ink from each sample of the ink-jet recording head by itself, while varying the driving frequency, to observe the ink-jet characteristic such as the ink-jet velocity, ink-jet volume and ink-jet curve (or ink-jet trajectory). In Table 1, "O" indicates that the ink-jet characteristic showed no driving frequency dependence, and "X" indicates that the ink-jet characteristic showed driving frequency dependence.

Furthermore, the following items were selected as structure factors which may be regarded as affecting the evaluations A and B.

SF1) Thickness Ud (m) of the thin portion 22;

SF2) Length Uy (m) of the thin portion 22 along the shorter side thereof;

SF3) Length Ux (m) of the thin portion 22 along the longer side thereof (direction X); and SF4) Young's modulus E (Pa) of the thin portion 22.

The above structure factors SF1 through SF4 were regarded as variables, and a, b, c and d were regarded as fitting parameters in the following formula and optimized, so as to obtain a parameter K which indicates the performance of the pressure absorbing member 21. The value of this parameter K is referred to as the K value in Table 1.

$$K=Ud^a\times Uy^b\times Ux^c\times E^d$$

It was found that the K value appropriately indicates the performance of the pressure absorbing member 21 when the fitting parameters a, b, c and d were set to a=2, b=−2.5, c=−3.5 and d=⅔.

It may be seen from Table 1 that both the evaluations A and B are satisfactory when the K value falls within a range of approximately $2\times10^{10}$ to approximately $9\times10^{10}$.

In other words, the rigidity and the resonance frequency of the pressure absorbing member 21 which forms the pressure absorbing surface 21*a* can be optimized so that it is possible to positively obtain a stable ink-jet characteristic even at high driving frequencies, when the thickness Ud (m) of the thin portion 22, the length Uy (m) of the thin portion along the shorter side thereof, the length Ux (m) of the thin portion 22 along the longer side thereof (that is, along the direction X) and the Young's modulus E (Pa) of the thin portion 22 satisfy the following relationship (1).

$$2\times10^{10}<Ud^2\times Uy^{-2.5}\times Ux^{-3.5}\times E^{2/3}<9\times10^{10} \quad (1)$$

As the number of nozzles 5 increases and the size (length) of the ink-jet recording head increases, the area of the pressure absorbing surface 21*a* of the pressure absorbing member 21 increases. In this case, if a soft material such as a resin is used for the pressure absorbing member 21, more resonance of the pressure absorbing member 21 is generated in the low-frequency band. In addition, since it is difficult to process a soft material having a large area, it is preferable to use a hard material for the pressure absorbing member 21, even if the rigidity of the pressure absorbing member 21 becomes slightly high. Even when a material having a high rigidity is used for the pressure absorbing member 21, it is possible to obtain a sufficient pressure absorbing effect.

Figure 14:
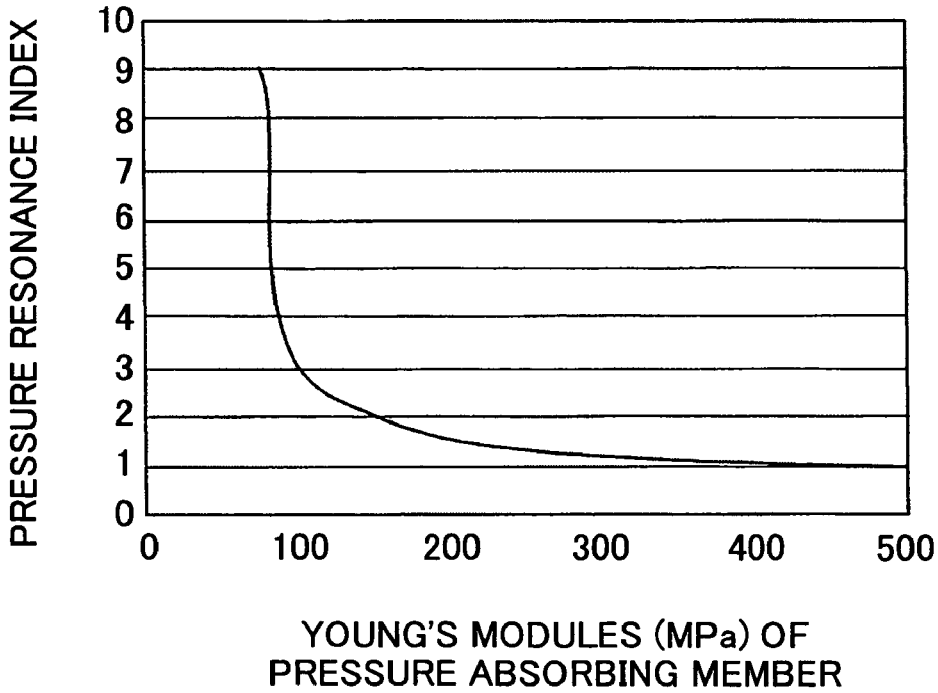
FIG. 14 is a diagram for explaining a Young's modulus of the pressure absorbing member and a pressure resonance characteristic of the common ink chamber of the first embodiment of the recording head.

The present inventors have studied a pressure resonance characteristic of the common ink chamber 6 for various materials used for the pressure absorbing member 21, with respect to the ink-jet recording head having a number of nozzles 5 exceeding 200. FIG. 14 is a diagram for explaining the Young's modulus of the pressure absorbing member 21 and the pressure resonance characteristic of the common ink chamber 8 of the first embodiment of the recording head. In FIG. 14, the ordinate indicates a pressure resonance index, and the abscissa indicates the Young's modulus (MPa) of the pressure absorbing member 21.

In order to obtain a simple index to indicate the degree or extent of the pressure resonance, it is assumed that the driving frequency band of the ink-jet recording head is approximately 1 kHz to approximately 16 kHz, and pressure change values at the time when the pressure resonance is generated are totaled. Hence, the indexes indicating the degree or extent of the pressure resonance of pressure absorbing members having different Young's modulus may be compared. For example, in the case of the frequency characteristic shown in FIG. 13, the resonance point exists at the frequencies of 4 kHz, 10 kHz and 10.8 kHz, and the pressure change values at these resonance points respectively are 0.8, 1.1 and 0.5. Hence, the index indicating the degree or extent of the pressure resonance may be calculated from 0.8+1.1+0.5=2.4. In this specification, this index indicating the degree of extent of the pressure resonance will be referred to as the "pressure resonance index".

As may be seen from FIG. 14, when the Young's modulus of the pressure absorbing member 21 becomes less than 100 MPa, the pressure resonance index rapidly increases. In other words, the pressure change of the common ink chamber 8 more easily affects the ink-jet characteristic. Accordingly, it is preferable that the material used for the pressure absorbing member 21 has a Young's modulus that is 100 MPa or greater.

By using a material having a Young's modulus that is 100 Pa or greater for the pressure absorbing member 21 which forms the pressure absorbing surface 21*a*, it is possible to suppress the resonance frequency from becoming low due to the large area of the pressure absorbing surface 21*a* when the number of nozzles 5 increases and the size of the ink-jet recording head becomes large. For this reason, it is possible to obtain a stable ink-jet characteristic even in the case of the ink-jet recording head which has a large number of nozzles 5 and is large (or long).

Nickel (Ni) is suited for use as the pressure absorbing member 21, because the Young's modulus of nickel is approximately 150 MPa. In other words, nickel satisfies the above described demands as the material used for the pressure absorbing member 21, and is also easy to process.

Of the total length Tx of the pressure absorbing member 21 along the direction X, the length Ux of the thin portion 22 is important. A sufficient pressure absorbing effect cannot be obtained if the proportion of the thin portions 22 in the pressure absorbing member 21 is reduced. This is because the structural damping capacity of the thin portion 22 changes, and it becomes impossible to sufficiently absorb the pressure of the common ink chamber 8 as a whole when the thick portion 23 becomes long. On the other hand, if the proportion of the thin portions 22 in the pressure absorbing member 21 is increased, the vibration of the pressure absorbing member 21 causes the problem described above.

The present inventors prepare samples of this first embodiment of the recording head by varying the length Ux of the thin portion 22 along the direction X and the total length Tx of the pressure absorbing member 21 along the direction X, and evaluated the ink-jet characteristic of the samples. Results of the evaluation are shown in Table 2, where NG indicates that the evaluation result is unsatisfactory (no good), and OK indicates that the evaluation result is satisfactory.

TABLE 2

| Sample No. | Ux/Tx | Evaluation Result |
|---|---|---|
| 1 | 0.061 | NG |
| 2 | 0.121 | NG |
| 3 | 0.182 | NG |
| 4 | 0.242 | NG |
| 5 | 0.303 | OK |
| 6 | 0.317 | OK |
| 7 | 0.343 | OK |
| 8 | 0.364 | OK |
| 9 | 0.424 | OK |
| 10 | 0.485 | NG |

From the evaluation results shown in Table 2, it may be seen that a ratio Ux/Tx of the length Ux of the thin portion 22 and the total length Tx of the pressure absorbing member 21 is preferably set within a range of approximately 0.25 to approximately 0.45.

In other words, it is possible to optimize the structure of the pressure absorbing member 21 by satisfying the following relationship (2), where Ux (μm) denotes the length of the thin portion 22 along the direction X and Tx (μm) denotes the total length of the pressure absorbing member 21 along the direction X. Therefore, it is possible to more positively absorb the pressure and more positively suppress the resonance, to stabilize the ink-jet characteristic.

$$0.25<Ux/Tx<0.45 \quad (2)$$

Figure 15:
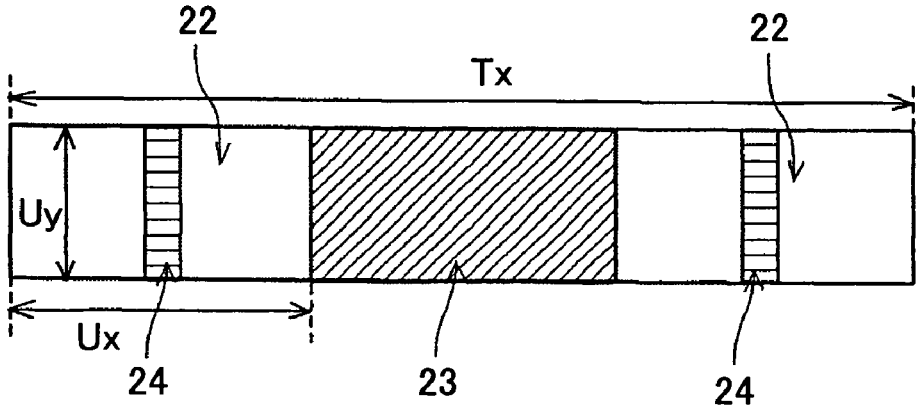
FIG. 15 is a plan view showing a pressure absorbing member of a first modification of the first embodiment of the recording head according to the present invention.
Figure 16:
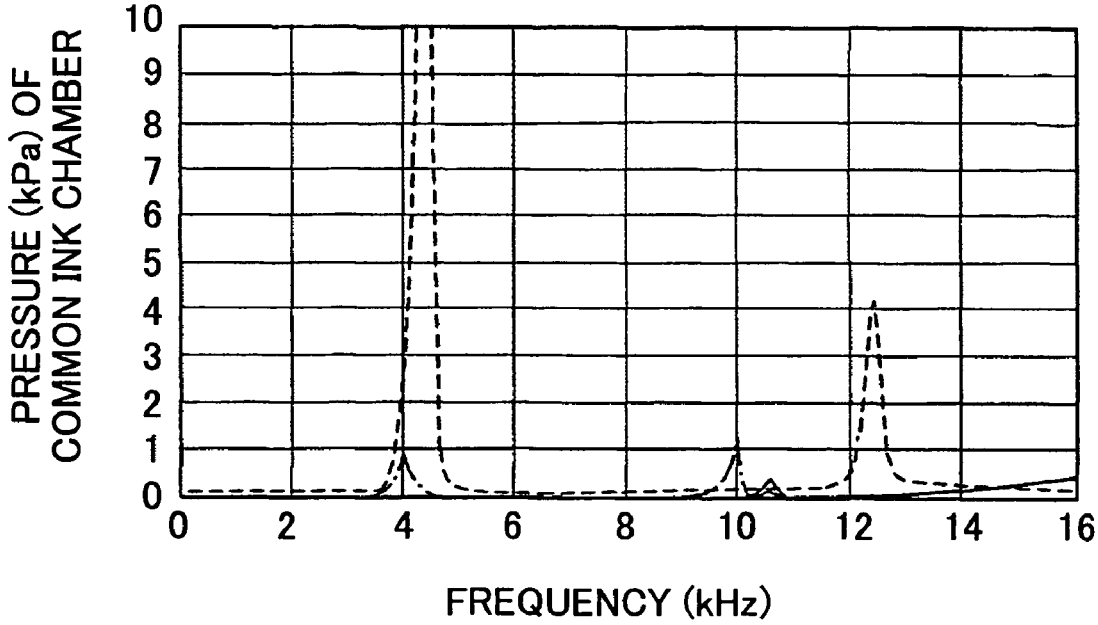
FIG. 16 is a diagram for explaining a frequency characteristic of a pressure change of the common ink chamber of the first modification of the first embodiment of the recording head.

Next, a description will be given of a first modification of the first embodiment of the recording head according to the present invention, by referring to FIGS. 15 and 16. FIG. 15 is a plan view showing a pressure absorbing member of this first modification of the first embodiment of the recording head. In FIG. 15, those parts which are essentially the same as those corresponding parts in FIGS. 3 through 8 are designated by the same reference numerals, and a description thereof will be omitted. FIG. 16 is a diagram for explaining a frequency characteristic of a pressure change of the common ink chamber of this first modification of the first embodiment of the recording head. In FIG. 16, the ordinate indicates the pressure (kPa) of the common ink chamber 8 of the first modification of the first embodiment of the recording head, and the abscissa indicates the frequency (kHz). In this first modification of the first embodiment of the recording head, the present invention is applied to an ink-jet recording head.

In this first modification of the first embodiment of the recording head, the pressure absorbing member 21 has two thin portions 22 and a thick portion 23, but each thin portion 22 has a second thick portion 24 provided within a region of the thin portion 22.

By providing the second thick portion 24, the resonance frequency of the wall surface of the common ink chamber 8 is shifted towards the high-frequency band. For this reason, it is possible to further suppress the generation of the resonance point within the driving frequency band of the ink-jet recording head.

In addition, the strength of the thin portion 22 increases by providing the second thick portion 24. As a result, it becomes easier to process and produce the ink-jet recording head. In FIG. 16, a solid line shows the frequency characteristic of the pressure change of the common ink chamber 8 of this first modification of the first embodiment of the recording head. For comparison purposes, a one-dot chain line shows the frequency characteristic of the pressure change of the common ink chamber 8 of the first embodiment of the recording head which is not provided with the second thick portion 24. Furthermore, a dotted line shows frequency characteristic of the pressure change of the common ink chamber 8 of the first comparison example of the ink-jet recording head shown in FIG. 9 which has the pressure absorbing member 21 having the uniform thickness of the thin portion 22.

As may be seen from FIG. 16, this first modification of the first embodiment of the recording head provided with the second thick portion 24 has a pressure change which is even smaller than that of the first embodiment of the recording head, and considerably small compared to that of the first comparison example of the ink-jet recording head.

As a result, this first modification of the first embodiment of the recording head which is provided with the second thick portion 24 has a satisfactory ink-jet characteristic having a small pressure changed compared to the ink-jet recording heads which are not provided with the second thick portion 24.

Because it is possible to separate the resonance frequency of the pressure absorbing member 21 and the driving frequency of the ink-jet recording head by providing the second thick portion 24 in the region of the thin portion 22 of the pressure absorbing member 21, it is possible to effectively obtain a stable ink-jet characteristic. Furthermore, it is easier to treat the ink-jet recording head during the assembling process and the production efficiency is improved, because the strength of the pressure absorbing member 21 is increased by the provision of the second thick portion 24.

If the thickness of the second thick portion 24 is made the same as the thickness of the thick portion 23, it is possible to simultaneously form the thick portion 23 and the second thick portion 24. In this case, the production process can be simplified and the production cost can be reduced.

Figure 17:
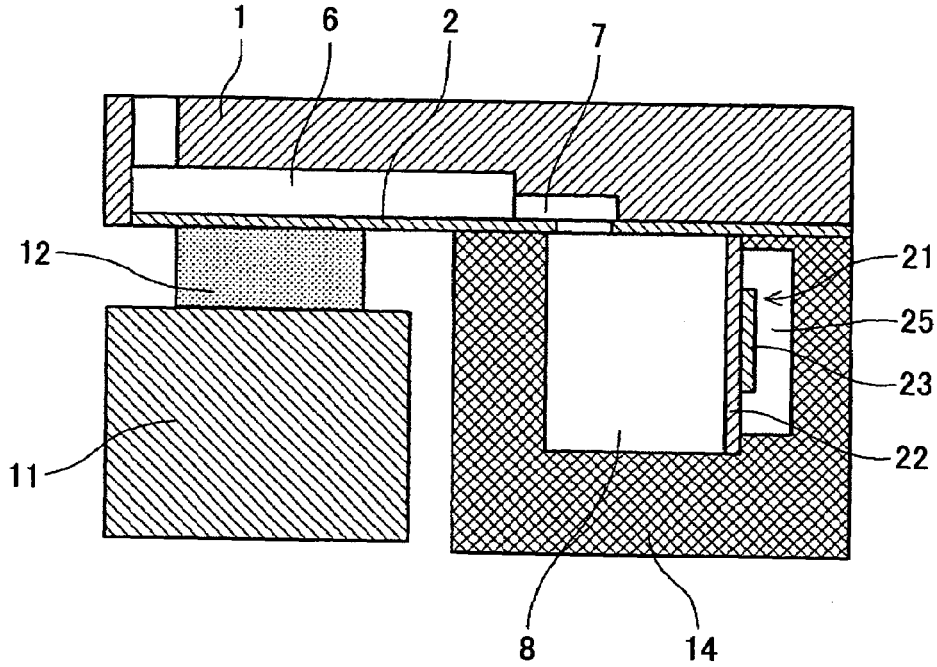
FIG. 17 is a cross sectional view showing a portion of a second modification of the first embodiment of the recording head according to the present invention cut along the direction perpendicular to the direction in which the nozzles are arranged.

Next, a description will be given of a second modification of the first embodiment of the recording head according to the present invention, by referring to FIG. 17. FIG. 17 is a cross sectional view showing a portion of this second modification of the first embodiment of the recording head cut along the direction perpendicular to the direction in which the nozzles are arranged. In FIG. 17, those parts which are essentially the same as those corresponding parts in FIGS. 3 through 8 are designated by the same reference numerals, and a description thereof will be omitted. In this second modification of the first embodiment of the recording head, the present invention is applied to an ink-jet recording head.

In this second modification of the first embodiment of the recording head, a pressure absorbing member 21 is provided at a portion of the wall surface of the frame member 14 forming the common ink chamber 8, as shown in FIG. 17. In this case, it is preferable to provide a damper chamber 21 on a rear surface of the pressure absorbing member 21 to make the pressure absorbing member 21 displaceable, and to communicate the damper chamber 25 to the atmosphere via an atmosphere communicating passage (not shown). Except for the effects which are obtainable by forming a portion of the pressure absorbing member 21 by the vibration plate 2, this second modification of the first embodiment of the recording head can obtain the effects obtainable by the first embodiment and the first modification of the first embodiment of the recording head described above.

According to the ink-jet recording head of the present invention, one wall surface of the common ink chamber is formed as a pressure absorbing surface, and a member which forms the pressure absorbing surface has a non-uniform thickness and/or a plurality of portions having different rigidities. As a result, it is possible to suppress the decrease of the resonance frequency of the pressure absorbing surface while maintaining the rigidity of the pressure absorbing member, and the driving frequency of the ink-jet recording head can be made different from the resonance frequency of the pressure absorbing surface. For this reason, it is possible to obtain a stable ink-jet characteristic even when the ink-jet recording head is driven at a high driving frequency.

The ink-jet recording head according to the present invention effectively applied particularly to the line type ink-jet recording head. In other words, the line type ink-jet recording head has a large number of nozzles (bits), and the length of the pressure absorbing member along the longitudinal direction thereof (direction X) is large. Consequently, the resonance of the pressure absorbing member itself, which is to be decreased by the present invention, is notably generated in the case of the line type ink-jet recording head. But by applying the present invention to the line type ink-jet recording head, it becomes possible to absorb the pressure change of the common ink chamber while maintaining the rigidity of the pressure absorbing member, and a stable ink-jet characteristic can be obtained even in the case of a full-line type ink-jet recording head which simultaneously records for the full length of a line on the recording medium.

Next, a description will be given of a first method of producing the first embodiment of the recording head according to the present invention.

A stacked piezoelectric element, which is used as a pressure converting means, is bonded on a support substrate (base substrate 11) made of Special Use Stainless (SUS) by use of an anaerobic adhesive, and a groove is formed in the piezoelectric element by use of a dicing saw, so as to form a piezoelectric element 12 which is separated so as to correspond to each pressure-applied ink chamber 6. An FPC cable 18, which is used as a conductor member, is connected to the side surface of the piezoelectric element 12 which is formed with the groove, by soldering, so as to form an actuator unit.

On the other hand, a nozzle plate 3 and a vibration plate 2 which are formed by electroforming, and a flow passage forming substrate (ink chamber substrate) 1 made of silicon is formed by etching. The nozzle plate 3, the vibration plate 2 and the flow passage forming substrate 1 are positioned and stacked with high precision, and an epoxy adhesive is applied to each interface to bond the nozzle plate 3, the vibration plate 2 and the flow passage forming substrate 1 together. A top surface of the piezoelectric element 12 of the actuator unit is bonded to a back surface of the vibration plate 2 by an epoxy adhesive.

A frame member 14 made of a resin for forming a common ink chamber 8 having a length of 35 mm along the longer side thereof, a length of 1 mm along the shorter side thereof, and a depth of 2 mm is prepared, and this frame member 14 is bonded on the back surface of the vibration plate 2 and the end surface of the base substrate 11 by an anaerobic adhesive, so as to form the ink-jet recording head.

An opening in the frame member 14, which forms the common ink chamber 8, is covered by the vibration plate 2. The vibration plate 2 used has a 2-layer stacked structure formed by Ni electroforming, and the 2 layers of the stacked structure respectively have thicknesses of 3 μm and 27 μm. The portion of the vibration plate 2 covering the opening of the frame member 14, that is, covering the common ink chamber 8, has a central portion which is made up of the 2 layers and has a thickness of 30 μm (=3 μm+27 μm) to form the thick portion 23, and an end portion on both sides of the central portion along the longitudinal direction of the common ink chamber 8 and made up of 1 (thinner) layer having the thickness of 3 μm.

The ink-jet recording head which is produced in the above described manner and having 200 nozzles 5, that is, nozzles 5 amounting to 200 bits, was mounted on a printer and print tests were carried out. As a result of the print tests, it was confirmed that a satisfactory printing can be carried out without generating a deteriorated picture quality, even when a multi-printing was carried out by ejecting the ink from all of the nozzles 5.

For comparison purposes, an ink-jet recording head having the vibration plate 2, which closes the common ink chamber 8, made up solely of 1 (thinner) layer having the thickness of 3 μm, was produced. In addition, this ink-jet recording head was mounted on a printer and print tests were carried out. As a result of the print tests, it was confirmed that the deteriorated picture quality is generated by the printing.

Therefore, it was confirmed that the ink-jet characteristic is improved by this first embodiment of the recording head according to the present invention.

Next, a description will be given of a second method of producing the first embodiment of the recording head according to the present invention.

A stacked piezoelectric element, which is used as a pressure converting means, is bonded on a support substrate (base substrate 11) made of Special Use Stainless (SUS) by use of an anaerobic adhesive, and a groove is formed in the piezoelectric element by use of a dicing saw, so as to form a piezoelectric element 12 which is separated so as to correspond to each pressure-applied ink chamber 6. An FPC cable 18, which is used as a conductor member, is connected to the side surface of the piezoelectric element 12 which is formed with the groove, by soldering, so as to form an actuator unit.

On the other hand, a nozzle plate 3 and a vibration plate 2 which are formed by electroforming, and a flow passage forming substrate (ink chamber substrate) 1 made of silicon is formed by etching. The nozzle plate 3, the vibration plate 2 and the flow passage forming substrate 1 are positioned and stacked with high precision, and an epoxy adhesive is applied to each interface to bond the nozzle plate 3, the vibration plate 2 and the flow passage forming substrate 1 together. A top surface of the piezoelectric element 12 of the actuator unit is bonded to a back surface of the vibration plate 2 by an epoxy adhesive.

A frame member 14 made of a resin for forming a common ink chamber 8 having a length of 63 mm along the longer side thereof, a length of 2.5 mm along the shorter side thereof, and a depth of 3 mm is prepared, and this frame member 14 is bonded on the back surface of the vibration plate 2 and the end surface of the base substrate 11 by an anaerobic adhesive, so as to form the ink-jet recording head.

An opening in the frame member 14, which forms the common ink chamber 8, is covered by the vibration plate 2. The vibration plate 2 used has a 3-layer stacked structure formed by Ni electroforming, and first through third layers, that is, the 3 layers of the stacked structure respectively have thicknesses of 3 μm, 15 μm and 15 μm. The portion of the vibration plate 2 covering the opening of the frame member 14, that is, covering the common ink chamber 8, has a central portion which is made up of the first through third layers and has a thickness of 33 μm (=3 μm+15 μm+15 μm) to form the thick portion 23, and an end portion on both sides of the central portion along the longitudinal direction of the common ink chamber 8 and made up of the first and second layers having the thickness of 18 μm (3 μm+15 μm).

The ink-jet recording head which is produced in the above described manner and having 360 nozzles 5, that is, nozzles 5 amounting to 360 bits, was mounted on a printer and print tests were carried out. As a result of the print tests, it was confirmed that a satisfactory printing can be carried out without generating a deteriorated picture quality, even when a multi-printing was carried out by ejecting the ink from all of the nozzles 5.

For comparison purposes, an ink-jet recording head having the vibration plate 2, which closes the common ink chamber 8, made up solely of 1 layer having the thickness of 3 μm, was produced. In addition, this ink-jet recording head was mounted on a printer and print tests were carried out. As a result of the print tests, it was confirmed that the deteriorated picture quality is generated by the printing.

Therefore, it was also confirmed in this case that the ink-jet characteristic is improved by this first embodiment of the recording head according to the present invention.

Figure 18:
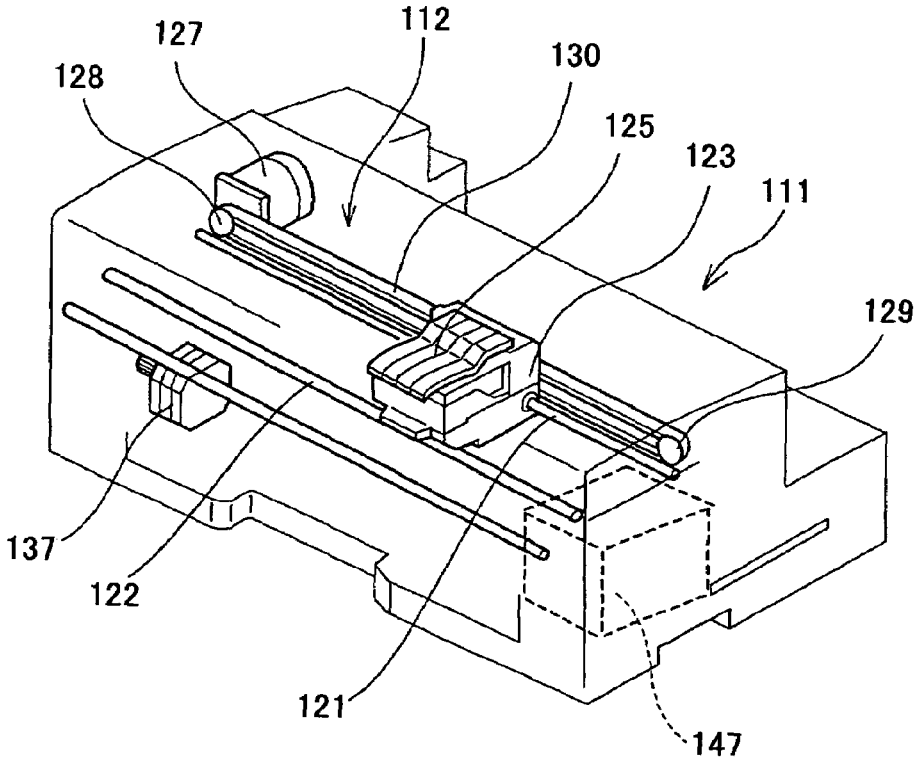
FIG. 18 is a perspective view showing a first embodiment of an image forming apparatus according to the present invention.
Figure 19:
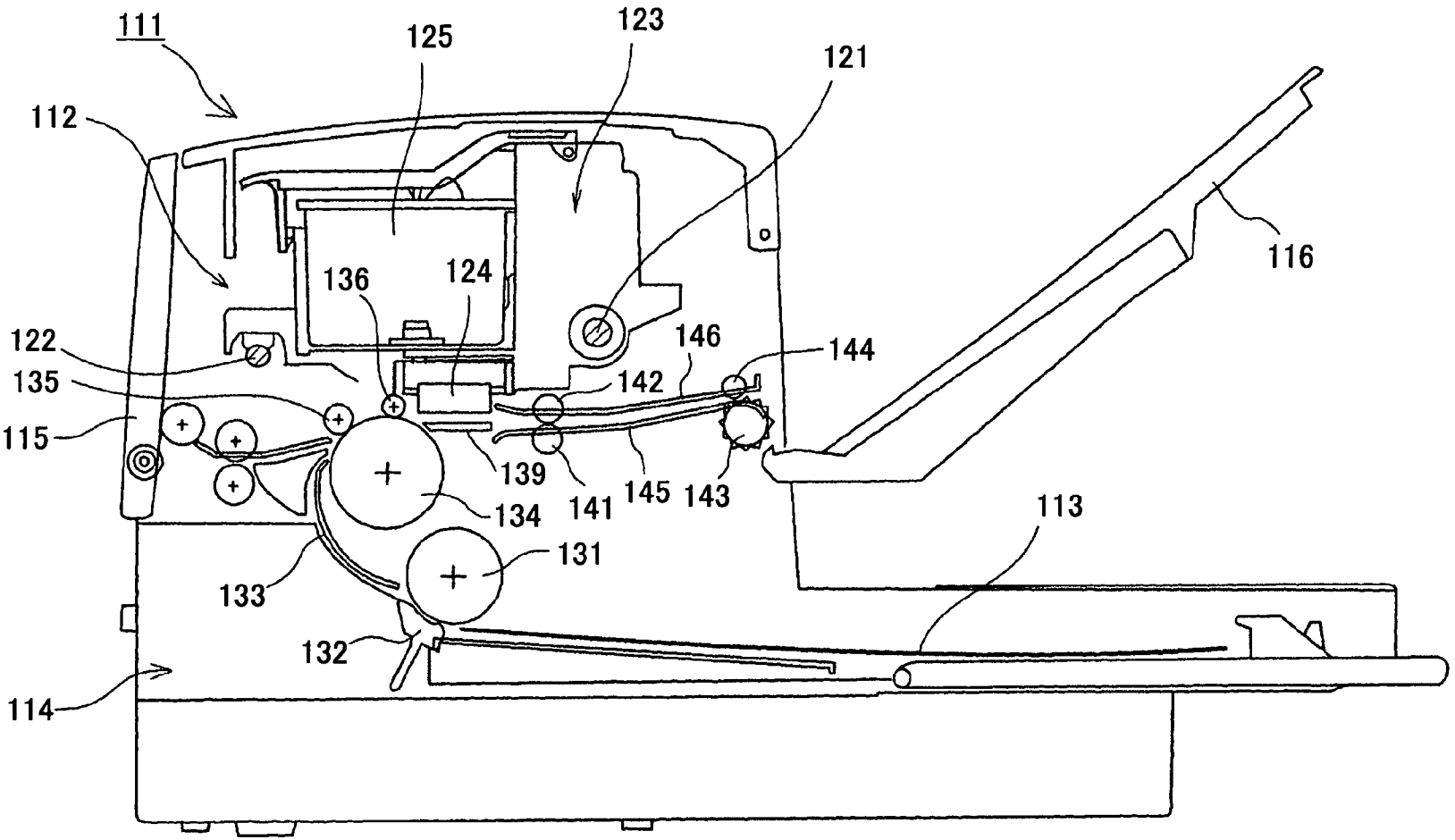
FIG. 19 is a side view for explaining a portion of the image forming apparatus shown in FIG. 18.

Next, a description will be given of a first embodiment of an image forming apparatus according to the present invention, by referring to FIGS. 18 and 19. FIG. 18 is a perspective view showing this first embodiment of an image forming apparatus, and FIG. 19 is a side view for explaining a portion of the image forming apparatus shown in FIG. 18. This first embodiment of the image forming apparatus employs a first embodiment of a carriage according to the present invention.

The image forming apparatus, that is, an ink-jet recording apparatus, shown in FIGS. 18 and 19 accommodates a print mechanism 112 within a main body 111. This print mechanism 112 includes a carriage 123 which is movable in a main scan direction within the main body 111, ink-jet recording heads 124 having the structure of any of the first embodiment and first and second modifications of the first embodiment of the recording head described above, ink cartridges 125 for supplying inks to the ink-jet recording heads, and the like. A paper supply cassette (or a paper supply tray) 114 shown in FIG. 19, which holds a stack of a plurality of recording media (in this case, recording paper) 113, is detachably provided on a lower portion of the main body 111. The recording media 113 may be set on the paper supply cassette 114 from a front of the ink-jet recording apparatus. A manual feed tray 115 for manually supplying the recording medium 113 may be closed as shown in FIG. 19 when not in use and is opened in a counterclockwise direction when in use. The print mechanism 112 prints an image on the recording medium 113 which is supplied from the paper supply cassette 114 or the manual feed tray 115, and the printed recording medium 113 is ejected on a paper eject tray 116 which is provided on a rear side of the ink-jet recording apparatus.

In the print mechanism 112, the carriage 123 is supported by a main guide rod 121 and a sub guide rod 122, and is slidable in the main scan direction. The main and sub guide rods 121 and 122 are provided across right and left side plates of the main body 111. The ink-jet recording heads 124 for ejecting yellow (Y), cyan (C), magenta (M) and black (Bk) ink drops are provided on the carriage, so that the nozzles are arranged in a direction perpendicular to the main scan direction and the ink-jet direction is the downward direction. Of course, the ink-jet recording heads 124 for ejecting the Y, C, M and Bk inks may be formed as a single head assembly or unit. The Y, C, M and Bk ink cartridges 125 are replaceably provided with respect to the ink-jet recording heads 124.

The ink cartridge 125 has an opening in an upper portion thereof for communicating to the atmosphere, an opening in a lower portion thereof for supplying the ink to the corresponding ink-jet recording head 124, and a porous or cellular member inside thereof for holding the ink. The capillarity of the porous or cellular member maintains the ink which is supplied to the ink-jet recording head 124 to a slight negative pressure.

Of course, instead of providing the four ink-jet recording heads 124 for the Y, C, M and Bk inks, it is also possible to provide a single ink-jet recording head which ejects the Y, C, M and Bk inks from the nozzles thereof.

The rear side, that is, a downstream side along a recording medium transport direction of the carriage 123, is slidably supported by the main guide rod 121. The front side, that is, the upstream side along the recording medium transport direction of the carriage 123, is slidably supported by the sub guide rod 122. In order to move the carriage 123 in the main scan direction, a timing belt 130 is provided across a driving pulley 128 which is driven by a main scan motor 127 and a following pulley 129, and the carriage 123 is fixed on the timing belt 130. Hence, the carriage 123 undergoes a reciprocating movement by rotating the main scan motor 127 in forward and reverse directions.

On the other hand, in order to transport the recording medium 113 which is set in the paper supply cassette 114 to the lower side of the ink-jet recording heads 124, a paper supply roller 131 for separating and supplying the recording medium 113 from the paper supply cassette 114, a friction pad 132, a guide member 133 for guiding the recording medium 113, a transport roller 134 for reversing and transporting the recording medium 113, a transport roller 135 which pushes against a peripheral surface of the transport roller 134, and a tip end roller 136 for restricting a supply angle of the recording medium 113 from the transport roller 134, are provided as shown in FIG. 19. The transport roller 134 is driven by a sub scan motor 137 via a gear mechanism.

A receiving member 139 is provided to guide the recording medium 113 which is transported from the transport roller 134 on the lower side of the ink-jet recording heads 124, in correspondence with a moving range of the carriage 123 in the main scan direction. A transport roller 141 for transporting the recording medium 113 in an eject direction and a spur gearing 142 are provided on the downstream side of the receiving member 139 along the recording medium transport direction. Furthermore, an eject roller 143 for ejecting the recording medium 113 towards the paper eject tray 116 and a spur gearing 144 are also provided, with guide members 145 and 146 forming an eject path for the recording medium 113.

At the time of the recording, the ink-jet recording heads 124 are driven in response to an image signal while moving the carriage 123 in the main scan direction, so as to eject the inks on the stationary recording medium 113 and record one line. Then, after transporting the recording medium 113 by a predetermined amount, the next line is recorded in a similar manner. When a recording end signal or, a signal indicating that the rear end of the recording medium 113 has reached the recording region is received, the recording operation is ended and the recording medium 113 is ejected.

In this case, in each of the ink-jet recording heads 124, the pressure change of the common ink chamber is approximately absorbed, and at the same time, the resonance is suppressed, so that a stable ink-jet characteristic having no mutual interference is obtained. For this reason, it is possible to record an image having a high picture quality on the recording medium 113.

When viewed from the front of the ink-jet recording apparatus, a recovery unit 147 is provided on the right end along the moving direction of the carriage 123, at a position outside the recording region, as shown in FIG. 18. The recovery unit 147 recovers ink-jet failures and the like of the ink-jet recording heads 124. The recovery unit 147 includes a capping means, a suction means and a cleaning means. The capping means provides a cap on the ink-jet recording heads 124 when the carriage 123 is in a print standby state in which the carriage 123 is moved to a position corresponding to the recovery unit 147, so as to maintain the nozzles in a wet state to prevent the inks from drying and causing an ink-jet failure. During the recording, the ink not related to the recording may be ejected to the capping means to maintain the ink viscosities at all of the nozzles constant, so as to maintain a stable ink-jet characteristic.

When an ink-jet failure or the like occurs, the nozzles of the ink-jet recording heads 124 are sealed by the capping means, and air bubbles and the like are sucked together with the ink from the nozzles of the ink-jet recording heads 124 by the suction means, via a tube (not shown). Then, the ink, dust particles and the like adhered on the nozzle surface are removed by the cleaning means, so as to eliminate the ink-jet failure or the like of the ink-jet recording heads 124. The ink which is sucked by the suction means is recovered within a recovery ink tank (not shown)which is provided at the lower portion of the main body 111. The recovered ink is held by an ink absorbing member within the recovery ink tank.

Therefore, according to this embodiment of the image forming apparatus and the carriage, it is possible to obtain a stable ink-jet characteristic even when the ink-jet recording heads are driven at a high speed, because the ink-jet recording heads have the structure of any of the first embodiment and the first and second modifications of the first embodiment of the ink-jet recording head described above.

The image forming apparatus according to the present invention may form a printer, a facsimile apparatus, a copying apparatus, a plotter, a composite apparatus and the like.

Further, the recording head according to the present invention may eject a fluid other than ink, such as DNA sample, resist, pattern material and the like. The carriage and the image forming apparatus according to the present invention may be provided with such a recording head which ejects a fluid other than ink.

In addition, the pressure converting means (or actuator means) of the recording head according to the present invention is not limited to the piezoelectric type actuator, and various other actuators may be used, such as a static type actuator, a thermal type actuator, and an actuator using a shape memory alloy.

Next, a description will be given of a second embodiment of the recording head according to the present invention, by referring to FIGS. 20 through 30. In this second embodiment of the recording head, the present invention is applied to an ink-jet recording head.

Figure 21:
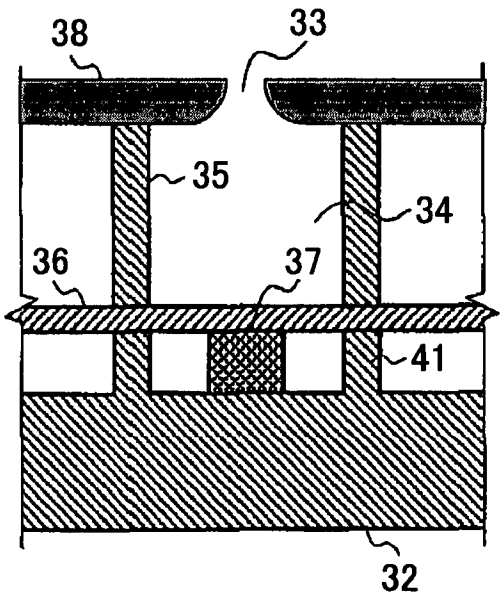
FIG. 21 is a cross sectional view showing a portion of the second embodiment of the recording head cut along the direction in which the nozzles are arranged.
Figure 20:
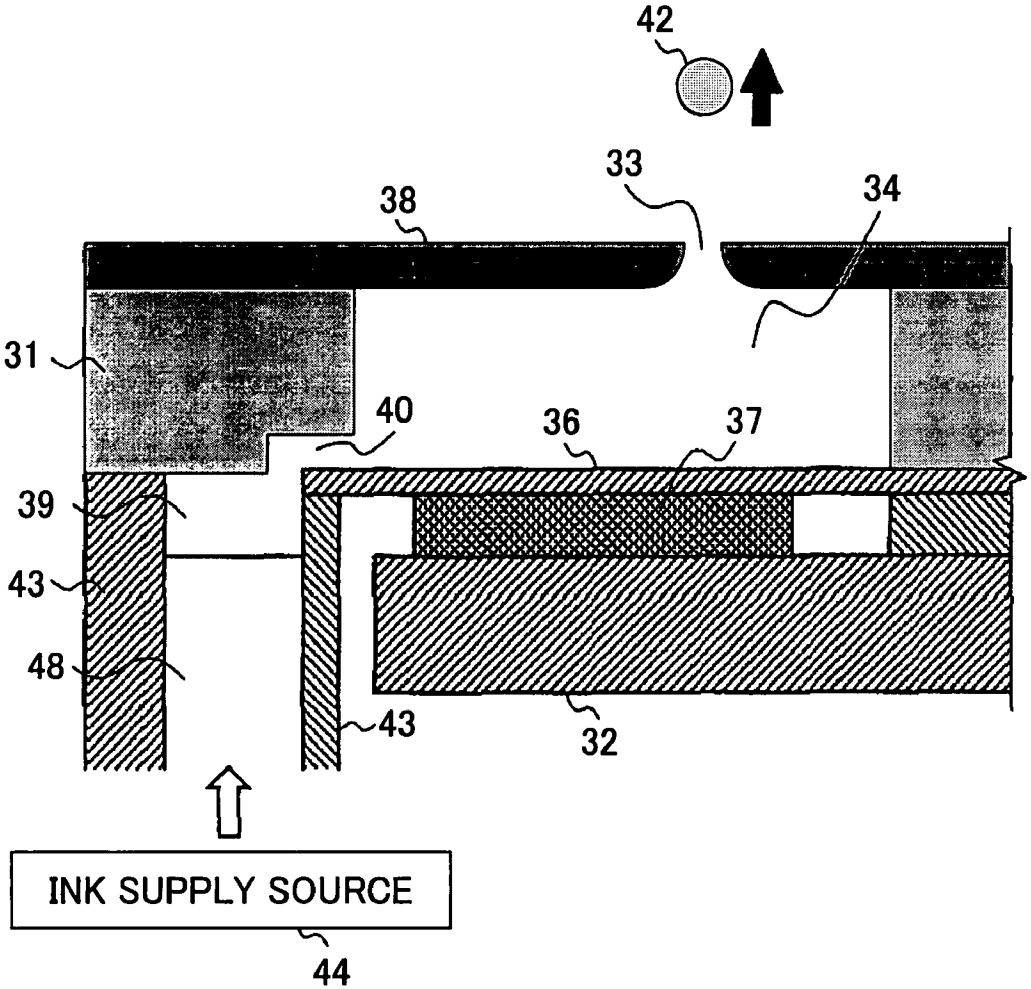
FIG. 20 is a cross sectional view showing a portion of a second embodiment of the recording head according to the present invention cut along the direction perpendicular to the direction in which nozzles are arranged.
Figure 22:
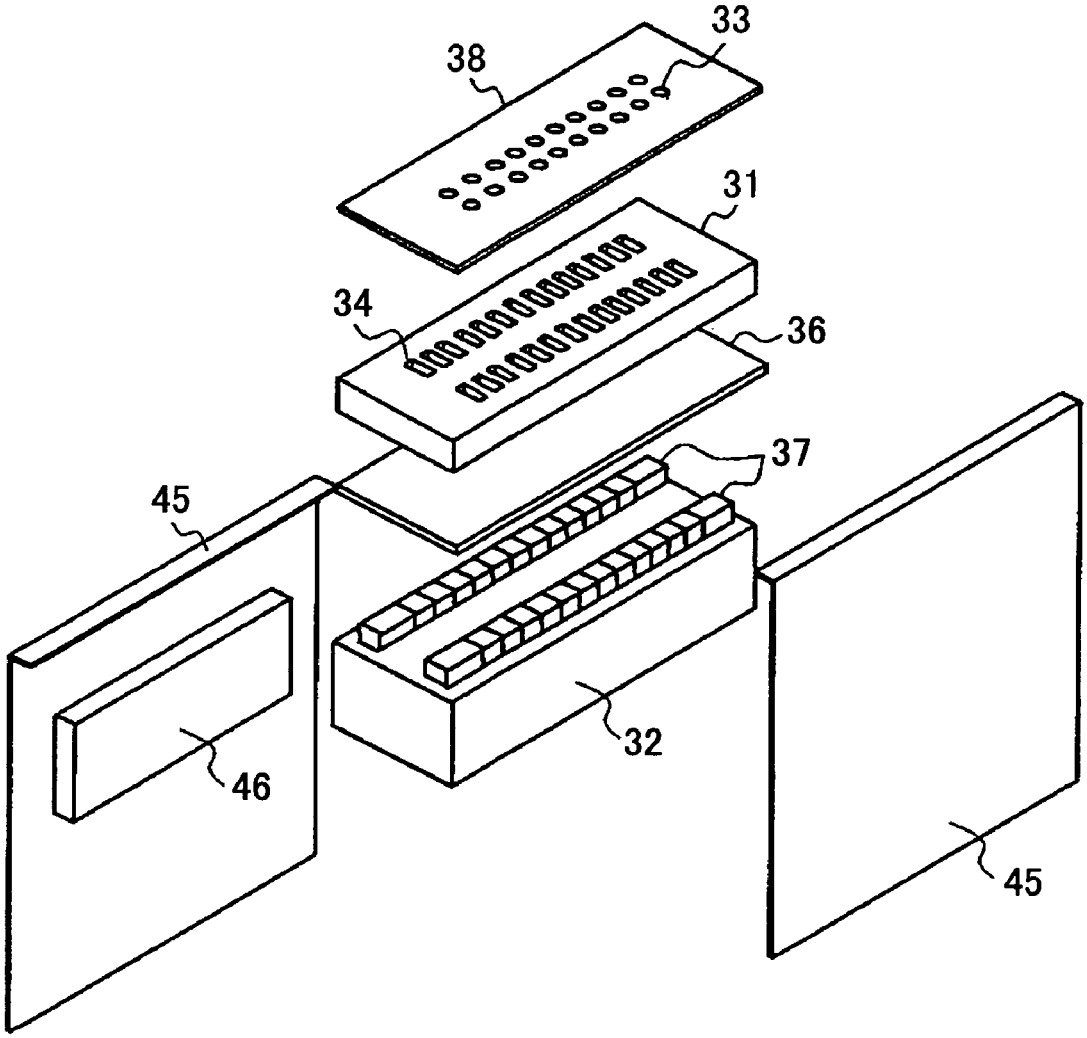
FIG. 22 is a disassembled perspective view showing the second embodiment of the recording head.

FIG. 20 is a cross sectional view showing a portion of the second embodiment of the recording head according to the present invention cut along a direction perpendicular to a direction in which nozzles are arranged. FIG. 21 is a cross sectional view showing a portion of the second embodiment of the recording head cut along the direction in which the nozzles are arranged. In addition, FIG. 22 is a disassembled perspective view showing the second embodiment of the recording head. In FIGS. 20 through 24, the illustration of a pressure absorbing member is omitted, and the pressure absorbing member will be described in detail by referring to FIG. 25 through 30.

As shown in FIG. 22, the ink-jet recording head has a stacked structure made up of a flow passage forming substrate (ink chamber substrate) 31, a nozzle plate 38 and a vibration plate 36. A plurality of pressure-applied ink chambers 34 are formed on the flow passage forming substrate 31, and a plurality of nozzles 33 communicating with the corresponding pressure-applied ink chambers 34 are provided in the nozzle plate 38. A plurality of piezoelectric elements 37 are provided on the vibration plate 36 as pressure converting elements. An FPC cable 45 is electrically connected to the piezoelectric elements 37, for supplying driving signals. The FPC cable 45 is provided with a driving circuit (driver IC) 46 for selectively applying a driving waveform to each of the piezoelectric elements 37. The piezoelectric element 37 displaces the vibration plate 36 with respect to the corresponding pressure-applied ink chamber 34. In this embodiment, a rod-shaped piezoelectric element is diced by a diamond cutter and separated into the piezoelectric elements 37 each corresponding to one of the pressure-applied ink chambers 34.

Each pressure-applied ink chamber 34 shown in FIG. 22 is sectioned as shown in FIG. 21. A support member 41 shown in FIG. 21 may be provided if necessary.

Based on an image signal (or image forming signal), driving signals are supplied to the piezoelectric elements 37 from the driver IC 46 via the FPC cable 45. Hence, the piezoelectric element 37 undergoes a displacement (that is, contract and expand) depending on the driving signal, and the displacement of the piezoelectric element 37 is transferred to the vibration plate 36. An ink drop 42 is ejected from a corresponding nozzle 33 by appropriately controlling an internal pressure of the pressure-applied ink chamber 34.

The piezoelectric elements 37 are provided on a base substrate 32, and the base substrate 32 is provided on a frame 43 shown in FIG. 20. The frame 43 is mounted on a carriage (not shown) of a main body of a second embodiment of the image forming apparatus according to the present invention. The second embodiment of the image forming apparatus may have a structure similar to that of the first embodiment of the image forming apparatus, that is, the ink-jet recording apparatus shown in FIGS. 18 and 19. The FPC cable 45 is connected to an electrical circuit (not shown) of the image forming apparatus, and an ink supply source 44 shown in FIG. 20, such as an ink cartridge, supplies the ink to the pressure-applied ink chambers 34.

Figure 23:
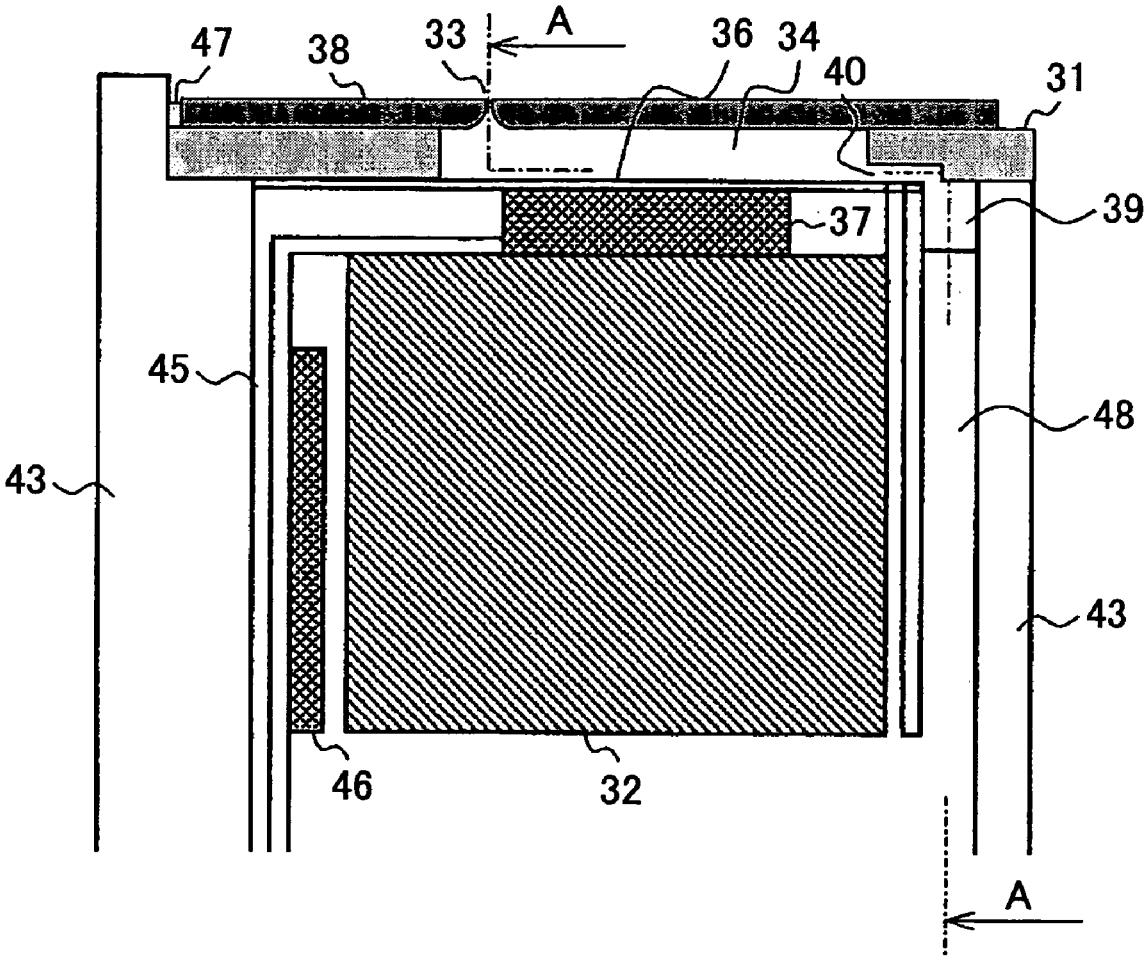
FIG. 23 is a cross sectional view on an enlarged scale showing a common ink chamber of the second embodiment of the recording head cut along the direction in which the nozzles are arranged.

FIG. 23 is a cross sectional view on an enlarged scale showing the common ink chamber 39 of the second embodiment of the recording head cut along the direction in which the nozzles 33 are arranged, that is, along the longitudinal direction of the pressure-applied ink chamber 34. In this embodiment, 2 columns of the nozzles 33 are provided symmetrically. FIG. 23 omits the illustration of 1 column of the nozzles 33, and shows only one-half of the ink-jet recording head.

As shown in FIG. 23, the flow passage forming substrate 31 is provided on the frame 43, similarly to the base substrate 32. A sealant 47 also functions as an adhesive. The structure shown in FIG. 23 slightly differs from the structures shown in FIGS. 20 through 22, but those parts which have the same functions are designated by the same reference numerals.

Of course, the structure of this second embodiment of the recording head is not limited to the structures shown in FIGS. 20 through 23.

In FIGS. 20 through 23, the nozzles 33 shown face upwards and the ink-jet direction is the upward direction. But when actually ejecting the ink drop on the recording medium such as paper to carry out the ink-jet recording, the ink drop is ejected vertically downwards in most cases. Accordingly, in this embodiment, the ink drop may similarly be ejected vertically downwards from the nozzle 33 in FIG. 24 with respect to the recording medium, such as paper, which is transported horizontally, when carrying out the ink-jet recording of the image.

Figure 24:
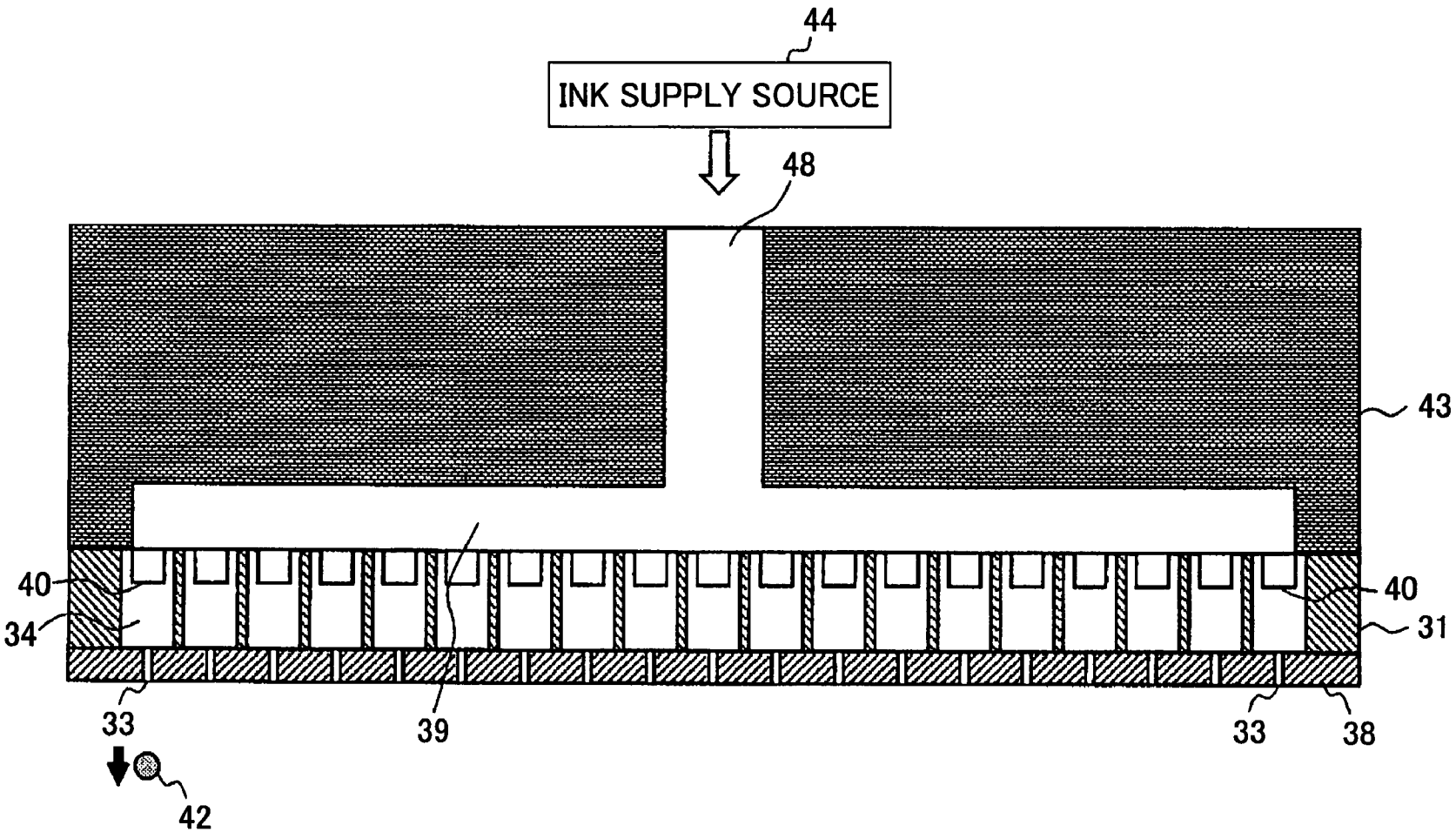
FIG. 24 is an inverted cross sectional view showing the second embodiment of the recording head cut along a line A-A in FIG. 23.

FIG. 24 is an inverted cross sectional view showing the second embodiment of the recording head cut along a line A-A in FIG. 23. FIG. 24 shows the recording head in a state where the nozzles 33 face downwards so that the ink drop 42 is ejected vertically downwards. The ink from the ink supply source 44 is supplied to the common ink chamber 39 via an ink supply opening (communication tube) 48, and reaches each nozzle 33 via the corresponding pressure-applied ink chamber 34 which communicates to the common ink chamber 39 via an ink supply passage (communicating part) 40. The pressure-applied ink chamber 34 corresponding to the nozzle 33 which is located on one end of the common ink chamber 39 along a longitudinal direction thereof, may not be used to form the image, so as to use this nozzle 33 as a dummy nozzle for suction to eject air bubbles. Further, both nozzles 33 located on the respective ends of the common ink chamber 39 along the longitudinal direction thereof, may be used as such dummy nozzles.

Figure 25:
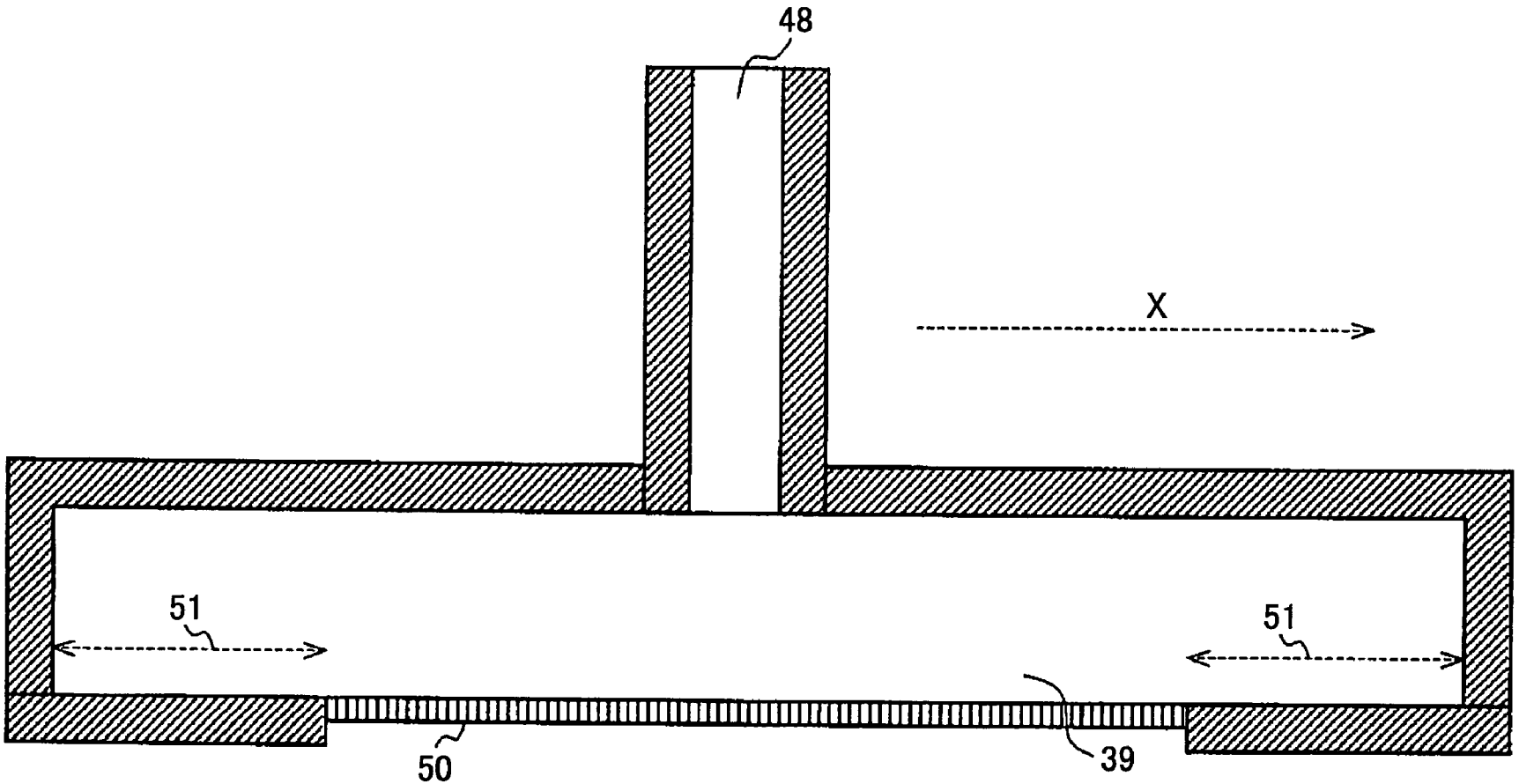
FIG. 25 is a cross sectional view showing only a portion including the common ink chamber and an ink supply opening of the second embodiment of the recording head, for explaining a pressure absorbing member.

FIG. 25 is a cross sectional view showing only a portion including the common ink chamber 39 and an ink supply opening 48 of the second embodiment of the recording head shown in FIG. 24, for explaining the pressure absorbing member. In addition, for comparison purposes, FIG. 26 is a cross sectional view showing only a portion including the common ink chamber 39 and the ink supply opening 48 of the first comparison example of the recording head, for explaining a pressure absorbing member.

In FIG. 25, a direction X from the left to right of the figure, corresponds to the longitudinal direction of the common ink chamber 39, that is, the direction in which the nozzles 33 (or the pressure-applied ink chambers 34) are arranged. A pressure absorbing member 50 is provided on at least one of wall surfaces of the common ink chamber 39 extending in the direction X. The pressure absorbing member 50 forms a damper surface for absorbing pressure by vibration.

The pressure absorbing member 50 is not provided in regions 51 along the direction X. Although the region 51 not provided with the pressure absorbing member 50 is provided at 2 locations on both sides of the common ink chamber 39 along the direction X, the number of such regions 51 and the locations of the regions 51 are not limited to those shown in FIG. 25.

Figure 26:
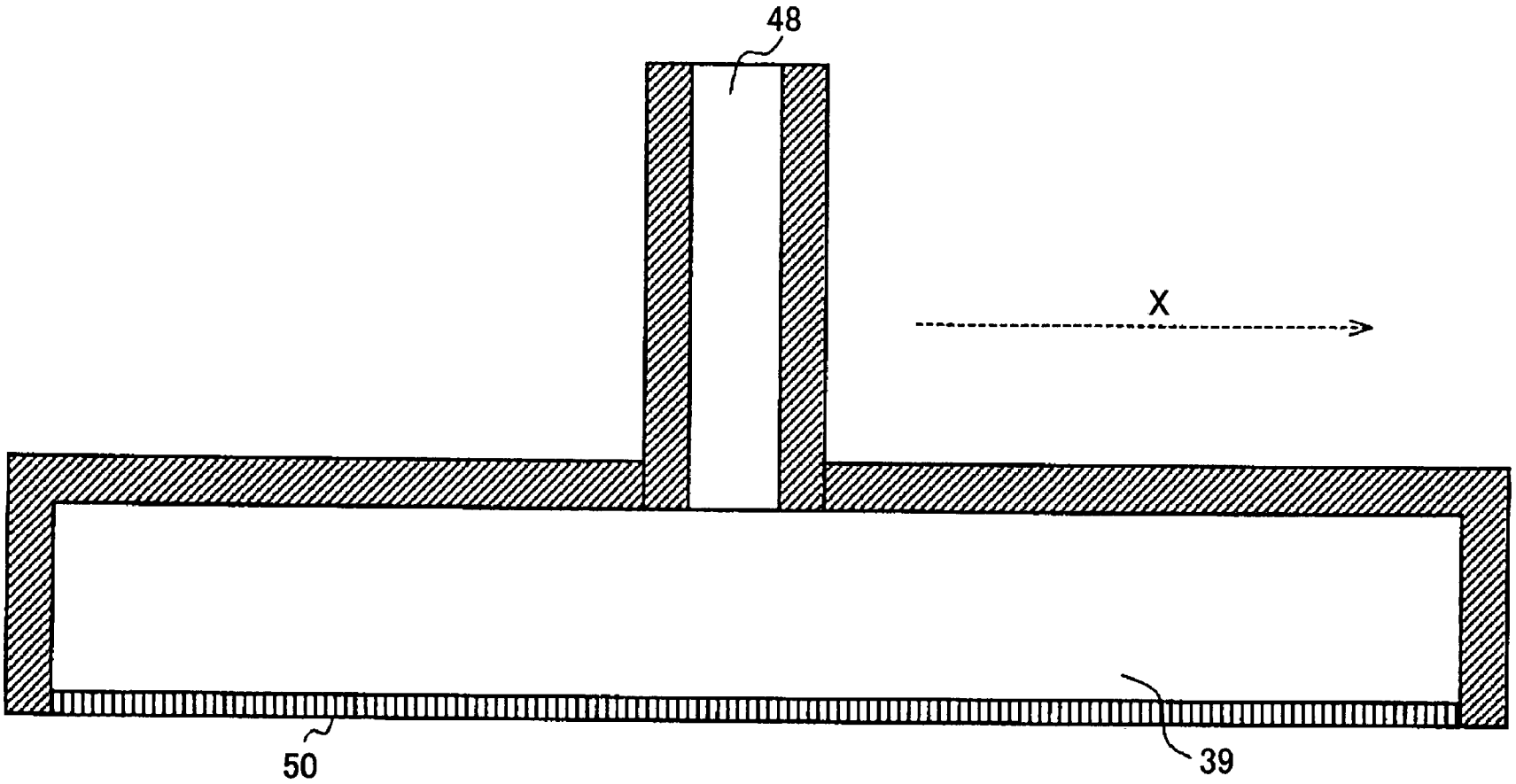
FIG. 26 is a cross sectional view showing only a portion including the common ink chamber and the ink supply opening of the first comparison example of the recording head, for explaining a pressure absorbing member.

Compared to the first comparison example shown in FIG. 26, the length of the pressure absorbing member 50 shown in FIG. 25 is shorter along the longitudinal direction thereof due to the provision of the regions 51 not provided with the pressure absorbing member 50. Consequently, the rigidity of the pressure absorbing member 50, as the vibration plate 36, becomes high, thereby shifting the resonance frequency of the pressure absorbing member 50 towards the high-frequency band. Hence, it is possible to separate the resonance frequency from the driving frequency band of the ink-jet recording head existing in the low-frequency band, to prevent ink-jet failure caused by the pressure change due to the resonance. But in the case of the first comparison example shown in FIG. 26, the pressure absorbing member 50 is long along the longitudinal direction thereof, thereby making the rigidity of the pressure absorbing member 50 low, and the resonance point shifts towards the low-frequency band, which may cause the resonance frequency and the driving frequency to match.

Figure 27:
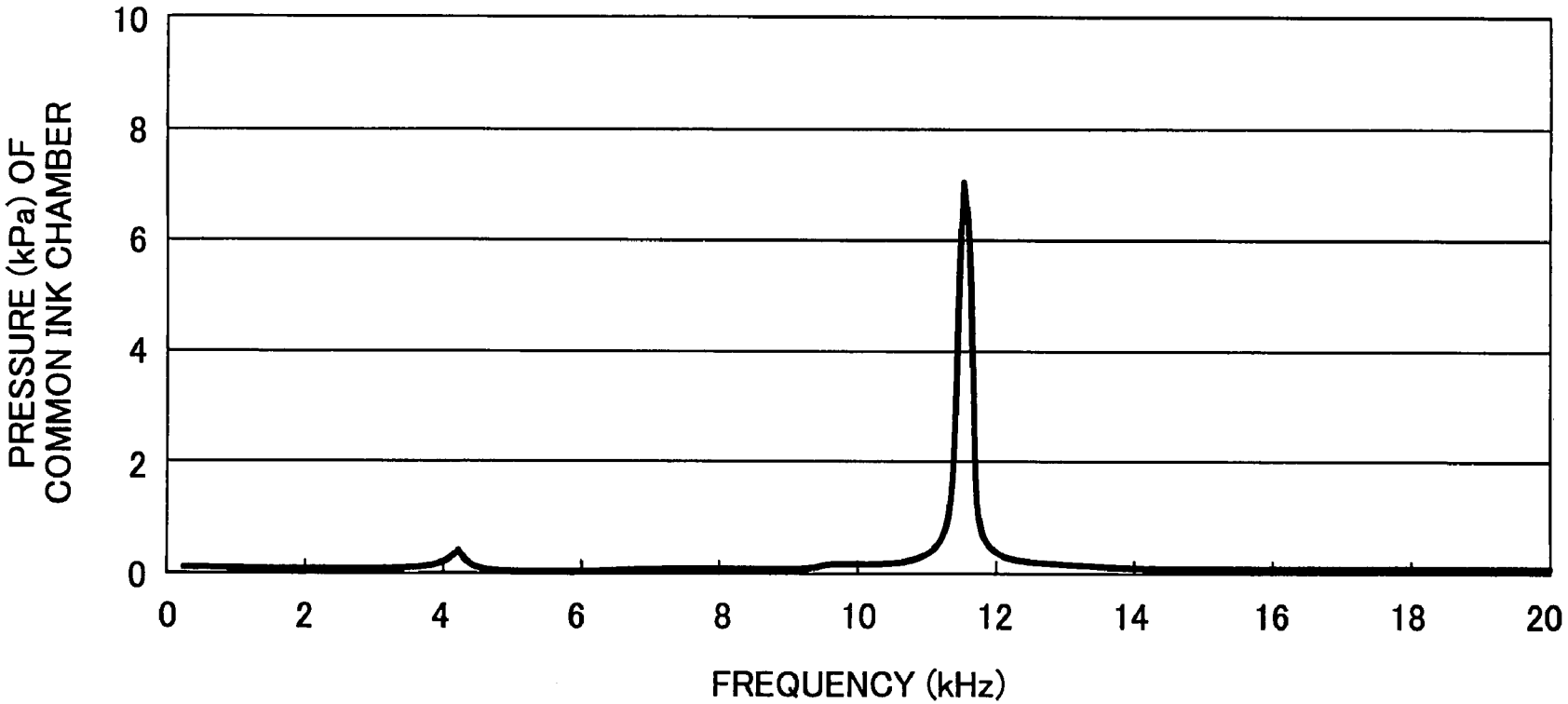
FIG. 27 is a diagram for explaining a frequency characteristic of a pressure change of the common ink chamber of the second embodiment of the recording head.

FIG. 27 is a diagram for explaining a frequency characteristic of a pressure change of the common ink chamber of the second embodiment of the recording head. In FIG. 27, the ordinate indicates the pressure (kPa) of the common ink chamber 39 of the second embodiment of the recording head, and the abscissa indicates the frequency (kHz). FIG. 27 shows the evaluation result for a case where, of the total length of the common ink chamber 39 along the direction X, approximately 25% of the length is formed as the region 51 at each of the two ends along the direction X in FIG. 25. As may be seen by comparing FIG. 27 with the evaluation result indicated by the dotted line in FIG. 16 for the first comparison example shown in FIG. 26, the frequency at which the resonance point is generated is shifted greatly towards the high-frequency band according to this second embodiment. Accordingly, it is possible to drive the ink-jet recording head at a high speed, and to increase the printing speed of the ink-jet recording apparatus.

As shown in FIG. 25, the damper surface of the pressure absorbing member 50 in this second embodiment is desirably a single continuous region, and not sectioned into a plurality of regions. If the damper surface of the pressure absorbing member 50 is sectioned into a plurality of regions, the rigidity of each of the individual regions becomes high and the pressure absorbing effect decreases. On the other hand, if the thickness of the pressure absorbing member 50 is reduced, for example, so as to suppress the pressure absorbing effect from deteriorating, it becomes more difficult to produce the pressure absorbing member 50 and the production yield of the pressure absorbing member 50 and thus the ink-jet recording head deteriorates. In other words, by forming the damper surface of the pressure absorbing member 50 as a single continuous region, it is possible to most efficiently absorb the pressure.

In addition, it is desirable to arrange the region 51 which is not provided with the pressure absorbing member 50 at both ends of the common ink chamber 39 along the direction X, as shown in FIG. 25. If the region 51 were arranged at other locations, such as the central portion of the common ink chamber 39 along the direction X, the damper surface of the pressure absorbing member 50 becomes sectioned into a plurality of regions, the rigidity of the sectioned regions becomes high, and the pressure absorbing effect deteriorates, as described above. On the other hand, if the region 51 is arranged at only one end of the common ink chamber 39 along the direction X, the pressure absorbing effect may become insufficient at the end provided with the region 51, to thereby cause a partial ink-jet failure. Therefore, it is desirable to arrange the region 51 at both ends of the common ink chamber 39 along the direction X.

Figure 28:
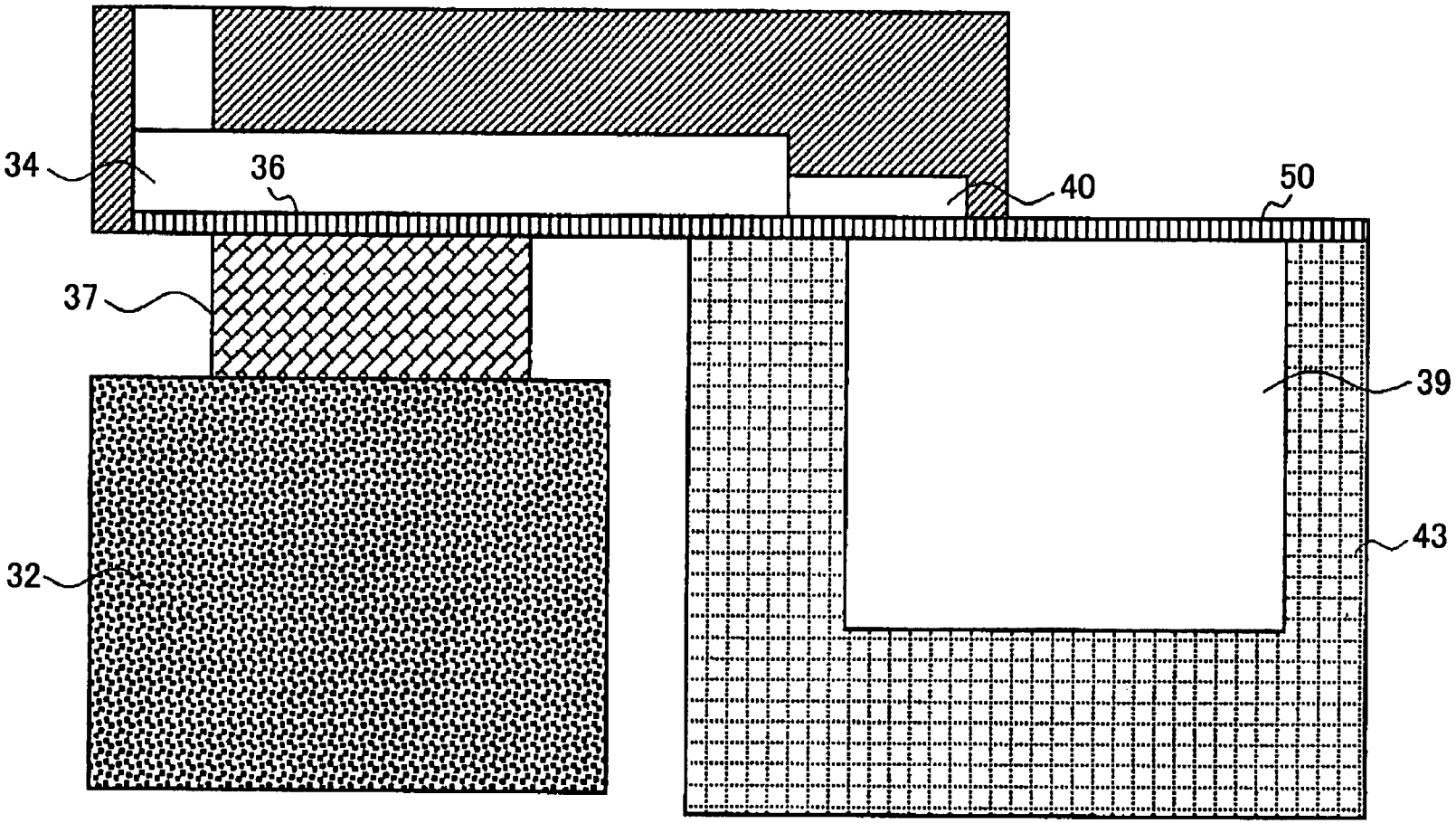
FIG. 28 is a cross sectional view showing a first modification of the second embodiment of the recording head cut along the direction perpendicular to the direction in which the nozzles are arranged.

FIG. 28 is a cross sectional view showing a first modification of the second embodiment of the recording head cut along the direction perpendicular to the direction in which the nozzles 33 are arranged. In FIG. 28, those parts which are the same as those corresponding parts in FIGS. 20 through 25 are designated by the same reference numerals, and a description thereof will be omitted.

In FIG. 28, the pressure absorbing member 50 is formed by a layer which is the same as the layer forming the vibration plate 36 provided with respect to the pressure-applied ink chamber 34. In other words, the layer which functions as the vibration plate 36 with respect to the pressure-applied ink chamber 34 also functions as the pressure absorbing member 50 with respect to the common ink chamber 39.

According to this first modification of the second embodiment of the recording head, it is possible to simultaneously form the vibration plate 36 and the pressure absorbing member 50, and the production process can be simplified. Normally, the rigidity of the vibration plate is too low for use as the pressure absorbing member, and the problem associated with the resonance is easily generated. However, by applying the basic structure of the second embodiment of the recording head to this first modification of the second embodiment, it is possible to suppress the problem associated with the resonance, because the resonance frequency of the pressure absorbing member 50 can be shifted sufficiently towards the high-frequency band relative to the driving frequency of the ink-jet recording head.

However, the region 51 not having the pressure absorbing member 50, cannot be provided in FIG. 28. In other words, in FIG. 28, the vibration plate 36 is also provided at the individual pressure-applied ink chamber 34 corresponding to the region 51, and in order to form the entire ink-jet recording head using the same layer structure, the layer forming the vibration plate 36 must also be arranged at the common ink chamber 39 as the pressure absorbing member 50.

Figure 29:
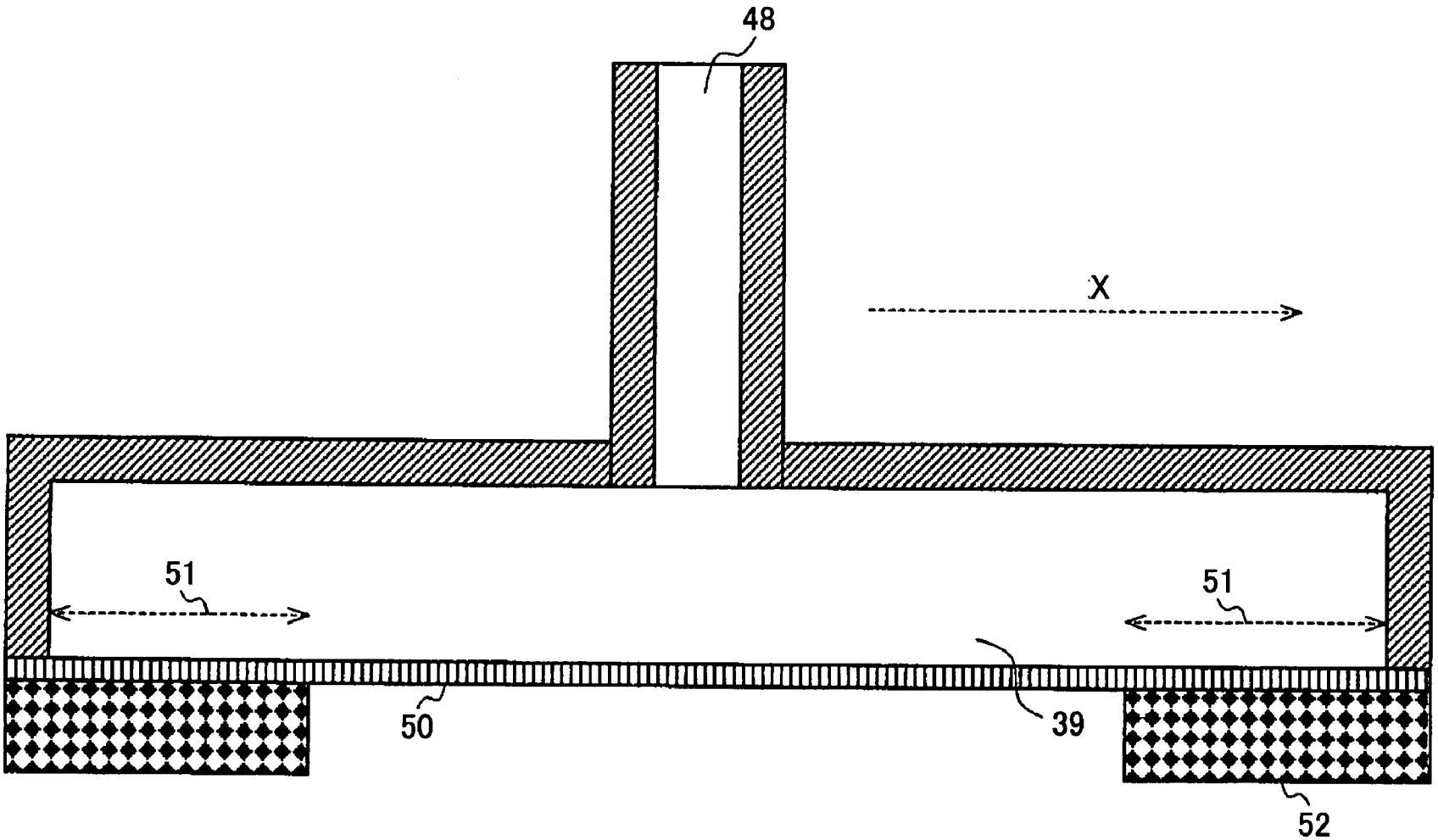
FIG. 29 is a cross sectional view showing only a portion including the common ink chamber and the ink supply opening of a second modification of the second embodiment of the recording head, for explaining a pressure absorbing member.

FIG. 29 is a cross sectional view showing only a portion including the common ink chamber 39 and the ink supply opening 48 of a second modification of the second embodiment of the recording head, for explaining a pressure absorbing member. In FIG. 29, those parts which are the same as those corresponding parts in FIGS. 25 and 28 are designated by the same reference numerals, and a description thereof will be omitted.

Unlike the first modification of the second embodiment shown in FIG. 28, this second modification of the second embodiment shown in FIG. 29 is provided with regions 51 not having the pressure absorbing member 50. More particularly, the layer forming the pressure absorbing member 50 is formed on the entire common ink chamber 39, and a fixed member 52 is partially provided on the pressure absorbing member 50. The fixed member 52 suppresses vibration of the pressure absorbing member 50, and functions as the region 51. Hence, the damper surface is formed by a portion of the pressure absorbing member 50 not provided with the fixed member 52. By forming the fixed member 52 by a portion of the flow passage forming substrate 31, it becomes possible to form the region 51 on the vibration absorbing member 50 without the need to carry out an additional process.

In FIG. 28, the pressure absorbing member 50 and the vibration plate 36 may be formed independently by separate layers. In this case, it is possible to form the pressure absorbing member 50 by the same material as the wall surface forming the common ink chamber 39, and a thickness of a portion of the material that is to function as the pressure absorbing member 50 is made thin, so as to form the pressure absorbing member 50. But in this case, the material forming the common ink chamber 39, that is, the material forming the frame 43, must be made thin in order to obtain the pressure absorbing (damper) function, and a more difficult process is required to form the pressure absorbing member 50. For this reason, the pressure absorbing member 50 may be made of a resin such as polyamide resin, which has a lower elasticity compared to the material forming the frame 43. By use of such a resin for the pressure absorbing member 50, it is possible to produce the pressure absorbing member 50 having an effective pressure absorbing function by a relatively simple process.

If an attempt is made to increase the resonance frequency of the pressure absorbing member 50, the pressure absorbing effect itself deteriorates. For this reason, it is desirable to optimize the shape, size, material and the like of the pressure absorbing member 50, so that the resonance frequency can be shifted sufficiently towards the high-frequency band without deteriorating the pressure absorbing effect to such a level that the deterioration in the ink-jet characteristic is no longer tolerable. Hence, the present inventors produced 8 kinds of samples of the second embodiment of the recording head, with the pressure absorbing member 50 and the common ink chamber 39 having different structures. Table 3 shows 8 kinds of samples of the ink-jet recording head produced, which were subjected to ink-jet tests, with the following evaluations A and C made for each sample. The evaluation A was made to evaluate the mutual interference, that is, whether or not the pressure absorbing member 50 sufficiently functions. The evaluation C was made to evaluate the ink-jet stability at high driving frequencies, that is, whether or not the resonance point of the pressure absorbing member 50 is sufficiently shifted towards the high-frequency band.

TABLE 3

| Sample No. | K1 Value ($\times 10^{-13}$) | Evaluation A | Evaluation C |
|---|---|---|---|
| 1 | 2.01 | ○ | Δ |
| 2 | 1.52 | ○ | ○ |
| 3 | 1.04 | Δ | ○ |
| 4 | 5.49 | x | ○ |
| 5 | 3.93 | ○ | x |
| 6 | 2.98 | ○ | x |
| 7 | 2.03 | ○ | Δ |
| 8 | 1.07 | ○ | ○ |

The evaluation A was made by actually mounting each sample of the ink-jet recording head and printing an evaluation chart, to judge whether or not an image abnormality is generated in the printed sample. In Table 3, "O" indicates that no image abnormality was detected by the evaluation A for all of the nozzles 33 (or channels), "Δ" indicates that the image abnormality was detected by the evaluation A for 10% or less of the nozzles 33 (or channels), and "X" indicates that the image abnormality was detected by the evaluation A for more than 10% of the nozzles 33 (or channels). On the other hand, the evaluation C was made by ejecting the ink from each sample of the ink-jet recording head by itself, while varying the driving frequency, to observe the ink-jet stability. In Table 3, "O" indicates that the ink-jet stability is maintained for all of the nozzles 33 (or channels), "Δ" indicates that the ink-jet stability is deteriorated for 10% or less of the nozzles 33 (or channels), and "X" indicates that the ink-jet stability is deteriorated for more than 10% of the nozzles 33 (or channels).

Furthermore, the following items were selected as structure factors which may be regarded as affecting the evaluations A and C.

SF11) Total length Lx (m) of the common ink chamber 39 along the direction X;

SF12) Length Ldx (m) of the damper surface of the pressure absorbing member 50 along the direction X;

SF13) Length Ldy (m) of the damper surface of the pressure absorbing member 50 along the direction perpendicular to the direction X;

SF14) Thickness Td (m) of the pressure absorbing member 50 forming the damper surface; and SF15) Elasticity Gd (Pa) of the pressure absorbing member 50 forming the damper surface.

The above structure factors SF11 through SF15 were regarded as variables, and a1, b1, c1, d1 and e1 were regarded as fitting parameters in the following formula and optimized, so as to obtain a parameter K1 which indicates the performance of the pressure absorbing member 50 by taking into account the pressure absorbing effect and the adverse or side effects of the resonance frequency of the pressure absorbing member 50. The value of this parameter K1 is referred to as the K1 value in Table 3.

$$K1=Lx^{a1}\times Ldx^{b1}\times Ldy^{c1}\times Td^{d1}\times Gd^{e1}$$

It was found that the K1 value appropriately indicates the performance of the pressure absorbing member 50 when the fitting parameters a1, b1, c1, d1 and e1 were set to a1=−1, b1=1, c1=1, d1=−0.3 and e1=−1.

It may be seen from Table 3 that the pressure absorbing effect of the pressure absorbing member 50 becomes high when the K1 value is large, but the adverse or side effects of the resonance frequency of the pressure absorbing member 50 becomes larger. Both the evaluations A and C are satisfactory when the K1 value falls within a range of approximately $1.0\times10^{-13}$ to approximately $2.0\times10^{-13}$, that is, when the following relationship is satisfied.

$$1.0\times10^{-13}<Lx^{-1}\times Ldx\times Ldy\times Td^{-0.3}\times Gd^{-1}<2.0\times10^{-13}$$

Therefore, it was confirmed from the above evaluation results that a satisfactory ink-jet characteristic can be obtained even when carrying out a high-speed recording, by employing the structure of any of the second embodiment and the first and second modifications of the second embodiment of the recording head, and that it is possible to record an image having a high picture quality at a high speed by providing such a recording head in a carriage of an image forming apparatus.

Next, a description will be given of a first method of producing the second embodiment of the recording head according to the present invention.

A stacked piezoelectric element, which is used as a pressure converting means, is bonded on a support substrate (base substrate 32) made of Special Use Stainless (SUS) by use of an anaerobic adhesive, and a groove is formed in the piezoelectric element by use of a dicing saw, so as to form a piezoelectric element 37 which is separated so as to correspond to each pressure-applied ink chamber 34. An FPC cable 45, which is used as a conductor member, is connected to the side surface of the piezoelectric element 37 which is formed with the groove, by soldering, so as to form an actuator unit.

On the other hand, a nozzle plate 38 and a vibration plate 36 which are formed by electroforming, and a flow passage forming substrate (ink chamber substrate) 31 made of silicon is formed by etching. The nozzle plate 38, the vibration plate 36 and the flow passage forming substrate 31 are positioned and stacked with high precision, and an epoxy adhesive is applied to each interface to bond the nozzle plate 38, the vibration plate 36 and the flow passage forming substrate 31 together. A top surface of the piezoelectric element 37 of the actuator unit is bonded to a back surface of the vibration plate 36 by an epoxy adhesive.

A common ink chamber 39 having a length of 37 mm along the longer side thereof, a length of 2 mm along the shorter side thereof, and a depth of 1 mm is formed. A frame member 43 is made of a resin and has an opening having a length of 20 mm and a width of 1.2 mm provided at a central portion of the wall surface of the common ink chamber 39. A polyamide resin film having a thickness of 20 μm is adhered to the frame member 43 at the opening, as the pressure absorbing member. This frame member 43 is bonded on the back surface of the vibration plate 36 and the end surface of the base substrate 32 by an anaerobic adhesive, so as to form the ink-jet recording head.

The ink-jet recording head which is produced in the above described manner was mounted on a printer and print tests were carried out. As a result of the print tests, it was confirmed that a satisfactory printing can be carried out without generating a deteriorated picture quality, even when a multi-printing was carried out by ejecting the ink from all of the nozzles 33.

For comparison purposes, an ink-jet recording head having the polyamide resin film adhered at an opening which has a size of 37 mm×2 mm and is provided for the entire side surface of the common ink chamber 39, was produced. In addition, this ink-jet recording head was mounted on a printer and print tests were carried out. As a result of the print tests, it was confirmed that the deteriorated picture quality is generated by the printing.

Therefore, it was confirmed that the ink-jet characteristic is improved by this second embodiment of the recording head according to the present invention.

Next, a description will be given of a second method of producing the second embodiment of the recording head according to the present invention.

A stacked piezoelectric element, which is used as a pressure converting means, is bonded on a support substrate (base substrate 32) made of Special Use Stainless (SUS) by use of an anaerobic adhesive, and a groove is formed in the piezoelectric element by use of a dicing saw, so as to form a piezoelectric element 37 which is separated so as to correspond to each pressure-applied ink chamber 34. An FPC cable 45, which is used as a conductor member, is connected to the side surface of the piezoelectric element 37 which is formed with the groove, by soldering, so as to form an actuator unit.

On the other hand, a nozzle plate 38 and a vibration plate 36 which are formed by electroforming, and a flow passage forming substrate (ink chamber substrate) 31 made of silicon is formed by etching. The nozzle plate 38, the vibration plate 36 and the flow passage forming substrate 31 are positioned and stacked with high precision, and an epoxy adhesive is applied to each interface to bond the nozzle plate 38, the vibration plate 36 and the flow passage forming substrate 31 together. A top surface of the piezoelectric element 37 of the actuator unit is bonded to a back surface of the vibration plate 36 by an epoxy adhesive.

A common ink chamber 39 having a length of 37 mm along the longer side thereof, a length of 2 mm along the shorter side thereof, and a depth of 1 mm is formed. A frame member 43 is made of a resin and has an opening having a length of 25 mm and a width of 1.2 mm provided at a central portion of the wall surface of the common ink chamber 39.

This frame member 43 is bonded on the back surface of the vibration plate 36 and the end surface of the base substrate 32 by an anaerobic adhesive, so as to cover the opening in the frame member 43 by the vibration plate 36, and the ink-jet recording head was produced.

The ink-jet recording head which is produced in the above described manner was mounted on a printer and print tests were carried out. As a result of the print tests, it was confirmed that a satisfactory printing can be carried out without generating a deteriorated picture quality, even when a multi-printing was carried out by ejecting the ink from all of the nozzles 33.

Therefore, it was confirmed that the ink-jet characteristic is improved by this second embodiment of the recording head according to the present invention.

In order to satisfy the demands to further increase the recording speed and further improve the picture quality of the recorded image of the ink-jet recording apparatus, it is possible to either increase the driving frequency of the ink-jet recording head or to increase the number of nozzles per ink-jet recording head.

However, when the driving frequency of the ink-jet recording head is increased, the pressure in the pressure-applied ink chambers undergoes a complex behavior due to reflection of the pressure propagated from the pressure-applied ink chambers to the common ink chamber, and it becomes difficult to accurately eject the ink drop. On the other hand, when the number of nozzles is large, the end portion of the common ink chamber along the longitudinal direction thereof sometimes has a narrowed shape in order to satisfactorily eject air bubbles in the common ink chamber. But because of the narrowed shape, the pressure change in the common ink chamber becomes large towards the end portion along the longitudinal direction thereof, and the effects on the pressure of the pressure-applied ink chambers is larger from the end portion than the central portion of the common ink chamber along the longitudinal direction thereof. In other words, the pressure behavior of the pressure-applied ink chambers is different depending on the position of each pressure-applied ink chamber, and it is extremely difficult to appropriately control the pressure behavior of all of the pressure-applied ink chambers. For this reason, it is not only desirable to suppress the pressure change in the common ink chamber, but also desirable to suppress the differences in the pressure changes of the pressure-applied ink chambers regardless of the positions of the pressure-applied ink chambers.

A method of suppressing the pressure change in the common ink chamber by providing an air chamber in the common ink chamber to function as an air damper, has been proposed in a Japanese Patent No. 3069477. In addition, a method of absorbing the pressure generated by the ink ejection by using a porous or cellular elastic material for at least a portion of the ink chamber, has been proposed in a Japanese Laid-Open Patent Application No. 7-171969.

A Japanese Laid-Open Patent Application No. 9-141856 proposes providing a damper chamber in a portion of the common ink chamber, and providing an elastic member between the pressure-applied ink chambers and an energy generating part to section the damper chamber and the common ink chamber, so as to use the elastic member as a damper. Furthermore, a Japanese Laid-Open Patent Application No. 2000-301714 proposes providing an elastic layer including a piezoelectric element in the common ink chamber, and absorbing the pressure by driving the piezoelectric element depending on the pressure of the common ink chamber.

However, according to the method proposed in the Japanese Patent No. 3069477, the amount of air within the air chamber cannot be recovered by itself, and it is difficult to maintain the damper effect for a long period of time. Hence, it is necessary to constantly control the amount of air held within the air chamber, but a heating element becomes necessary in order to carry out such a control, and the proposed method is difficult to realize or becomes expensive when employed in the ink-jet recording heads using actuators other than the thermal actuator. Moreover, the control itself of the amount of air within the air chamber is difficult, and the air separated from the air chamber may enter within the pressure-applied ink chambers and prevent the pressure of the pressure-applied ink chambers from increasing sufficiently. As a result, an ink-jet failure may occur in a worst case.

According to the method proposed in the Japanese Laid-Open Patent Application No. 7-171969, an additional process is required to provide the porous or cellular elastic material, and the ink-jet recording head becomes expensive.

In addition, according to the method proposed in the Japanese Laid-Open Patent Application No. 9-141856, it is necessary to secure a sufficiently large area for the damper chamber in order to obtain a sufficient damper effect. But as a result, the degree of freedom with which the shape of the common ink chamber may be designed becomes restricted, and it becomes difficult to form the common ink chamber which can eject the air bubbles satisfactorily.

Furthermore, according to the method proposed in the Japanese Laid-Open Patent Application No. 2000-301714, it is difficult to control the piezoelectric element so as to effectively absorb the pressure, and a control unit must be provided additionally to control the piezoelectric element. Consequently, the structure of the ink-jet recording apparatus becomes complex and the ink-jet recording apparatus becomes expensive.

Accordingly, a description will now be given of a third embodiment of the recording head according to the present invention, having a reduced size and cost, and capable of improving the ink-jet characteristic.

Figure 30:
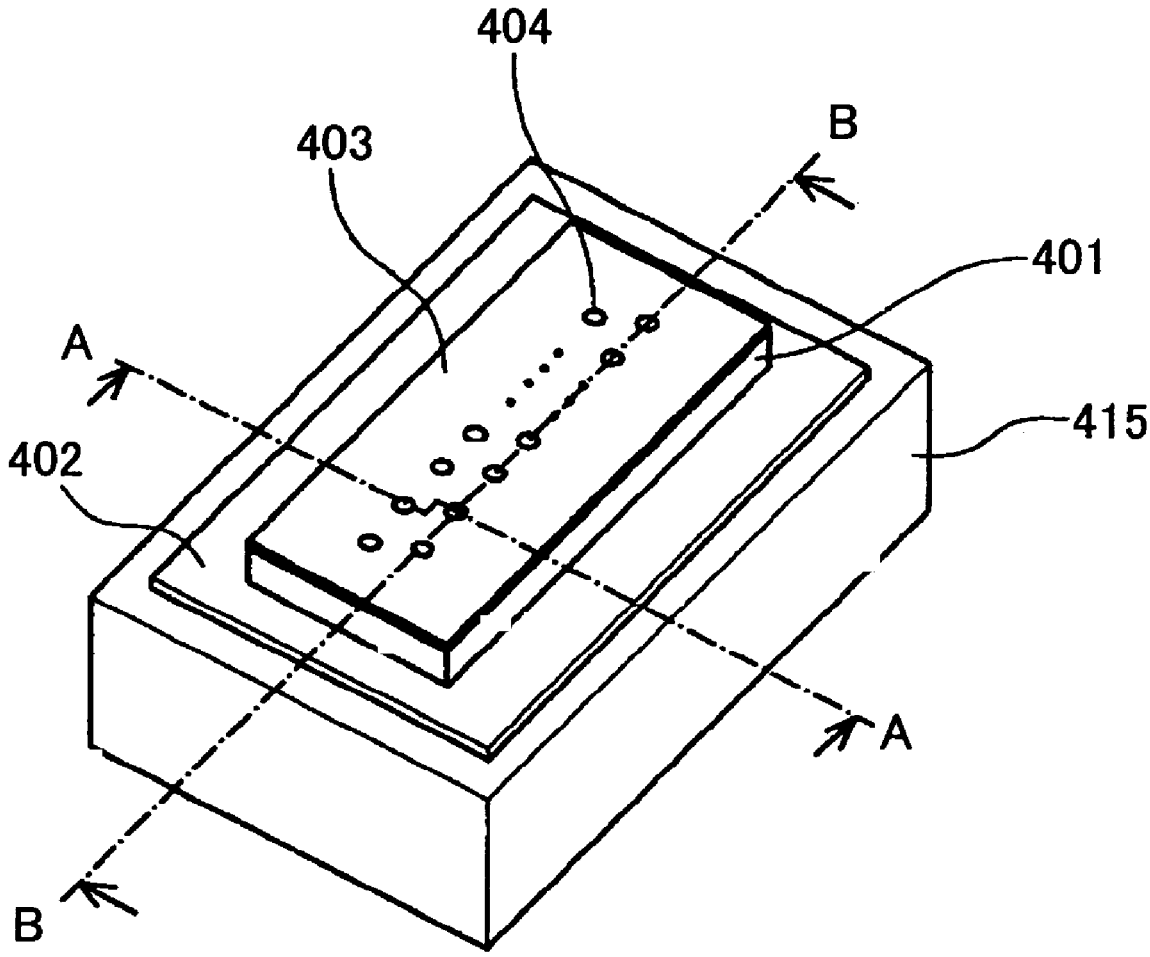
FIG. 30 is a perspective view showing a third embodiment of the recording head according to the present invention.
Figure 31:
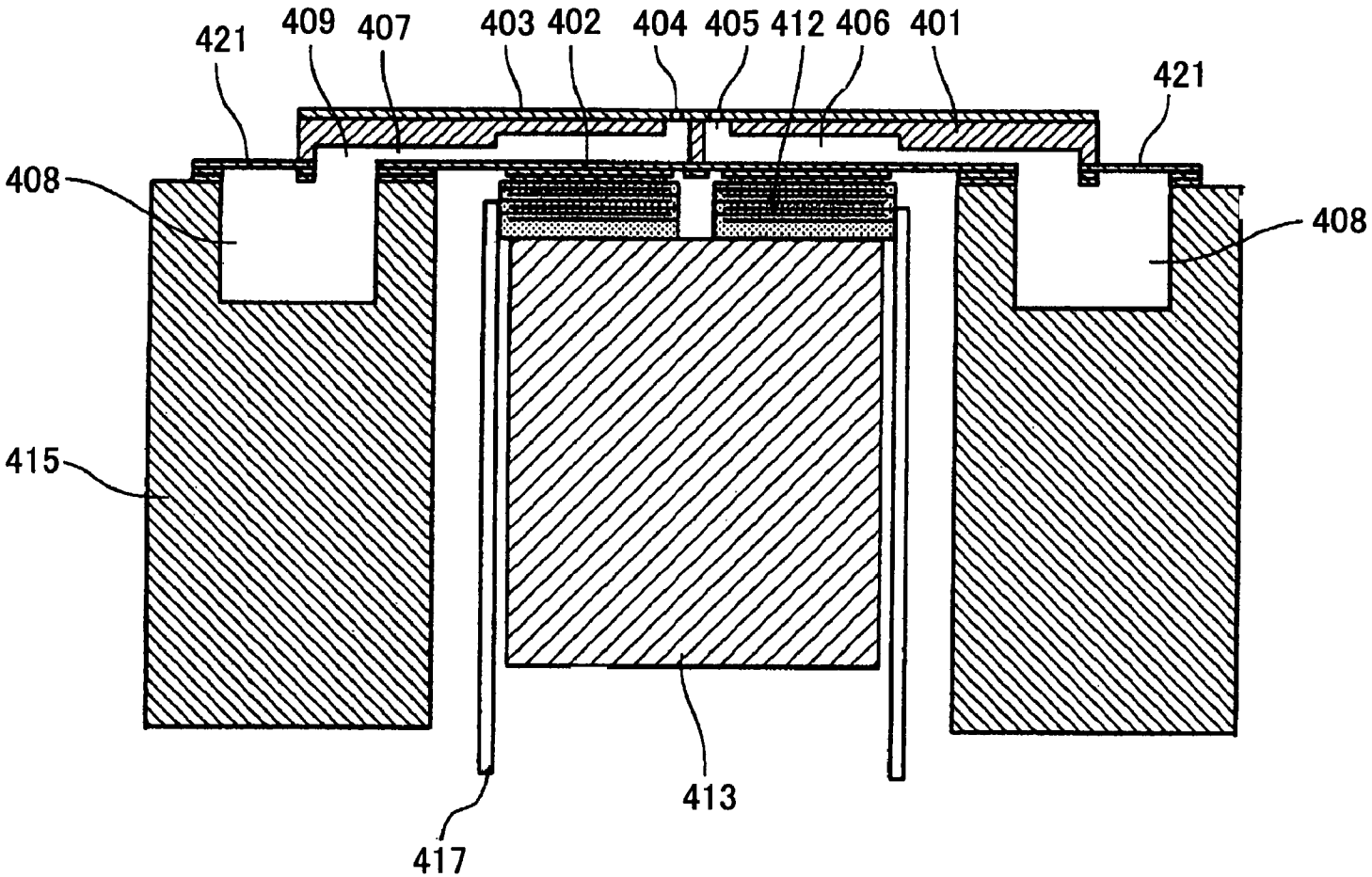
FIG. 31 is a cross sectional view showing the third embodiment of the recording head cut along a line A-A in FIG. 30.
Figure 32:
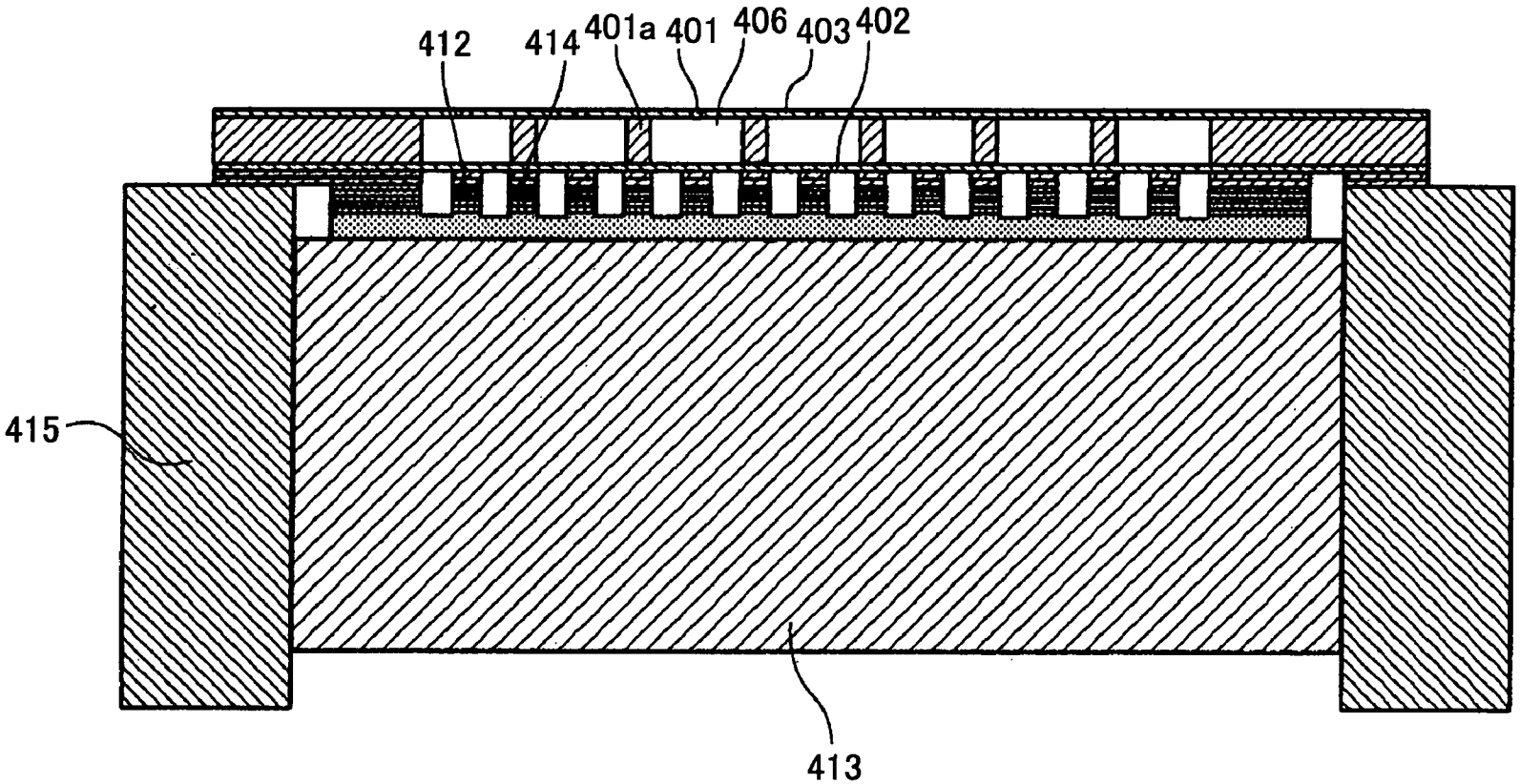
FIG. 32 is a cross sectional view showing the third embodiment of the recording head cut along a line B-B in FIG. 30.
Figure 33:
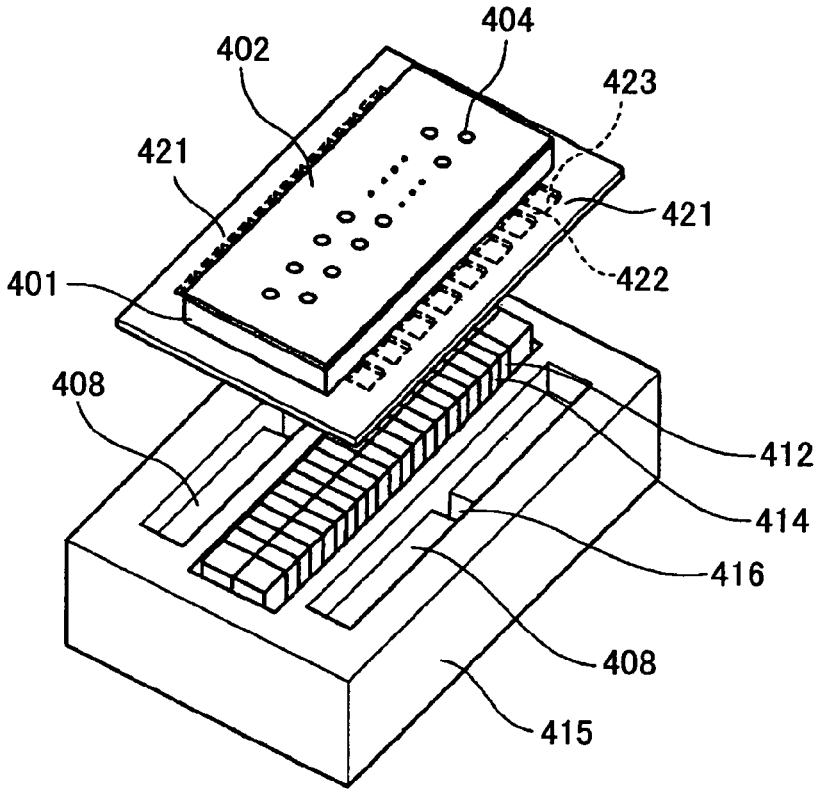
FIG. 33 is a disassembled perspective view showing the third embodiment of the recording head.
Figure 34:
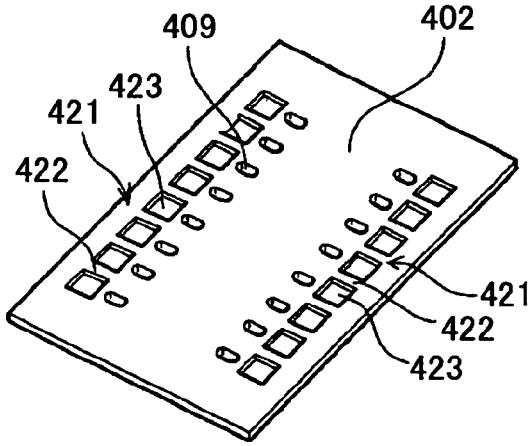
FIG. 34 is a perspective view showing a vibration plate shown in FIG. 33 viewed from a bottom surface thereof.

A description will be given of the third embodiment of the recording head, by referring to FIGS. 30 through 34. FIG. 30 is a perspective view showing the third embodiment of the recording head. FIG. 31 is a cross sectional view showing the third embodiment of the recording head cut along a line A-A in FIG. 30, and FIG. 32 is a cross sectional view showing the third embodiment of the recording head cut along a line B-B in FIG. 30. In addition, FIG. 33 is a disassembled perspective view showing the third embodiment of the recording head, and FIG. 34 is a perspective view showing a vibration plate shown in FIG. 33 viewed from a bottom surface thereof. In this third embodiment of the recording head, the present invention is applied to an ink-jet recording head.

The ink-jet recording head shown in FIGS. 30 through 33 includes a flow passage forming substrate 401 made of a single crystal silicon (Si), a vibration plate 402 provided on a lower surface of the flow passage forming substrate 401, and a nozzle plate 403 which is provide on an upper surface of the flow passage forming substrate 401. The flow passage forming substrate 401, the vibration plate 402 and the nozzle plate 403 form pressure-applied ink chambers 406 and a common ink chamber 408. Each nozzle 404 which ejects an ink drop communicates to one of the pressure-applied ink chambers 406 which forms a flow passage, via a nozzle communication passage 405. The common ink chamber 408 supplies the ink to the pressure-applied ink chambers 406 via an ink supply passage (communicating part) 409 which forms a flow resistance portion.

A stacked piezoelectric element 412 is provided with respect to each pressure-applied ink chamber 406 on the outer surface side of the vibration plate 402, that is, on the side opposite to the pressure-applied ink chamber 406, as a pressure generating means (or actuator means). The piezoelectric element 412 is an electromechanical conversion element as is well known, and is fixed on a base substrate 413 which is made of a highly rigid material such as metals or ceramics.

A partition 401*a* is provided between two adjacent pressure-applied ink chambers 406. A support portion 414 is provided between adjacent piezoelectric elements 412, at a position corresponding to the partition 401*a*. In this embodiment, a piezoelectric element member is subjected to a semi-cut (half-cut) dicing to form slits in a comb shape, so as to form the piezoelectric elements 412 by every other teeth of the comb shape and to form the support portion 414 by the teeth between the two adjacent teeth forming the piezoelectric elements 412. The support portion 414 and the piezoelectric element 412 have the same structure, but the support portion 414 does not function as the piezoelectric element 412 because no driving voltage is applied thereto.

A frame member 415 is provided on an outer peripheral portion of the vibration plate 402 by an adhesive. As shown in FIG. 33, a groove portion, which forms the common ink chamber 408, is formed in the frame member 415. In addition, an ink supply opening 416, which supplies the ink to the common ink chamber 408 from the outside, is formed in the frame member 415. This ink supply opening 416 is connected to an ink supply source (not shown) such as an ink cartridge. For example, the frame member 415 is made of epoxy resins or polyphenylene sulfite, by ejection molding.

Holes, grooves and the like for forming the nozzle communication passage 405, the pressure-applied ink chambers 406 and the ink supply passage 407 are formed in the flow passage forming substrate 401 by carrying out an anisotropic etching of a single crystal silicon substrate having a (110) crystal orientation, using an alkaline etchant such as potassium hydroxide (KOH) solution. Of course, a material other than silicon, such as stainless steel and photoconductive (or photosensitive) resin, may be used for the flow passage forming substrate 401.

The vibration plate 402 is made of a metal plate which is formed by electroforming, for example. In this embodiment, the vibration plate 402 is made of a nickel (Ni) plate having a 2-layer structure. However, a material other than nickel, such as other metals, resins, a stacked structure of metal and resin layers and a stacked structure of metal layers, may be used for the vibration plate 402.

Each nozzle 404 corresponding to one of the pressure-applied ink chambers 406 is formed in the nozzle plate 403 to have a diameter of approximately 10 μm to approximately 35 μm. The nozzle plate 403 may be made of a metal such as stainless steel and nickel (Ni), a combination of a metal and a resin such as polyimide resin film, silicon, or a combination of such materials. In this embodiment, the nozzle plate 403 is made of a nickel-plated layer which is formed by electroforming. The internal shape (or inner shape) of the nozzle 404 may be a horn-shape, approximate cylinder-shape, or an approximate cone-shape, such that the nozzle diameter on the ink-jet side is approximately 20 μm to approximately 35 μm. In each column of the nozzles 404, the nozzles 404 are arranged at a pitch of 150 dpi.

A water repellent layer is formed on a nozzle surface of the nozzle plate 403, that is, the surface from which the ink is ejected, to ensure that the nozzle surface repels the ink. The water repellent layer may be formed on the nozzle surface by a known method such as plating and coating the water repellent layer. More particularly, PTFE-Ni eutectic plating, electrodeposition of fluororesin, evaporation of evaporative fluororesin, and baking after coating silicon resin or fluororesin solvent, may be employed as the known method. By selecting the water repellent layer depending on the ink composition or characteristic, it is possible to stabilize the shape of the ink drop and the ink-jet characteristic, and obtain a high picture quality.

The piezoelectric element 412 has a stacked structure made up of a piezoelectric layer and an internal electrode layer which are alternately stacked. The piezoelectric layer is made of lead zirconate titanate(PZT) having a thickness of approximately 10 μm to approximately 50 μm, and the internal electrode layer is made of silver palladium (AgPd) having a thickness of several μm. In addition, the internal electrode layers are alternately connected electrically to an end surface electrode (external or individual electrode) and a common electrode, and a driving signal is supplied to these electrodes via an FPC cable 417. The pressure-applied ink chamber 406 is made to contract and expand by the contraction and expansion of the piezoelectric element 412 having a piezoelectric constant of d23. The piezoelectric element 412 expands when the driving signal is applied thereto and a charging takes place, and the piezoelectric element 412 contracts in an opposite direction when the charge is discharged.

As shown in FIG. 33, the common ink chamber 408 has a rectangular shape which is elongated, in a plan view, in a direction in which the pressure-applied ink chambers 406 (or nozzles 404) are arranged. This direction in which the pressure-applied ink chambers 406 are arranged, will also be referred to as a longitudinal direction of the common ink chamber 408.

The vibration plate 402 which forms the wall surface of the pressure-applied ink chamber 406 forms a portion of the wall surfaces of the common ink chamber 408. This portion of the wall surfaces of the common ink chamber 408, formed by the vibration plate 402, will be referred to as a free vibration surface 421. As shown in FIG. 34 which omits the portions connected to the piezoelectric elements 412, the free vibration surface 421 includes thick portions 422 and thin portions 423. The thick portions 422 and the thin portions 423 have an approximately rectangular shape in a plan view, and are arranged in a stripe pattern extending in the longitudinal direction of the common ink chamber 408. In this case, the vibration plate 402 has a stacked structure made up of 3 layers, and the thick portions 422 are formed by all of the 3 layers of the stacked structure, while the thin portions 423 are formed by only 1 layer of the stacked structure. Of course, the thick portions 422 may be formed by 2 layers with the thin portions 423 formed by 1 layer or, the thick portions 422 may be formed by 3 layers with the thin portions 423 formed by 2 layers.

When a driving pulse voltage of approximately 20 V to approximately 50 V is selectively applied to the piezoelectric elements 412 of the ink-jet recording head having the above described structure, the piezoelectric element 412 which is applied with the driving pulse voltage is displaced in an expanding direction in which the layers of the piezoelectric element 412 are stacked, and the vibration plate 402 is deformed in a direction of the corresponding nozzle 404. As a result, the volume or capacity of the corresponding pressure-applied ink chamber 406 changes to apply pressure on the ink within the pressure-applied ink chamber 406, and the ink drop is ejected from the corresponding nozzle 404 to enable the ink-jet recording.

As the ink is ejected, the ink pressure within the pressure-applied ink chamber 406 decreases, and a slight negative pressure is generated within the pressure-applied ink chamber 406 due to inertia of the ink flow. In this state, the vibration plate 402 returns to its original position and the pressure-applied ink chamber 406 returns to its original shape when the application of the driving pulse voltage to the piezoelectric element 412 is stopped, that is, when the driving pulse voltage is turned OFF, and as a result, the negative pressure is further generated within the pressure-applied ink chamber 406. In this state, the ink is supplied to the pressure-applied ink chamber 406 from the ink supply opening 409 via the common ink chamber 408 and the ink supply passage 407 which forms the flow resistance portion. Hence, after the vibration of an ink meniscus surface at the nozzle 404 is damped and stabilizes, the driving pulse voltage is applied to the piezoelectric element 412 to eject the ink drop to enable the next ink-jet recording.

When the pressure is applied on the pressure-applied ink chamber 406 to eject the ink drop, the pressure wave generated in the pressure-applied ink chamber 406 propagates to the common ink chamber 408 via the ink supply passage 407 and the ink supply opening 409. However, the pressure change is absorbed and damped within the common ink chamber 408 due to the thin portions 423 of the free vibration surface 421 forming the wall surface of the common ink chamber 408. As a result, the pressure wave is prevented from being reflected back to the pressure-applied ink chamber 406, thereby improving the controllability of the meniscus and the ink-jet characteristic.

The present inventors performed numerical simulations with respect to a third comparison example having the wall surface of the common ink chamber 408 formed by the vibration plate 403 itself (using only the thick portion 422), and this third embodiment of the recording head having the wall surface of the common ink chamber 408 formed by the free vibration surface 421 which includes the thick portions 422 and the thin portions 423. The pressure change of the pressure-applied ink chamber 406 located at the central portion of the common ink chamber 408 and the pressure change of the pressure-applied ink chamber 406 located at the end portion of the common ink chamber 408 along the longitudinal direction thereof, were compared for the third comparison example and this third embodiment of the recording head.

After supplying the driving pulse voltage to the piezoelectric element 412 to apply pressure on the corresponding pressure-applied ink chamber 406, effective values of the pressure changes of the pressure-applied ink chamber 406 during a time of 20 μsec were averaged. It was found that the pressure change of the pressure-applied ink chamber 406 located at the end portion of the common ink chamber 408 is approximately 15% greater than that at the central portion of the common ink chamber 408, and large, for the third comparison example. On the other hand, it was found that the pressure change of the pressure-applied ink chamber 406 located at the end portion of the common ink chamber 408 is only approximately 2% greater than that at the central portion of the common ink chamber 408, and small, for the third embodiment of the recording head. Therefore, it was confirmed that the pressure absorbing efficiency is improved by forming the free vibration surface 421 by the thin portions 423 and the thick portions 422.

The third comparison example and this third embodiment of the recording head were respectively mounted on a printer and print tests were carried out. As a result of the print tests, it was confirmed that a deteriorated picture quality is generated when a multi-printing was carried out by the third comparison example by ejecting the ink from all of the nozzles 404. But on the other hand, it was found that a satisfactory printing can be carried out by this third embodiment of the recording head without generating a deteriorated picture quality, even when a multi-printing was carried out by ejecting the ink from all of the nozzles 404.

Therefore, since at least a portion of the wall surfaces of the common ink chamber 408 is formed by the free vibration surface 421 having the thick portions 422 and the thin portions 423, the pressure of the common ink chamber 408 can be absorbed by the thin portions 423, while the rigidity and strength of the free vibration surface 421 can be maintained by the thick portions 422. For this reason, the ink-jet recording head can be produced by a simple process. In addition, the pressure change within the common ink chamber 408 can be effectively damped or absorbed, and the controllability of the meniscus and the ink-jet characteristic can be improved. It is also possible to improve the air bubble ejection, and to improve the degree of freedom of design of the ink-jet recording head.

In other words, by providing the free vibration surface 421 at the common ink chamber 408, the pressure of the common ink chamber 408 can be reduced by the damper effect of the free vibration surface 421. But since the damping capacity increases as the free vibration surface 421 becomes thinner, it is preferable to provide a thin free vibration surface 421 for the entire wall surface of the common ink chamber 408. However, it is difficult from the point of view of the process and the assembly to form the thin free vibration surface 421 which covers a large area, and the strength of such a thin free vibration surface 421 may be insufficient. Hence, this third embodiment of the recording head provides the thick portions 422 and the thick portions 423 in the free vibration surface 421, so that the ink-jet recording head can be produced by a simple process, the strength of the free vibration surface 421 is sufficient, an effective damper effect can be obtained, and the pressure within the common ink chamber 408 can be reduced.

In this case, the free vibration surface 421 and the vibration plate 402 which is arranged on one surface of the pressure-applied ink chamber 406 may be integrally formed by the same layer, so as to reduce the number of constituent parts of the ink-jet recording head. Because the vibration plate 402 and the free vibration surface 421 can be formed simultaneously by the same process, it is possible to reduce the production cost and the number of production processes and assembling processes. This is because, after the parts forming the pressure-applied ink chamber 406 and the parts forming the common ink chamber 408 are formed, the pressure-applied ink chamber 406 and the common ink chamber 408 can be formed by a single process which connects the layer forming the vibration plate 402 and the free vibration surface 421.

By employing the stacked structure for the free vibration surface 421, it is possible to form the thin portions 423 by a simple process by changing the number of layers forming the thin portions 423 with respect to the number of layers forming the thick portions 422. The free vibration surface 421 can be formed to have a sufficient strength by a simple process, by forming the thick portions 422 by all of the layers (maximum number of layers) making up the stacked structure.

Figure 35:
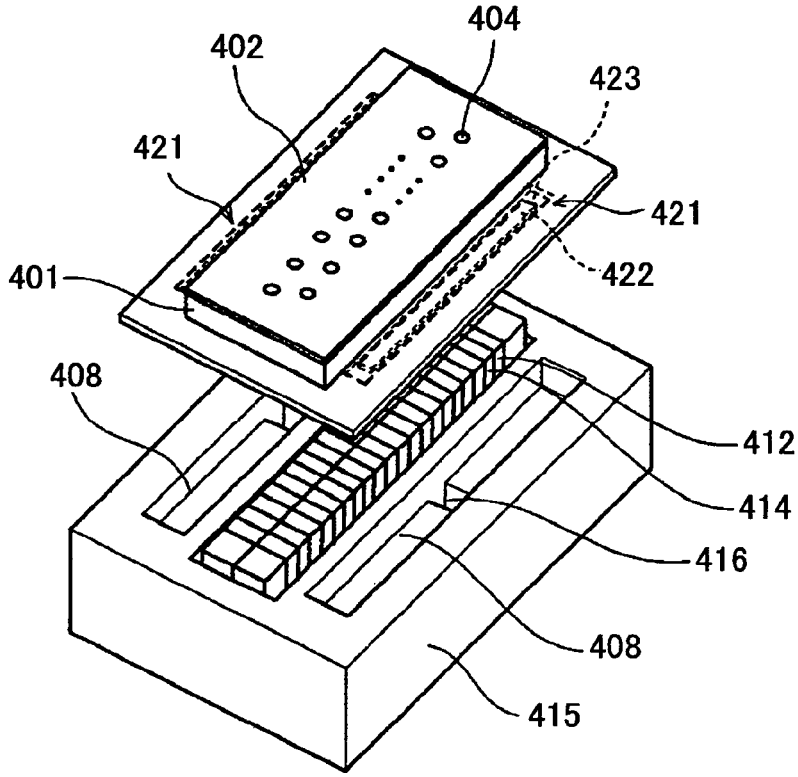
FIG. 35 is a disassembled perspective view showing a first modification of the third embodiment of the recording head according to the present invention.
Figure 36:
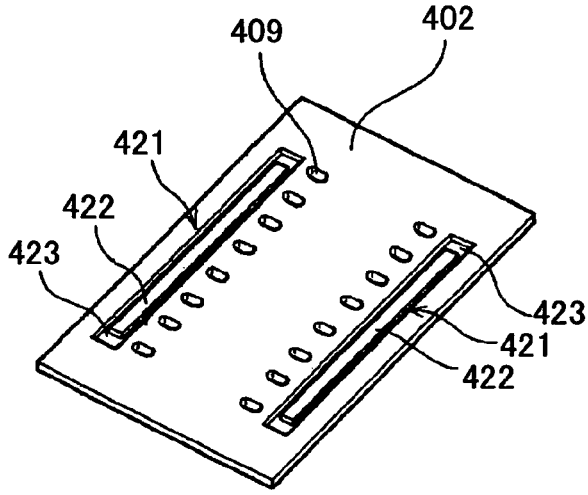
FIG. 36 is a perspective view showing a vibration plate shown in FIG. 35 viewed from a bottom surface thereof.

Next, a description will be given of a first modification of the third embodiment of the recording head according to the present invention, by referring to FIGS. 35 and 36. FIG. 35 is a disassembled perspective view showing the first modification of the third embodiment of the recording head, and FIG. 36 is a perspective view showing a vibration plate shown in FIG. 35 viewed from a bottom surface thereof. In FIGS. 35 and 36, those parts which are essentially the same as those corresponding parts in FIGS. 30 through 34 are designated by the same reference numerals, and a description thereof will be omitted.

The free vibration plate 421 shown in FIG. 35 which forms the wall surface of the common ink chamber 408 has thin portions 423 arranged in the peripheral portion thereof as shown in FIG. 36, and a thick portion 422 is formed at the central portion of the free vibration surface 421 in the form of an island.

The third comparison example and this first modification of the third embodiment of the recording head were respectively mounted on a printer and print tests were carried out. As a result of the print tests, it was confirmed that a deteriorated picture quality is generated when a multi-printing was carried out by the third comparison example by ejecting the ink from all of the nozzles 404. But on the other hand, it was found that a satisfactory printing can be carried out by this first modification of the third embodiment of the recording head without generating a deteriorated picture quality, even when a multi-printing was carried out by ejecting the ink from all of the nozzles 404.

Figure 37:
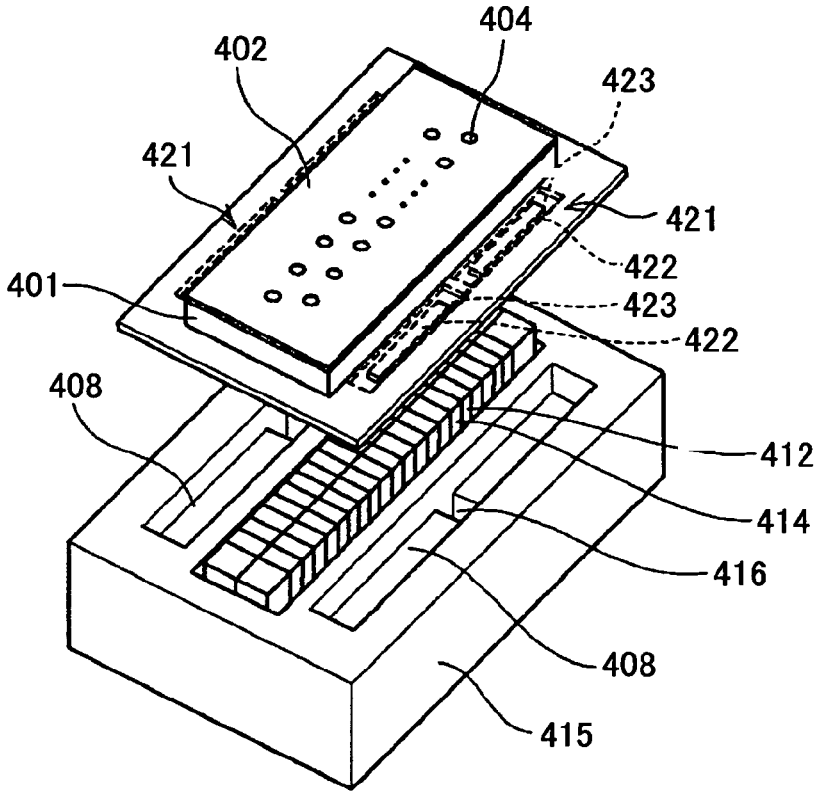
FIG. 37 is a disassembled perspective view showing a second modification of the third embodiment of the recording head according to the present invention.
Figure 38:
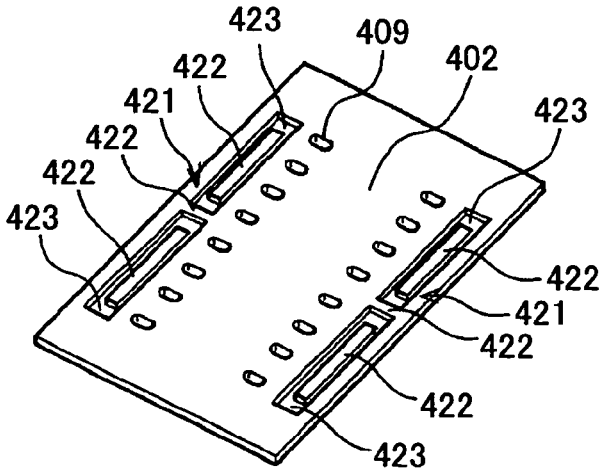
FIG. 38 is a perspective view showing a vibration plate shown in FIG. 37 viewed from a bottom surface thereof.

Next, a description will be given of a second modification of the third embodiment of the recording head according to the present invention, by referring to FIGS. 37 and 38. FIG. 37 is a disassembled perspective view showing the second modification of the third embodiment of the recording head, and FIG. 38 is a perspective view showing a vibration plate shown in FIG. 37 viewed from a bottom surface thereof. In FIGS. 37 and 38, those parts which are essentially the same as those corresponding parts in FIGS. 30 through 34 are designated by the same reference numerals, and a description thereof will be omitted.

The free vibration plate 421 shown in FIG. 37 which forms the wall surface of the common ink chamber 408 has 2 thin portions 423 arranged on each side in the peripheral portion thereof as shown in FIG. 38, and a thick portion 422 is formed at the central portion of the free vibration surface 421 in the form of an island within each thin portion 423 and between the adjacent thin portions 423 which are separated along the longitudinal direction of the common ink chamber 408.

The third comparison example and this second modification of the third embodiment of the recording head were respectively mounted on a printer and print tests were carried out. As a result of the print tests, it was confirmed that a deteriorated picture quality is generated when a multi-printing was carried out by the third comparison example by ejecting the ink from all of the nozzles 404. But on the other hand, it was found that a satisfactory printing can be carried out by this second modification of the third embodiment of the recording head without generating a deteriorated picture quality, even when a multi-printing was carried out by ejecting the ink from all of the nozzles 404.

Figure 39:
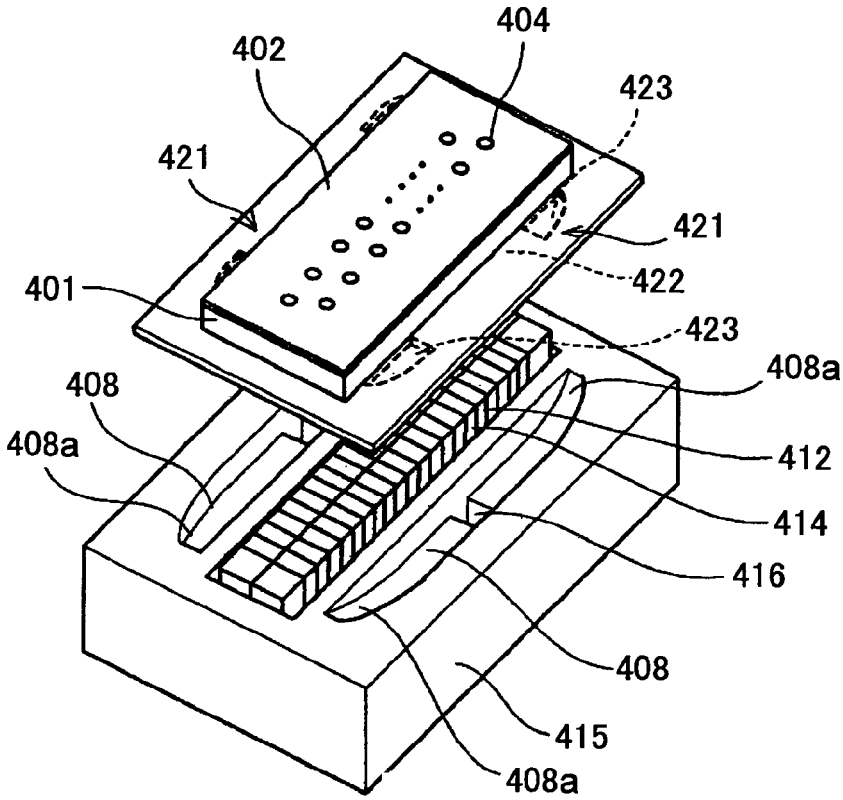
FIG. 39 is a disassembled perspective view showing a third modification of the third embodiment of the recording head according to the present invention.
Figure 40:
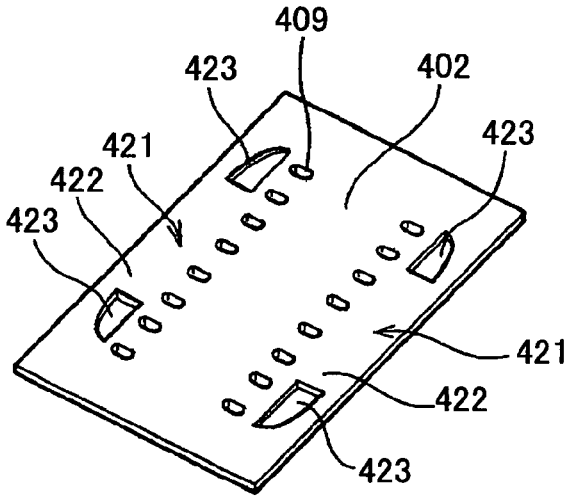
FIG. 40 is a perspective view showing a vibration plate shown in FIG. 39 viewed from a bottom surface thereof.

Next, a description will be given of a third modification of the third embodiment of the recording head according to the present invention, by referring to FIGS. 39 and 40. FIG. 39 is a disassembled perspective view showing the third modification of the third embodiment of the recording head, and FIG. 40 is a perspective view showing a vibration plate shown in FIG. 39 viewed from a bottom surface thereof. In FIGS. 39 and 40, those parts which are essentially the same as those corresponding parts in FIGS. 30 through 34 are designated by the same reference numerals, and a description thereof will be omitted.

As shown in FIG. 39, the width of the common ink chamber 408 in a direction perpendicular to the longitudinal direction thereof narrows towards an end portion 408*a*, so as to efficiently eject air bubbles. The free vibration plate 421 shown in FIG. 39 which forms the wall surface of the common ink chamber 408 has thick portions 422 and thin portions 423 arranged in correspondence with the shape of the common ink chamber 408. That is, the think portions 423 have shapes corresponding to the shape of the end portions 408*a* of the common ink chamber 408.

The third comparison example and this third modification of the third embodiment of the recording head were respectively mounted on a printer and print tests were carried out. As a result of the print tests, it was confirmed that a deteriorated picture quality is generated when a multi-printing was carried out by the third comparison example by ejecting the ink from all of the nozzles 404. But on the other hand, it was found that a satisfactory printing can be carried out by this third modification of the third embodiment of the recording head without generating a deteriorated picture quality, even when a multi-printing was carried out by ejecting the ink from all of the nozzles 404.

By providing the thin portions 423 at or in vicinities of the portions of the free vibration plate 421 where the width of the of the free vibration plate 421 in the direction perpendicular to the longitudinal direction of the common ink chamber 408 narrows, it is possible to effectively suppress and damp the pressure change of the common ink chamber 408. In other words, since the damping capacity of a plate member is approximately proportional to a cube of the length thereof, if the free vibration surface 421 is a plate member having no thin portions 423, the damping capacity greatly deteriorates at the portion of the free vibration surface 421 where the width which narrows. Hence, by providing the thin portions 423 at or in the vicinities of the portions of the free vibration surface 421 where the width narrows, it is possible to effectively reduce the pressure of the common ink chamber 408.

By narrowing the shape of the thin portion 423 towards the end portion of the common ink chamber 408 along the longitudinal direction thereof, it is possible to improve the ink flow, and the pressure of the common ink chamber 408 can be effectively reduced while improving the ejection of air bubbles.

Normally, if the cross sectional area of the common ink chamber cut along a direction perpendicular to the longitudinal direction thereof were to decrease towards the end portion along the longitudinal direction and the width of the free vibration surface were also to narrow towards the end portion, the damping capacity would deteriorate to thereby increase the pressure within the common ink chamber. Hence, reducing the cross sectional area of the common ink chamber towards the end portion would greatly affect the pressure within the common ink chamber.

But according to this third embodiment of the recording head, the thin portions 423 are provided in the free vibration surface 421 at or in the vicinities of the portion where the cross sectional area of the common ink chamber 408 decreases. Hence, it is possible to reduce the pressure of the common ink chamber 408. In addition, it is possible to improve the ink flow by decreasing cross sectional area of the common ink chamber 408 towards the end portion.

Therefore, it is possible to shape the common ink chamber 408 so that the air bubbles can be ejected satisfactorily while suppressing the increase of the pressure of the common ink chamber 408.

Figure 41:
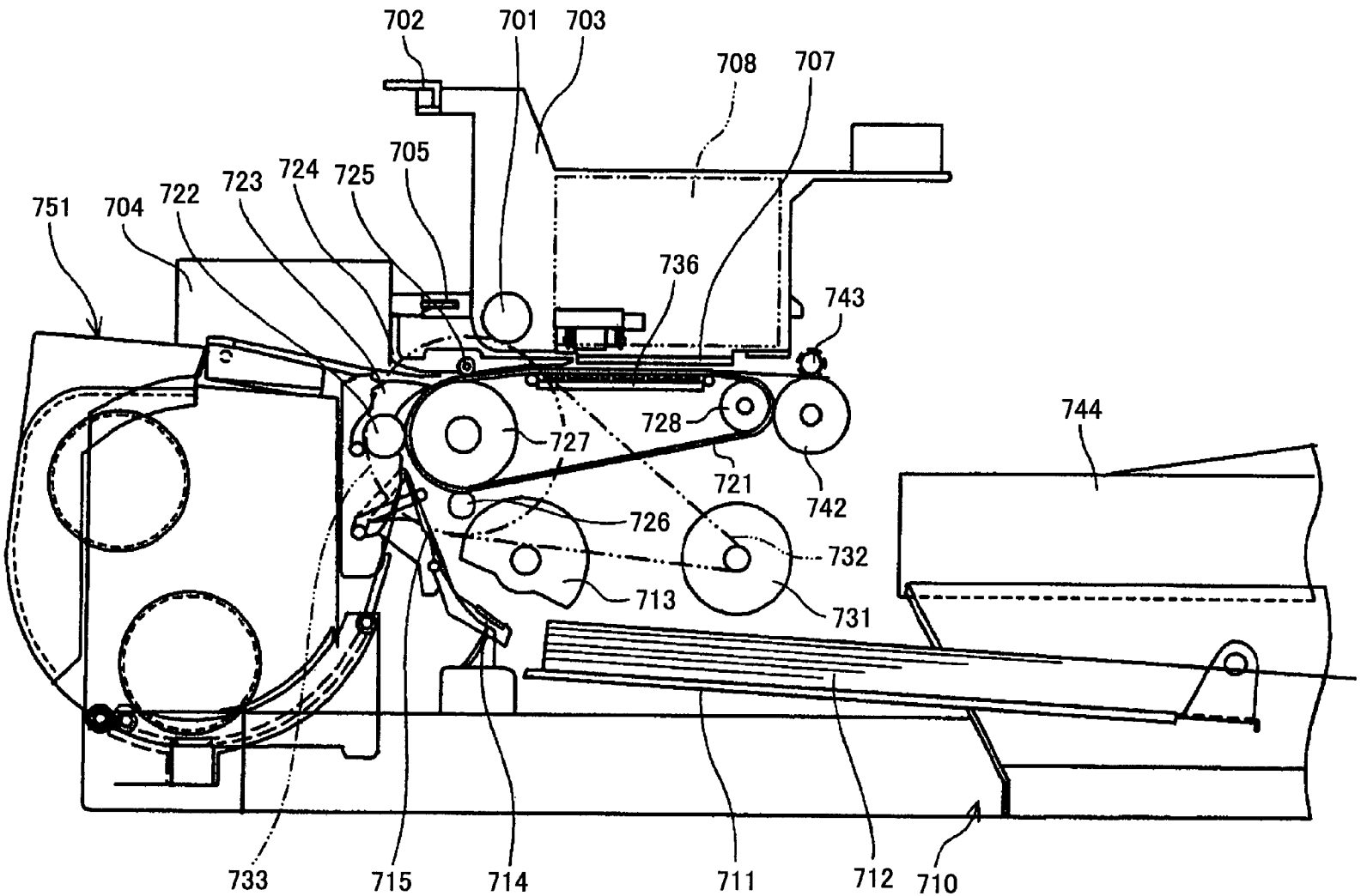
FIG. 41 is a side view for explaining a portion of a third embodiment of the image forming apparatus according to the present invention.
Figure 42:
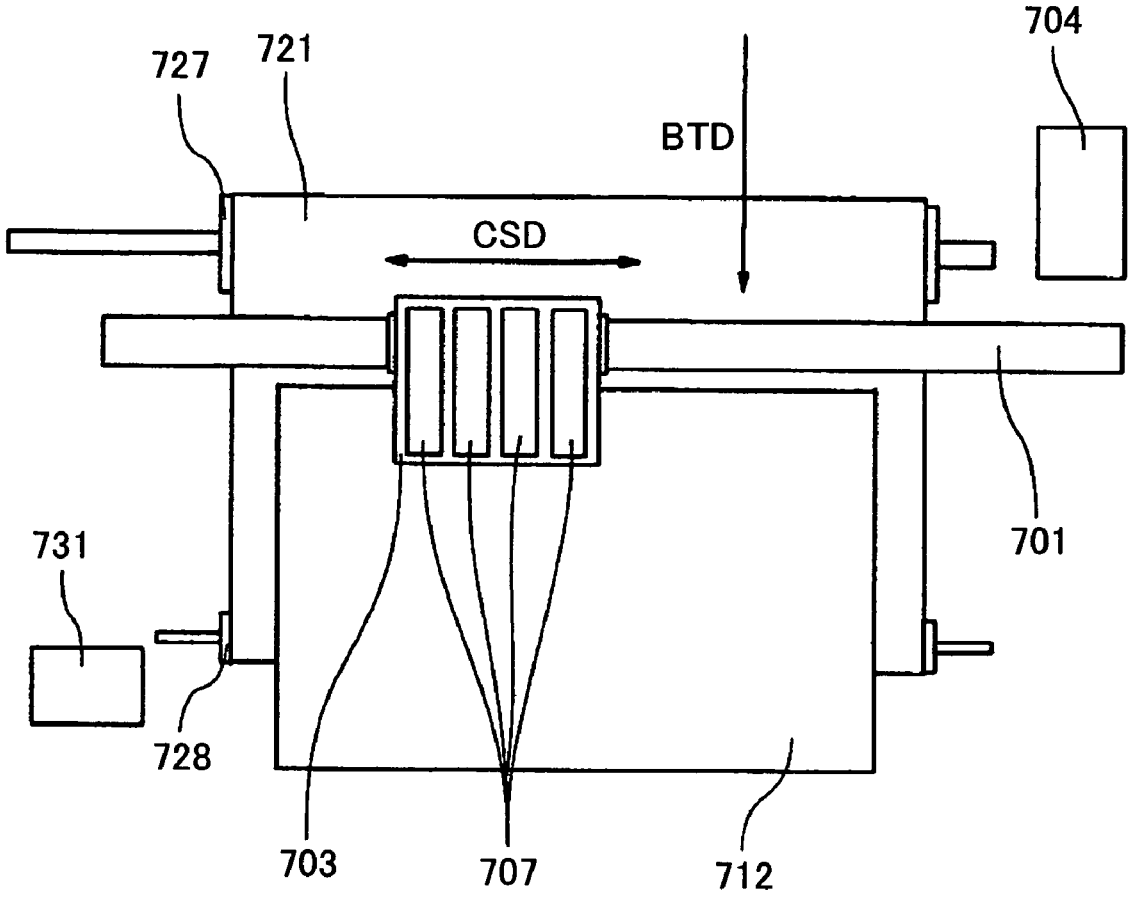
FIG. 42 is a plan view showing a portion of the image forming apparatus shown in FIG. 41.

Next, a description will be given of a third embodiment of the image forming apparatus according to the present invention, by referring to FIGS. 41 and 42. FIG. 41 is a side view for explaining a portion of the third embodiment of the image forming apparatus according to the present invention, and FIG. 42 is a plan view showing a portion of the image forming apparatus shown in FIG. 41. In this third embodiment of the image forming apparatus, the present invention is applied to an ink-jet recording apparatus. Further, this third embodiment of the image forming apparatus employs a third embodiment of the carriage according to the present invention.

In the ink-jet recording apparatus shown in FIGS. 41 and 42, a carriage 703 is slidably supported by a guide rod 701 and a stay 702 which are fixed across right and left side plates (not shown). The carriage 707 is moved in a carriage scan direction (main scan direction) CSD shown in FIG. 42 by a main scan motor 704 via a timing belt 705.

The carriage 703 includes a recording head unit made up of 4 recording heads 707 for ejecting Y, C, M and Bk inks. Each recording head 707 as the structure of any of the third embodiment and the first through third modifications of the third embodiment of the recording head described above. The nozzles of the recording heads 707 are arranged in a direction perpendicular to the main scan direction CSD, so as to eject the Y, C, M and Bk inks downwards in FIG. 41.

As shown in FIG. 41, sub-tanks 708 containing the Y, C, M and Bk inks and to supply the Y, C, M and Bk inks to the corresponding recording heads 707, is provided on the carriage 703. Although not shown in FIG. 41, the Y, C, M and Bk inks are supplied from main tanks (or ink cartridges) to the sub-tanks 708 via respective ink supply tubes.

On the other hand, a paper supply part is provided to supply recording media 712 such as paper stacked on a stacking part 711, such as a paper supply cassette 710. The paper supply part includes a paper supply roller 713 for separating and supplying each recording medium 712 stacked on the stacking part 711, and a separating pad 714 confronting the paper supply roller 713. The separating pad 714 is made of a material having a large coefficient of friction, and is urged towards the paper supply roller 713.

A transport part transports the recording medium 712 which is supplied from the paper supply part, under the recording heads 707. The transport part includes a transport belt 712 on which the recording medium 712 is adhered by electrostatic attraction and transported, a counter roller 722 for transporting the recording medium 712 which is received from the paper supply part via a guide 715 between the counter roller 722 and the transport belt 721, a transport guide 723 for turning the recording medium 712 which is transported approximately vertically by approximately 90 degrees to follow the transport belt 721, and a tip end pushing roller 725 which is pushed towards the transport belt 721 by a pushing member 724. A charging roller 726 forms a charging means for charging the surface of the transport belt 721.

The transport belt 721 is formed by an endless belt that is provided across a transport roller 727 and a tension roller 728. The transport belt 721 moves in a belt transport direction BTD shown in FIG. 42 when the transport roller 727 is rotated by a sub scan motor 731 via a timing belt 732 and a timing roller 733.

The transport belt 721 includes a front surface 721*a* and a back surface. The front surface 721*a* is made of a resin, such as ETFE pure material, which has not been subjected to resistance control and purely having a thickness of approximately 40 μm. This front surface 721*a* forms a medium adhering (or attracting) surface on which the recording medium 712 adheres. The back surface is made of the same material as the front surface 721*a*, but has been subjected to resistance control using carbon, so as to function as an intermediate resistance layer or ground layer.

The charging roller 726 contacts the front surface 721*a* of the transport belt 721, and rotates as the transport belt 721 moves. For example, a pushing force of 2.5 N is applied at both ends of a shaft carrying the charging roller 726. The transport roller 727 also functions as a ground roller, and contacts the back surface (intermediate resistance layer) of the transport belt 721 to ground the back surface.

A guide member 736 is provided on the rear side of the transport belt 721, in correspondence with a recording region of the recording heads 707. A top surface of the guide member 736 project towards the recording heads 707 than a tangential line connecting the transport roller 727 and the tension roller 728 which support the transport belt 721. Hence, the transport belt 721 is pushed upwards by the top surface of the guide member 736 and guided in the recording region of the recording heads 707.

A paper eject part is provided to eject the recording medium 712 which is recorded with an image by the recording heads 707. The paper eject part includes a separating part for separating the recording medium 712 from the transport belt 721, paper eject rollers 742 and 743, and a paper eject tray 744 on which the ejected recording media 712 are stacked. A duplex paper supply unit 751 is detachably provided on a rear part of the ink-jet recording apparatus. The duplex paper supply unit 751 enters the recording medium 712 which is returned by moving the transport belt 721 in a reverse direction and reversing sides before supplying the reversed recording medium 712 again between the counter roller 722 and the transport belt 721.

The recording medium 712 is separated and supplied one by one from the paper supply part, and the recording medium 712 which is transported approximately vertically is guided by the guide 715, and transported in a state pinched between the transport belt 721 and the counter roller 722. Thereafter, the tip end of the recording medium 712 is guided by the transport guide 723 and pushed against the transport belt 721 by the tip end pushing roller 725, to turn the transport direction of the recording medium 712 by approximately 90 degrees.

An alternating voltage from a high voltage source (not shown) is supplied to the charging roller 726 under control of a control circuit (not shown), so that a positive output and a negative output is alternately repeated with respect to the charging roller 726. Hence, an alternating charge voltage pattern, that is, a charge pattern which is alternately charged to positive and negative polarities in a band-shape having a predetermined width in a sub scan direction, is formed on the transport belt 721. The sub scan direction corresponds to the moving direction of the transport belt 721. When the recording medium 712 is supplied onto the transport belt 721 which is charged in this manner, the recording medium 712 is polarized to charges opposite to charge pattern on the transport belt 721 to thereby form parallel-connection capacitors. As a result, the recording medium 712 is attracted to and adheres on the transport belt 721, and the recording medium 712 is transported in the sub scan direction when the transport belt 721 moves.

By driving the recording heads 707 depending on an image signal while moving the carriage in the main scan direction CSD, the ink drop from each driven recording head 707 is ejected on the recording medium 712 which is stationary, to record 1 line. After the recording medium 712 is transported by a predetermined amount, the next line is recorded in a similar manner. When a recording end signal or, a signal indicating that the rear end of the recording medium 712 has reached the recording region is received, the recording operation is ended and the recording medium 712 is ejected onto the paper eject tray 744.

In this case, in each of the recording heads 707, the pressure change of the common ink chamber is suppressed so that a stable ink-jet characteristic is obtained, as described above in conjunction with the third embodiment and the first through third modifications of the third embodiment of the recording head. For this reason, it is possible to record an image having a high picture quality on the recording medium 712.

Further, the recording head according to the present invention may eject a fluid other than ink, such as DNA sample, resist, pattern material and the like. The carriage and the image forming apparatus according to the present invention may be provided with such a recording head which ejects a fluid other than ink.

Further, the present invention is not limited to these embodiments, but various variations and modifications may be made without departing from the scope of the present invention.

The invention claimed is:

1. A recording head comprising:

a plurality of nozzles for ejecting a fluid;

a plurality of pressure-applied chambers arranged in a predetermined direction and each communicating with a corresponding one of the nozzles; and a common chamber having a plurality of wall surfaces and configured to supply the fluid to the pressure-applied chambers, wherein at least one of the wall surfaces of the common chamber, along the predetermined direction, has a pressure absorbing surface with rigidity lower than those of other wall surfaces and configured to absorb a pressure change, wherein said pressure absorbing surface is formed by a pressure absorbing member having a non-uniform thickness, and wherein the pressure absorbing surface is divided into a central portion and two end portions on both sides of the central portion along the predetermined direction, and an average thickness of the pressure absorbing member at the central portion is larger than an average thickness of the pressure absorbing member at the end portions.

2. The recording head as claimed in claim 1, wherein the end portions of the pressure absorbing member includes a second thick portion provided in a portion thereof.

3. The recording head as claimed in claim 2, wherein the thick portion and the second thick portion of the pressure absorbing member have the same thickness.

4. The recording head as claimed in claim 1, further comprising:

a vibration plate forming at least one surface of the pressure-applied chambers, wherein a layer forms said vibration plate and at least a portion of the pressure absorbing member.

5. A recording head comprising:

a plurality of nozzles for ejecting a fluid;

a plurality of pressure-applied chambers arranged in a predetermined direction and each communicating with a corresponding one of the nozzles; and a common chamber having a plurality of wall surfaces and configured to apply the fluid to the pressure-applied chambers, wherein at least one of the wall surfaces or the common chamber, along the predetermined direction, has a pressure absorbing surface with a rigidity lower than those of other wall surfaces and configured to absorb a pressure change, wherein said pressure absorbing surface is formed by a pressure absorbing member having a non-uniform thickness, wherein the pressure absorbing member has a thin portion and a thick portion having at least two kinds of thicknesses, and wherein the thick portion is provided at a central portion of the pressure absorbing member along the predetermined direction, and the thin portion is provided on both sides of the central portion of the pressure absorbing member along the predetermined direction.

6. The recording head as claimed in claim 5, which satisfies a relationship $$0.25<Ux/Tx<0.45$$

where Ux (μm) denotes a length of the thin portion along the predetermined direction X and Tx (μm) denotes a total length of the pressure absorbing member along the predetermined direction.

7. A recording head comprising:

a plurality of nozzles for ejecting a fluid;

a plurality of pressure-applied chambers arranged in a predetermined direction and each communicating with a corresponding one of the nozzles; and a common chamber having a plurality of wall surfaces and configured to supply the fluid to the pressure-applied chambers, wherein at least one of the wall surfaces of the common chamber, along the predetermined direction, has a pressure absorbing surface with a rigidity lower than those of other wall surfaces and configured to absorb a pressure change, wherein said pressure absorbing surface is formed by a pressure absorbing member having a non-uniform thickness, wherein the pressure absorbing member has a thin portion and a thick portion having at least two kinds of thicknesses, and wherein the pressure absorbing member has a stacked structure made up of a plurality of layers, and a number of layers of the stacked structure forming the thin portion is different from a number of layers of the stacked structure forming the thick portion.

8. A recording head comprising:

a plurality of nozzles for ejecting a fluid;

a plurality of pressure-applied chambers arranged in a predetermined direction and each communicating with a corresponding one of the nozzles; and a common chamber having a plurality of wall surfaces and configured to supply the fluid to the pressure-applied chambers, wherein at least one of the wall surfaces of the common chamber, along the predetermined direction, has a pressure absorbing surface with a rigidity lower than those of other wall surfaces and configured to absorb a pressure change, wherein said pressure absorbing surface is formed by a pressure absorbing member having a non-uniform thickness, wherein the pressure absorbing member has a thin portion and a thick portion having at least two kinds of thicknesses, and wherein the recording head satisfies a relationship $$2\times10^{10}<Ud^2\times Uy^{-2.5}\times E^{2/3}<9\times10^{10}$$

where Ud (mn) denotes a thickness of the thin portion, Uy (m) denotes a length of the thin portion along a direction perpendicular to the predetermined direction, Ux (m) denotes a length of the thin portion 22 the predetermined direction, and E (Pa) denotes a Young's modulus of the thin portion.

9. A recording head comprising:

a plurality of nozzles for ejecting a fluid;

a plurality of pressure-applied chambers arranged in a predetermined direction and each communicating with a corresponding one of the nozzles; and a common chamber having a plurality of wall surfaces and configured to supply the fluid to the pressure-applied chambers, wherein at least one of the wall surfaces of the common chamber, along the predetermined direction, has a pressure absorbing surface with a rigidity lower than those of other wall surfaces and configured to absorb a pressure change, wherein said pressure absorbing surface is formed by a pressure absorbing member having a non-uniform thickness, and wherein the pressure absorbing member has a Young's modulus of 100 MPa or greater.

10. The recording head as claimed in claim 9, wherein the pressure absorbing member is made of nickel.

11. A Line type recording head comprising a recording head including:

a plurality of nozzles for ejecting a fluid;

a plurality of pressure-applied chambers arranged in a predetermined direction and each communicating with a corresponding one of the nozzles; and a common chamber having a plurality of wall surfaces and configured to supply the fluid to the pressure-applied chambers, wherein at least one of the wall surfaces of the common chamber, along the predetermined direction, has a pressure absorbing surface with a rigidity lower than those of other wall surfaces and configured to absorb a pressure change, wherein said pressure absorbing surface is formed by a pressure absorbing member having a non-uniform thickness, and wherein the pressure absorbing surface is divided into a central portion and two end portions on both sides of the central portion along the predetermined direction, and an average thickness of the pressure absorbing member at the central portion is larger than an average thickness of the pressure absorbing member at the end portions.

12. A line type recording head comprising a recording head including:

a plurality of nozzles for ejecting a fluid;

a plurality of pressure-applied chambers ranged in a predetermined direction and each communicating with a corresponding one of the nozzles;

a common chamber having a plurality of wall surfaces and configured to supply the fluid to the pressure-applied chambers; and a plurality of pressure converting means for varying pressures within the pressure-applied chambers, at least one of the wall surfaces of the common chamber, along the predetermined direction, having a pressure absorbing surface with a rigidity lower than those of other wall surfaces and configured to absorb a pressure change, said pressure absorbing surface being formed by a pressure absorbing member having a plurality of portions with different rigidities.

13. A carriage comprising:

a recording head including:

a plurality of nozzles for ejecting a fluid;

a plurality of pressure-applied chambers arranged in a predetermined direction and each communicating with a corresponding one of the nozzles; and a common chamber having a plurality of wall surfaces and configured to supply the fluid to the pressure-applied chambers, wherein at least one of the wall surfaces of the common chamber, along the predetermined direction, has a pressure absorbing surface with a rigidity lower than those of other wall surfaces and configured to absorb a pressure change, wherein said pressure absorbing surface is formed by a pressure absorbing member having a non-uniform thickness, and wherein the pressure absorbing surface is divided into a central portion and two end portions on both sides of the central portion along the predetermined direction, and an average thickness of the pressure absorbing member at the central portion is larger than an average thickness of the pressure absorbing member at the end portions; and a fluid cartridge configured to supply the fluid to the recording head.

14. A carriage comprising:

a line type recording head including:

a plurality of nozzles for ejecting a fluid;

a plurality of pressure-applied chambers arranged in a predetermined direction and each communicating with a corresponding one of the nozzles;

a common chamber having a plurality of wall surfaces and configured to supply the fluid to the pressure-applied chambers; and a plurality of pressure converting means for varying pressures within the pressure-applied chambers, wherein at least one of the wall surfaces of the common chamber, along the predetermined direction, has a pressure absorbing surface with a rigidity lower than those of other wall surfaces and configured to absorb a pressure change, and wherein said pressure absorbing surface is formed by a pressure absorbing member having a plurality of portions with different rigidities; and a fluid cartridge configured to supply the fluid to the recording head.

15. An image forming apparatus comprising:

a recording head including:

a plurality of nozzles for ejecting a fluid;

a plurality of pressure-applied chambers arranged in a predetermined direction and each communicating with a corresponding one of the nozzles; and a common chamber having a plurality of wall surfaces and configured to supply the fluid to the pressure-applied chambers, wherein at least one of the wall surfaces of the common chamber, along the predetermined direction, has a pressure absorbing surface with a rigidity lower than those of other wall surfaces and configured to absorb a pressure change, wherein said pressure absorbing surface is formed by a pressure absorbing member having a non-uniform thickness, and wherein the pressure absorbing surface is divided into a central portion and two end portions on both sides of the central portion along the predetermined direction, and an average thickness of the pressure absorbing member at the central portion is larger than an average thickness of the pressure absorbing member at the end portions;

a fluid cartridge configured to supply the fluid to the recording head; and a carriage, accommodating the recording head and the fluid cartridge, configured to move in a main scan direction which is perpendicular to the predetermined direction.

16. An image forming apparatus comprising:

a line type recording head including:

a plurality of nozzles for electing a fluid;

a plurality of pressure-applied chambers arranged in a predetermined direction and each communication with a corresponding one of the nozzles;

a common chamber having a plurality of wall surfaces and configured to supply the fluid to the pressure-applied chambers; and a plurality of pressure converting means for varying pressures within the pressure-applied chambers, wherein at least one of the wall surfaces of the common chamber, along the predetermined direction, has a pressure absorbing surface with a rigidity lower than those of other wall surfaces and configured to absorb a pressure change, and wherein said pressure absorbing surface is formed by a pressure absorbing member having a plurality of portions with different rigidities;

a fluid cartridge configured to supply the fluid to the recording head; and a carriage, accommodating the recording head and the fluid cartridge, configured to move in a main scan direction which is perpendicular to the predetermined direction.

17. A recording head comprising:

a plurality of nozzles for ejecting a fluid;

a plurality of pressure-applied chambers arranged in a predetermined direction and each communicating with a corresponding one of the nozzles;

a common chamber having a plurality of wall surfaces and configured to supply the fluid to the pressure-applied chambers; and a plurality of pressure convening means for varying pressures within the pressure-applied chambers, wherein;

at least one of the wall surfaces of the common chamber, alone the predetermined direction, has a damping surface with a rigidity lower than those of other wall surfaces and configured to absorb a pressure by vibration, said damping surface is formed by a pressure absorbing member which partially has a region where no damping surface is formed, such that the damping surface extends for a length along the predetermined direction less than a total length of the common chamber along the predetermined direction, at least a portion of wall surfaces forming the pressure-applied chambers has a rigidity lower than the other wall surfaces to form a vibration plate of the pressure converting means, and both the vibration plate and the damper surface are formed by a common first layer.

18. The recording head as claimed in claim 17, wherein the pressure absorbing member has a continuous surface forming the damper surface.

19. The recording head as claimed in claim 17, wherein the region is arranged on both ends of said at least one of the wall surfaces of the common chamber along the predetermined direction.

20. The recording head as claimed in claim 17, further comprising:

a second layer partially formed on the common first layer and forming the region, said common first layer extending in the predetermined direction and forming the damper surface by a surface thereof not having the second layer formed thereon.

21. The recording head as claimed in claim 17, wherein the damper surface has an elasticity lower than those of the other wall surfaces of the common chamber.

22. A recording head comprising:

a plurality of nozzles for ejecting a fluid;

a plurality of pressure-applied chambers arranged in a predetermined direction and each communicating with a corresponding one of the nozzles;

a common chamber having plurality of wall surfaces and configured to supply the fluid to the pressure-applied chambers; and a plurality of pressure converting means for varying pressures within the pressure-applied chambers, wherein at least one of the wall surfaces of the common chamber, along the predetermined direction, has a damping surface with a rigidity lower than those of other wall surfaces and configured to absorb a pressure by vibration, wherein said damping surface is formed by a pressure absorbing member which partially has a region where no damping surface is formed, such that the damping surface extends for a length along the predetermined direction less than a total length of the common chamber along the predetermined direction, and wherein an elasticity Gd (Pa) of the pressure absorbing member forming the damper surface satisfies a relationship $$1.0\times10^{-13}<Lx^{-1}\times Ldx\times Ldy\times Td^{-0.3}\times Gd^{-1}<2.0\times10^{-13}$$

where Lx (m) denotes a length of the common chamber along the predetermined direction, Ldx (m) denotes a length of the damper surface of the pressure absorbing member along the predetermined direction, Ldy (m) denotes a length of the damper surface of the pressure absorbing member along a direction perpendicular to the predetermined direction, and Td (m) denotes a thickness of the pressure absorbing member forming the damper surface.

23. A carriage comprising:

a recording head including:

a plurality of nozzles for ejecting a fluid;

a plurality of pressure-applied chambers arranged in a predetermined direction and each communicating with a corresponding one of the nozzles;

a common chamber having a plurality of wall surfaces and configured to supply the fluid to the pressure-applied chambers; and a plurality of pressure converting means for varying pressures within the pressure-applied chambers, wherein at least one of the wall surfaces of the common chamber, along the predetermined direction, has a damping surface with a rigidity lower than those of other wall surfaces and configured to absorb a pressure by vibration, wherein said damping surface is formed by a pressure absorbing member which partially has a region where no damping surface is formed, such that the damping surface extends for a length along the predetermined direction less than a total length of the common chamber along the predetermined direction; and a fluid cartridge configured to supply the fluid to the recording head.

24. An image forming apparatus comprising:

a recording head including:

a plurality of nozzles for ejecting a fluid:

a plurality of pressure-applied chambers arranged in a predetermined direction and each communicating with a corresponding one of the nozzles;

a common chamber having a plurality of wall surfaces and configured to supply the fluid to the pressure-applied chambers; and a plurality of pressure converting means for varying pressures within the pressure-applied chambers, wherein at least one of the wall surfaces of the common chamber, along the predetermined direction, has a damping surface with a rigidity lower than those of other wall surfaces and configured to absorb a pressure by vibration, wherein said damping surface is formed by a pressure absorbing member which partially has a region where no damping surface is formed, such that the damping surface extends for a length along the predetermined direction less than a total length of the common chamber along the predetermined direction;

a fluid cartridge configured to supply the fluid to the recording head; and a carriage, accommodating the recording head and the fluid cartridge, configured to move in a main scan direction which is perpendicular to the predetermined direction.

25. A recording head comprising:

a plurality of nozzles for ejecting a fluid;

a plurality of pressure-applied chambers arranged in a predetermined direction and each communicating with a corresponding one of the nozzles; and a common chamber having a plurality of wall surfaces and configured to supply the fluid to the pressure-applied chambers, wherein at least one of the wall surfaces of the common chamber has a free vibration surface having thick portions and thin portions, and wherein the thin portions are arranged in vicinities of a portion of the free vibration surface where a width of the free vibration surface along a direction perpendicular to the predetermined direction narrows compared to other portions.

26. The recording head as claimed in claim 25, wherein a member forming the free vibration surface integrally forms a surface of the pressure-applied chamber.

27. The recording head as claimed in claim 26, wherein the thick portions have a thickness equal to a thickness of a member forming a wall surface of the pressure-applied chamber.

28. A recording head comprising:

a plurality of nozzles for ejecting a fluid;

a plurality of pressure-applied chambers arranged in a predetermined direction and each communicating with a corresponding one of the nozzles; and a common chamber having a plurality of wall surfaces and configured to supply the fluid to the pressure-applied chambers, wherein at least one of the wall surfaces of the common chamber has a free vibration surface having thick portions and thin portions, and wherein a member forming the free vibration surface has a stacked structure made up of a plurality of stacked layers.

29. A recording head comprising:

a plurality of nozzles for ejecting a fluid;

a plurality of pressure-applied chambers arranged in a predetermined direction and each communicating with a corresponding one of the nozzles; and a common chamber having a plurality of wall surfaces and configured to supply the fluid to the pressure-applied chambers, wherein at least one of the wall surfaces of the common chamber has a free vibration surface having thick portions and thin portions, and wherein the thin portions are arranged in vicinities of a portion of the common chamber where a cross sectional area of the common chamber cut along a direction perpendicular to the predetermined direction decreases compared to other portions.

30. A recording head comprising:

a plurality of nozzles for ejecting a fluid;

a plurality of pressure-applied chambers arranged in a predetermined direction and each communicating with a corresponding one of the nozzles; and a common chamber having a plurality of wall surfaces and configured to supply the fluid to the pressure-applied chambers, wherein at least one of the wall surfaces of the common chamber has a free vibration surface having thick portions and thin portions, and wherein a cross sectional area of the common chamber cut along a direction perpendicular to the predetermined direction decreases towards an end portion of the common chamber along the predetermined reaction.

31. A carriage comprising:

a recording head including:

a plurality of nozzles for ejecting a fluid;

a plurality of pressure-applied chambers arranged in a predetermined direction and each communicating with a corresponding one of the nozzles; and a common chamber having a plurality of wall surfaces and configured to supply the fluid to the pressure-applied chambers, wherein at least one of the wall surfaces of the common chamber has a free vibration surface having thick portions and thin portions, and wherein the thin portions are arranged in vicinities of a portion of the free vibration surface where a width of the free vibration surface along a direction perpendicular to the predetermined direction narrows compared to other portions; and a fluid cartridge configured to supply the fluid to the recording head.

32. An image forming apparatus comprising:

a recording head including:

a plurality of nozzles for electing a fluid;

a plurality of pressure-applied chambers arranged in a predetermined direction and each communicating with a corresponding one of the nozzles; and a common chamber having a plurality of wall surfaces and configured to supply the fluid to the pressure applied chambers, wherein at least one of the wall surfaces of the common chamber has a free vibration surface having thick portions and thin portions, and wherein the thin portions are arranged in vicinities of a portion of the free vibration surface where a width of the free vibration surface along a direction perpendicular to the predetermined direction narrows compared to other portions;

a fluid cartridge configured to supply the fluid to the recording head; and a carriage, accommodating the recording head and the fluid cartridge, configured to move in a main scan direction which is perpendicular to the predetermined direction.

* * * * *